US011340553B2

(12) United States Patent
Watariguchi et al.

(10) Patent No.: US 11,340,553 B2
(45) Date of Patent: May 24, 2022

(54) PROCESS CARTRIDGE AND ELECTROPHOTOGRAPHIC APPARATUS

(71) Applicant: CANON KABUSHIKI KAISHA, Tokyo (JP)

(72) Inventors: Kaname Watariguchi, Kanagawa (JP); Kohei Makisumi, Shizuoka (JP); Fumiyuki Hiyama, Shizuoka (JP); Yuichi Kikuchi, Shizuoka (JP); Kazuhiro Yamauchi, Shizuoka (JP); Hirotaka Araki, Yokohama (JP); Seiichi Miyazawa, Zama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 70 days.

(21) Appl. No.: 17/070,179

(22) Filed: Oct. 14, 2020

(65) Prior Publication Data

US 2021/0116858 A1 Apr. 22, 2021

(30) Foreign Application Priority Data

Oct. 18, 2019 (JP) ..... JP2019-191566

(51) Int. Cl.
*G03G 21/18* (2006.01)
*G03G 5/05* (2006.01)
*G03G 5/06* (2006.01)

(52) U.S. Cl.
CPC ..... *G03G 21/1814* (2013.01); *G03G 5/0553* (2013.01); *G03G 5/0696* (2013.01)

(58) Field of Classification Search
CPC ..... G03G 21/1814; G03G 5/0553; G03G 5/0696; G03G 15/0233
See application file for complete search history.

(56) References Cited

U.S. PATENT DOCUMENTS 6,697,587 B2 2/2004 Harada
8,298,670 B2 10/2012 Muranaka et al.
(Continued)

FOREIGN PATENT DOCUMENTS

EP 0543672 B1 5/1996
JP 05142846 A 6/1993
(Continued)

OTHER PUBLICATIONS

Minoru Umeda, "Extrinsic Photocarrier Generation Process and Kinetics of a Layered Organic Photoreceptor", Journal of Chemical Society of Japan, 1996, No. 11, pp. 932 to 937.
(Continued)

*Primary Examiner* — Sandra Brase
(74) *Attorney, Agent, or Firm* — Venable LLP

(57) ABSTRACT

The process cartridge includes an electrophotographic photosensitive member having a first support and a photosensitive layer; and a charging member. In the photosensitive member when an electric current is measured which flows when a voltage is applied to a surface while being varied, a gradient $a_1$ of a low electric field region and a gradient $a_2$ of a high electric field region satisfy $a_2/a_1 \geq 1.50$, in a graph. The charging member includes a second support having an electroconductive outer surface, and a second electroconductive layer including a matrix and a plurality of domains being dispersed in the matrix, at least a portion of the domain is exposed to an outer surface which includes at least the matrix and at least a portion of the domain, and a volume resistivity $\rho_M$ of the matrix is $1.00 \times 10^5$ times or higher of a volume resistivity $\rho_D$ of the domain.

11 Claims, 5 Drawing Sheets

(56) References Cited

U.S. PATENT DOCUMENTS

| | | | |
|---|---|---|---|
| 8,449,975 | B2 | 5/2013 | Hirakoso et al. |
| 8,491,994 | B2 | 7/2013 | Harada et al. |
| 8,628,854 | B2 | 1/2014 | Yamauchi et al. |
| 8,668,987 | B2 | 3/2014 | Yamauchi et al. |
| 8,715,830 | B2 | 5/2014 | Yamada et al. |
| 8,771,818 | B2 | 7/2014 | Nishioka et al. |
| 8,841,052 | B2 | 9/2014 | Watariguchi et al. |
| 8,852,743 | B2 | 10/2014 | Kikuchi et al. |
| 8,974,991 | B2 | 3/2015 | Kawahara et al. |
| 9,023,465 | B2 | 5/2015 | Yamada et al. |
| 9,068,083 | B2 | 6/2015 | Tanaka et al. |
| 9,086,643 | B2 | 7/2015 | Kikuchi et al. |
| 9,128,403 | B2 | 9/2015 | Yamauchi et al. |
| 9,146,482 | B2 | 9/2015 | Watanabe et al. |
| 9,360,789 | B1 | 6/2016 | Masu et al. |
| 9,436,106 | B2 | 9/2016 | Kuno et al. |
| 9,442,408 | B2 | 9/2016 | Yamauchi et al. |
| 9,442,451 | B2 | 9/2016 | Yamauchi et al. |
| 9,459,542 | B2 | 10/2016 | Tanaka et al. |
| 9,500,966 | B2 | 11/2016 | Watariguchi et al. |
| 9,535,347 | B2 | 1/2017 | Watariguchi et al. |
| 9,541,854 | B2 | 1/2017 | Kikuchi et al. |
| 9,547,250 | B2 | 1/2017 | Kikuchi et al. |
| 9,551,949 | B2 | 1/2017 | Yamauchi et al. |
| 9,563,139 | B2 | 2/2017 | Kawahara et al. |
| 9,581,931 | B2 | 2/2017 | Yamada et al. |
| 9,599,913 | B2 | 3/2017 | Nishioka et al. |
| 9,639,009 | B2 | 5/2017 | Yamaguchi et al. |
| 9,645,515 | B2 | 5/2017 | Kuno et al. |
| 9,645,516 | B2 | 5/2017 | Kawahara et al. |
| 9,651,888 | B2 | 5/2017 | Muranaka et al. |
| 9,665,028 | B2 | 5/2017 | Arimura et al. |
| 9,665,029 | B2 | 5/2017 | Hino et al. |
| 9,671,706 | B2 | 6/2017 | Nii et al. |
| 9,740,133 | B2 | 8/2017 | Yamauchi et al. |
| 9,811,009 | B2 | 11/2017 | Yamada et al. |
| 9,811,021 | B2 | 11/2017 | Muranaka et al. |
| 9,869,032 | B2 | 1/2018 | Kawahara et al. |
| 9,897,931 | B2 | 2/2018 | Nishioka et al. |
| 9,958,802 | B2 | 5/2018 | Kikuchi et al. |
| 9,964,914 | B2 | 5/2018 | Arimura et al. |
| 9,977,353 | B2 | 5/2018 | Nishioka et al. |
| 10,012,924 | B2 | 7/2018 | Yoshidome et al. |
| 10,018,927 | B2 | 7/2018 | Yamada et al. |
| 10,018,934 | B2 | 7/2018 | Yamada et al. |
| 10,108,129 | B2 | 10/2018 | Yamaguchi et al. |
| 10,280,148 | B2 | 5/2019 | Nishioka et al. |
| 10,416,588 | B2 | 9/2019 | Masu et al. |
| 10,649,350 | B2 | 5/2020 | Yamaguchi et al. |
| 10,678,154 | B2 | 6/2020 | Takashima et al. |
| 10,678,158 | B2 | 6/2020 | Kikuchi et al. |
| 2012/0224887 | A1* | 9/2012 | Harada ..... G03G 15/0233 428/521 |
| 2012/0308261 | A1 | 12/2012 | Tsuru et al. |
| 2013/0281276 | A1 | 10/2013 | Watanabe et al. |
| 2014/0141362 | A1 | 5/2014 | Watariguchi et al. |
| 2015/0093693 | A1 | 4/2015 | Watariguchi et al. |
| 2015/0331346 | A1 | 11/2015 | Yamauchi et al. |
| 2015/0346617 | A1 | 12/2015 | Kawahara et al. |
| 2015/0362847 | A1 | 12/2015 | Tanaka et al. |
| 2019/0187580 | A1* | 6/2019 | Yoshiyama ..... G03G 15/0233 |
| 2020/0159137 | A1 | 5/2020 | Ito et al. |
| 2020/0174385 | A1 | 6/2020 | Sakakibara et al. |
| 2020/0310264 | A1 | 10/2020 | Kurachi et al. |
| 2020/0310265 | A1 | 10/2020 | Nishioka et al. |
| 2020/0310266 | A1 | 10/2020 | Kikuchi et al. |
| 2020/0393771 | A1 | 12/2020 | Iwasaki et al. |
| 2020/0409278 | A1 | 12/2020 | Makisumi et al. |
| 2020/0409279 | A1 | 12/2020 | Sekiya et al. |
| 2020/0409280 | A1 | 12/2020 | Ishida et al. |
| 2020/0409281 | A1 | 12/2020 | Watariguchi et al. |
| 2021/0026295 | A1 | 1/2021 | Yamada et al. |
| 2021/0033996 | A1 | 2/2021 | Kikuchi et al. |

FOREIGN PATENT DOCUMENTS

| | | | |
|---|---|---|---|
| JP | 2002003651 | A | 1/2002 |
| JP | 2005114950 | A | 4/2005 |
| JP | 2006154565 | A | 6/2006 |
| JP | 2012163954 | A | 8/2012 |
| JP | 2015210366 | A | 11/2015 |
| JP | 2017072833 | A | 4/2017 |

OTHER PUBLICATIONS

P.G.Roetling:Visual Performance and Image Coding,SPIE/OSA,74,Image Processing,1976,pp. 195-199.

The Institute of Electrical Engineers of Japan, University Course "Dielectric Phenomenology" The Institute of Electrical Engineers of Japan, pp. 230 to 234.

U.S. Appl. No. 17/065,258, Kohei Makisumi, filed Oct. 7, 2020.

U.S. Appl. No. 17/069,919, Tsutomu Nishida, filed Oct. 14, 2020.

U.S. Appl. No. 17/070,054, Yuka Ishiduka, filed Oct. 14, 2020.

U.S. Appl. No. 17/070,085, Fumiyuki Hiyama, filed Oct. 14, 2020.

U.S. Appl. No. 17/071,103, Noriyoshi Umeda, filed Oct. 15, 2020.

U.S. Appl. No. 17/071,109, Shohei Kototani, filed Oct. 15, 2020.

U.S. Appl. No. 17/071,227, Kosuke Fukudome, filed Oct. 15, 2020.

U.S. Appl. No. 17/071,246, Tomohiro Unno, filed Oct. 15, 2020.

U.S. Appl. No. 17/071,283, Yoshitaka Suzumura, filed Oct. 15, 2020.

U.S. Appl. No. 17/071,535, Hiroyuki Tomono, filed Oct. 15, 2020.

U.S. Appl. No. 17/071,540, Tsuneyoshi Tominaga, filed Oct. 15, 2020.

U.S. Appl. No. 17/072,206, Satoru Nishioka, filed Oct. 16, 2020.

* cited by examiner

PROCESS CARTRIDGE AND ELECTROPHOTOGRAPHIC APPARATUS

BACKGROUND OF THE INVENTION

Field of the Invention

The present disclosure relates to a process cartridge and an electrophotographic apparatus, each of which including an electrophotographic photosensitive member and a charging unit.

Description of the Related Art

The electrophotographic process relating to the electrophotographic photosensitive member (hereinafter, also simply referred to as "photosensitive member") mainly includes four processes of charging, exposure, development and transfer, and a process such as cleaning or pre-exposure is added as needed. Among the processes, the charging process and the exposure process are processes that control the charge distribution of the photosensitive member and form a desired potential distribution on the surface of the photosensitive member, which are important processes for forming an electrostatic latent image.

However, considering the characteristics of the photosensitive member from the viewpoint of electric resistance, there is a trade-off relationship that it is desirable that the photosensitive member has a high resistance at the time of charging, but on the contrary, it is desirable that the photosensitive member has a low resistance at the time of exposure. Specifically, in the charging process, it is desirable that the electric charge to be given to the photosensitive member by the electric discharge from or frictional charging due to the charging member is not erased by dark decay or the like, and an electric potential of the dark portion is maintained. Accordingly, it is necessary that the dark portion of the photosensitive member at the time of charging has high electric resistance.

In contrast, in the exposure process, it is desirable that only the electric charges of the light-irradiated portion by the exposure unit are rapidly erased, and a light portion potential approaches 0 [V], in other words, that luminous sensitivity is high. Accordingly, it is necessary that the light portion of the photosensitive member at the time of exposure has the low electric resistance.

As described above, it brings an increase in the contrast between the dark portion potential and the light portion potential to give a large contrast between the time of charging and the time of exposure to the electric resistance of the photosensitive member. Accordingly, particularly in order to form a high-frequency latent image distribution in which distances between exposed portions and non-exposed portions are small and to obtain a high-resolution image, it is required that the contrast of the electric resistance is large.

On the other hand, a corona type, a roller type or the like has been conventionally and mainly used as a charging unit for giving the electric charge to the photosensitive member during the charging process. Among the types, an applied voltage necessary for the corona type is high compared to that of the roller type, and because of this, the size and cost of the power source required becomes a problem. Furthermore, the corona type generates a large amount of ozone, and there is a problem from the viewpoint of the environment; and in addition, so-called image deletion is also a problem, in which the surface resistance of the photosensitive member decreases due to attachment of ozone and moisture, and the latent image distribution is blurred by a phenomenon that the charge distribution formed in the exposure process collapses due to charge transfer on the surface of the photosensitive member.

On the other hand, in the roller type, the applied voltage is low, and the size and cost of the power source can be suppressed low; and in addition, the amount of ozone to be generated is small. Accordingly, the roller type is excellent from the viewpoint of environment, and effective also for the image deletion. However, the roller type has a problem of being inferior to the corona type in uniformity of charging.

In Japanese Patent Application Laid-Open No. 2015-210366, a photosensitive member is described that includes: a support; a first electroconductive layer which is formed so that nonlinearity is given to a voltage (V)-current (I) characteristic (in Japanese Patent Application Laid-Open No. 2015-210366, the first electroconductive layer is referred to as an undercoat layer, but will be hereinafter referred to as the "first electroconductive layer", in the present disclosure, and further, a layer to be formed between the first electroconductive layer and the photosensitive layer will be hereinafter referred to as an "undercoat layer" in the present disclosure); and a photosensitive layer formed thereon. This nonlinearity (hereinafter, referred to as "varistor property") means that a graph when a voltage is taken as the horizontal axis and an electric current is taken as the vertical axis (hereinafter, referred to as "V-I curve") is downwardly convexed. Because the first electroconductive layer has such a varistor property, the resistance of the first electroconductive layer becomes large at the time of charging, during which a voltage shared by the first electroconductive layer is relatively small; charge injection from the support is blocked; and a charging failure is suppressed which is caused by scum (hereinafter, also referred to as "fog"). On the other hand, the electric charges move through the photosensitive layer due to the light irradiation. As a result, at the time of exposure, at which the voltage shared by the first electroconductive layer becomes relatively large, the resistance of the first electroconductive layer transiently decreases, and an afterimage (also referred to as "ghost") is suppressed which is caused by charge trap in the first electroconductive layer.

In Japanese Patent Application Laid-Open No. H05-142846, a photosensitive member is described that includes an electroconductive substrate; a photosensitive layer; and a surface protective layer (hereinafter, also simply referred to as "protective layer"), which has the varistor property. Because the protective layer has the varistor property, the resistance of the protective layer becomes large at the time of charging, at which the voltage shared by the protective layer is relatively small, and the dark portion potential is maintained; and accordingly the protective layer can be stably charged to a high potential. On the other hand, at the time of exposure, at which the electric charges move in the photosensitive layer due to the light irradiation, and as a result, the voltage shared by the protective layer becomes relatively large, the resistance of the protective layer transiently decreases, and the electric charges move rapidly in the protective layer; and thereby the luminous sensitivity increases. Because of this, the contrast between the dark portion potential and the light portion potential can be increased without impairing the charging characteristics.

In Japanese Patent Application Laid-Open No. 2006-154565, a charging roller is described that has an electroconductive elastic layer in which an electron conductive material and an ion conductive material are dispersed between a surface and a shaft arranged so that the surface rotates while coming in contact with a photosensitive member. The electron conductive material has a large nonlinearity of the V-I curve and is inferior also in dispersion uniformity in a binder resin. On the other hand, the ion conductive material is excellent in the linearity of the V-I curve and the uniformity of dispersion in the binder resin, but has a problem of contaminating the photosensitive member by exudation of a material component. Then, by the use of a charging member in which both of the materials are hybridized, the uniformity of dispersion of the electroconductive material in the binder resin can be enhanced, while the exudation of the ion conductive material is reduced, and charging characteristics having satisfactory uniformity can be obtained.

Japanese Patent Application Laid-Open No. 2002-003651 describes: a rubber composition having a matrix-domain structure that includes a continuous phase of a polymer including an ion conductive rubber material which is mainly formed from a raw rubber A having a volume specific resistivity of $1\times10^{12}$ Ω·cm or smaller, and a particle phase of a polymer which is formed from an electron conductive rubber material that has been made electroconductive by an electroconductive particle mixed in a raw rubber B; and a charging member that includes an elastic layer which is formed from the rubber composition. The matrix-domain structure formed from the ion conductive rubber material and the electron conductive rubber material can thereby suppress contamination of a member to be charged such as the photosensitive member, be excellent in charge uniformity, and simultaneously reduce influences of the environmental change on the nonlinearity and variations of the V-I curve and the electrical characteristics.

SUMMARY OF THE INVENTION

According to the study of the present inventors, in the electrophotographic photosensitive members and charging units described in any of Japanese Patent Application Laid-Open No. 2015-210366, Japanese Patent Application Laid-Open No. H05-142846, Japanese Patent Application Laid-Open No. 2006-154565 and Japanese Patent Application Laid-Open No. 2002-003651, the combination of the photosensitive member and the charging member has not been fully optimized; and accordingly it has been a problem to suppress the image deletion at the time of repeated use for a long period of time or after storage under a high temperature and high humidity environment, while maintaining the luminous sensitivity of the photosensitive member.

Accordingly, an object of the present disclosure is to provide a process cartridge that includes an electrophotographic photosensitive member and a charging unit, and suppresses the image deletion at the time of repeated use for a long period of time or after storage under a high temperature and high humidity environment, while maintaining the luminous sensitivity.

The above object is achieved by the following present disclosure. Specifically, a process cartridge according to the present disclosure is detachably attachable to a main body of an electrophotographic apparatus, and includes an electrophotographic photosensitive member and a charging member, wherein the electrophotographic photosensitive member includes a first support and a photosensitive layer, when an electric current is measured which flows when a voltage is applied to a surface of the electrophotographic photosensitive member while being varied, there exists a point at which gradients change, in a graph in which a horizontal axis is a square root of an electric field strength E [V/m] in the photosensitive layer, and a vertical axis is a common logarithm of the electric current, and when a gradient of the graph is represented by $a_1$, in a region in which the electric field strength is smaller than that of the point at which the gradients change, and a gradient of the graph is represented by $a_2$, in a region in which the electric field strength is larger than that of the point at which the gradients change, $a_2/a_1$ is 1.50 or larger; and the charging member includes a second support having an electroconductive outer surface, and a second electroconductive layer provided on the outer surface of the second support, wherein the second electroconductive layer includes a matrix containing a first rubber, and a plurality of domains that are dispersed in the matrix, wherein the domain includes a second rubber and an electron conducting agent, at least a portion of the domain is exposed to an outer surface of the charging member, and the outer surface of the charging member includes at least the matrix and at least a portion of the domain, wherein when a volume resistivity of the matrix is represented by $\rho_M$ [Ω·cm] and a volume resistivity of the domain is represented by $\rho_D$ [Ω·cm], $\rho_M$ is $1.0\times10^5$ times or higher of $\rho_D$.

According to the present disclosure, a process cartridge can be provided that has an electrophotographic photosensitive member and a charging unit, in which the image deletion at the time of repeated use for a long period of time or after storage under a high temperature and high humidity environment is suppressed, while the luminous sensitivity is maintained.

Further features of the present invention will become apparent from the following description of exemplary embodiments with reference to the attached drawings.

curve, the curve is fitted by a sixth order function, and the function is further subjected to the first-order differentiation. The solid line is a fifth order function obtained by first-order differentiating the sixth order function.

Figure 9:
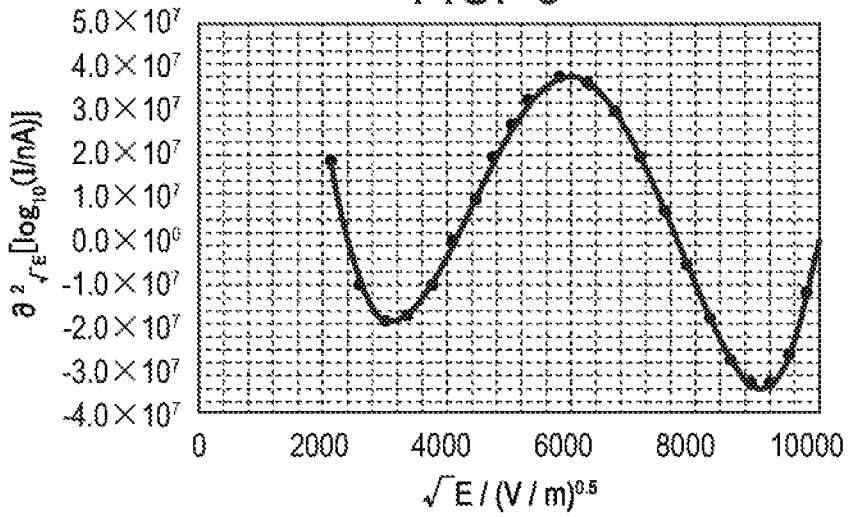

FIG. 9 illustrates a graph in which the measurement result of the voltage-current characteristics (V-I curve) of the electrophotographic photosensitive member described in Example 24 is re-illustrated in the form of the √E-log(I) curve, the curve is fitted by a sixth order function, and the function is further subjected to the second-order differentiation. The solid line is a fourth order function obtained by second-order differentiating the sixth order function.

Figure 10:
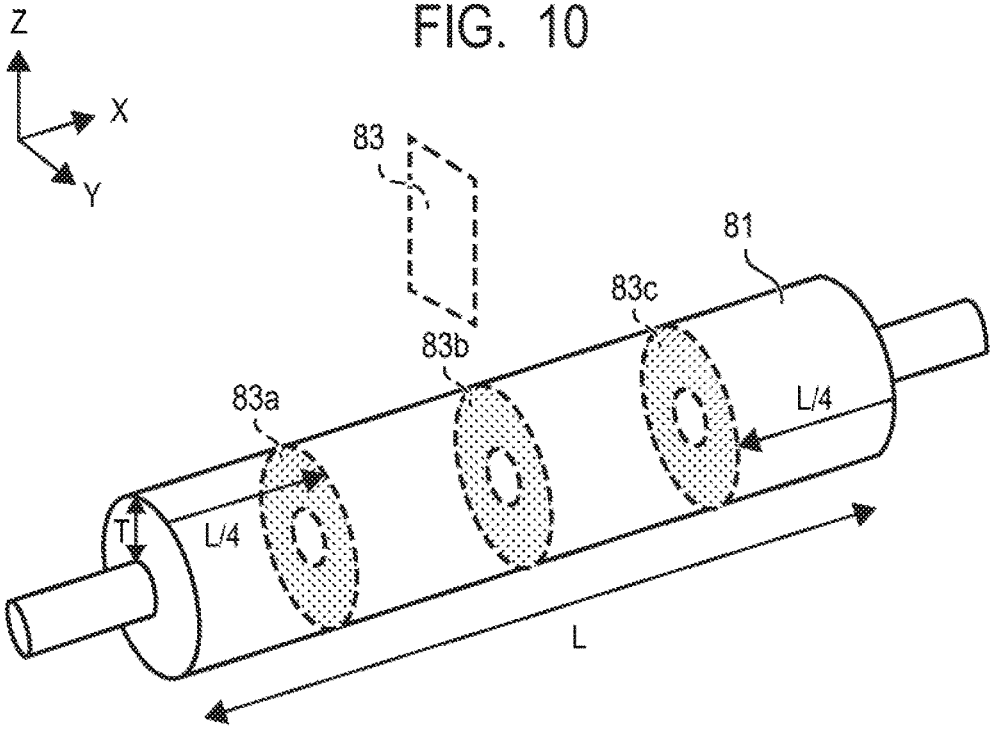

FIG. 10 illustrates an explanatory view of a charging member of the present disclosure, in a sectional cut-out direction.

Figure 11:
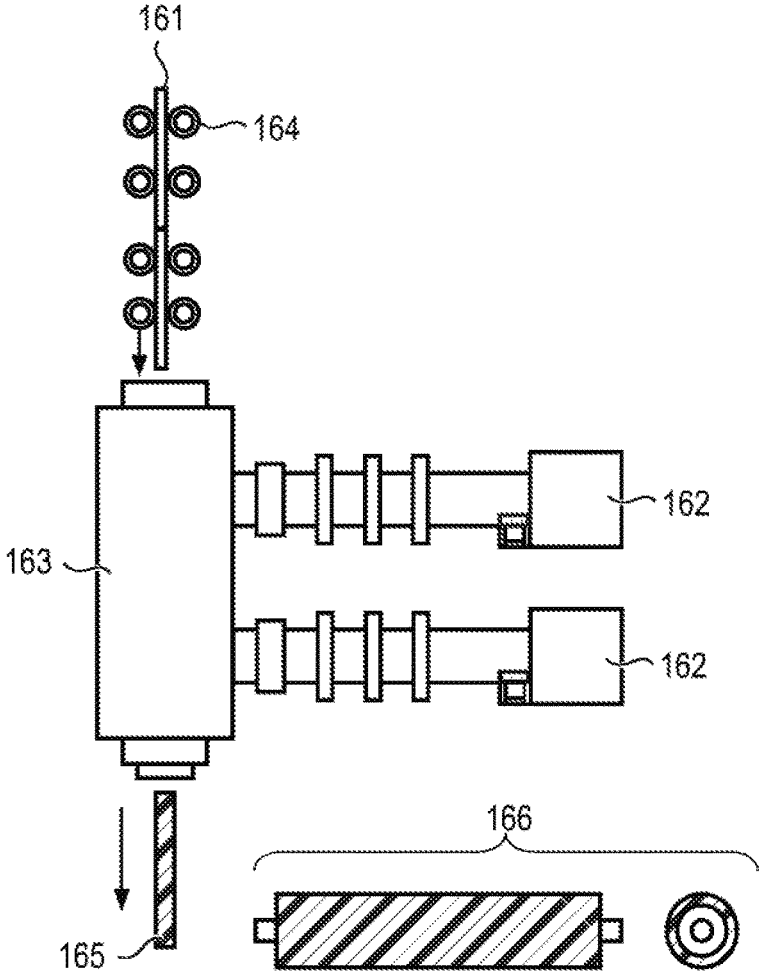

FIG. 11 illustrates an explanatory view of a method of manufacturing the charging member.

DESCRIPTION OF THE EMBODIMENTS

Preferred embodiments of the present invention will now be described in detail in accordance with the accompanying drawings.

The present disclosure relates to a process cartridge detachably attachable to a main body of the electrophotographic apparatus, the process cartridge including an electrophotographic photosensitive member and a charging member, wherein the electrophotographic photosensitive member includes a first support and a photosensitive layer, when an electric current is measured which flows when a voltage is applied to the surface of the electrophotographic photosensitive member while being varied, there exists a point at which gradients change, in a graph in which the horizontal axis is a square root of an electric field strength E [V/m] in the photosensitive layer, and the vertical axis is a common logarithm of the electric current, and when a gradient of the graph is represented by $a_1$, in a region in which the electric field strength is smaller than that of the point at which the gradients change, and a gradient of the graph is represented by $a_2$, in a region in which the electric field strength is larger than that of the point at which the gradients change, $a_2/a_1$ is 1.50 or larger; and the charging member includes a second support having an electroconductive outer surface, and a second electroconductive layer provided on the outer surface of the second support, wherein the second electroconductive layer includes a matrix containing a first rubber, and a plurality of domains that are dispersed in the matrix, wherein the domain includes a second rubber and an electron conducting agent, at least a portion of the domain is exposed to an outer surface of the charging member, and the outer surface of the charging member includes at least the matrix and at least a portion of the domain, wherein when a volume resistivity of the matrix is represented by $\rho_M$ [Ω·cm] and a volume resistivity of the domain is represented by $\rho_D$ [Ω·cm], $\rho_M$ is $1.0\times10^5$ times or higher of $\rho_D$.

The present disclosure also relates to an electrophotographic apparatus that includes the above electrophotographic photosensitive member, a charging unit, an exposure unit, a developing unit and a transfer unit.

As a result of studies by the present inventors, the varistor property which the first electroconductive layer of the photosensitive member and the protective layer of the conventional technology have has not been sufficiently effective in achieving both of the maintenance of the luminous sensitivity and the suppression of the image deletion at the time of repeated use for a long period of time and after storage under a high temperature and high humidity environment. In addition, a charging member of the conventional technology, in which the ion conducting agent and an electron conducting agent are hybridized, and a process cartridge in which the photosensitive member and the charging member are simply combined also have not had a sufficient effect.

Then, the present inventors have found that in order to optimize a combination of the photosensitive member and the charging member and to solve the above problem, it is desirable to design each of and combine both of the photosensitive member and the charging member, in the following way.

<Design of Photosensitive Member>

It has been necessary in the photosensitive member that each of individual layers such as the first electroconductive layer and the protective layer does not have the varistor property, but a strong varistor property having a predetermined level or larger exists in the voltage-current characteristics at the time when all the layers of the photosensitive member including the photosensitive layer are totalized, which is formed on the columnar first support of the present disclosure.

The "voltage-current characteristic when all the layers of the photosensitive member are combined" referred here means a V-I curve (see FIG. 2) at the time when a voltage is applied to the surface of the photosensitive member while the voltage is varied. In addition, the "strong varistor property" referred here means that in the case where the V-I curve has been re-illustrated in the form of the √E-log(I) curve (see FIG. 3), by plotting the square root of the electric field strength [E V/m] obtained by dividing the applied voltage by the film thickness of the photosensitive layer on the horizontal axis, and plotting the common logarithm of the electric current on the vertical axis, the graph is downwardly convexed in the vicinity of a point at which the gradients change. Furthermore, the term "predetermined strong varistor property" referred here means that when a gradient of the graph in a region in which the electric field strength is smaller than the point at which the above gradients change (hereinafter referred to as "low electric field region") is represented by $a_1$, and when a gradient of the graph in a region in which the electric field strength is larger than the point at which the above gradients change (hereinafter referred to as "high electric field region") is represented by $a_2$, $a_2/a_1$ is 1.50 or larger.

Figure 3:
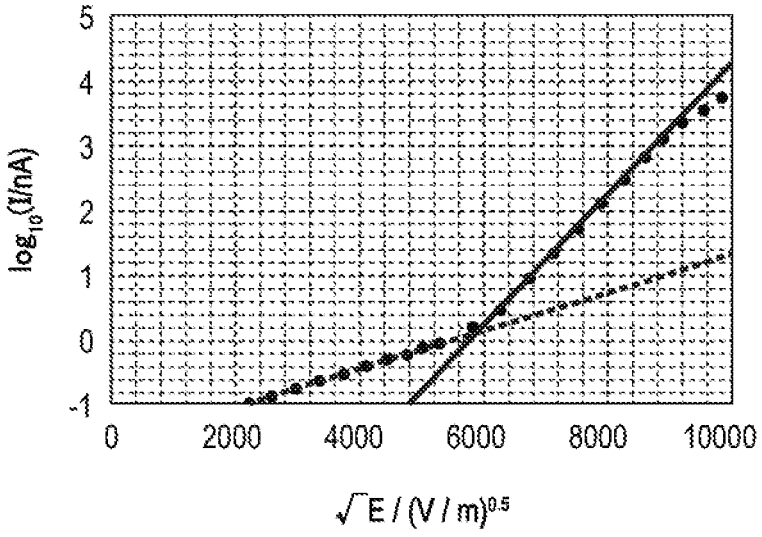
FIG. 3 illustrates a graph which re-illustrates the measurement result of the voltage-current characteristics (V-I curve) of the electrophotographic photosensitive member described in Example 24, in a form of a √E-log(I) curve.

Here, FIG. 3 illustrates a graph in which the measurement result of the voltage-current characteristic (V-I curve) of the electrophotographic photosensitive member described in Example 24 has been re-illustrated in the form of the √E-log(I) curve. The broken line and the solid line illustrated in FIG. 3 are each a result in which a curve in a side in which the electric field is smaller than the point at which the gradients of the graph change has been fitted by a straight line having a gradient $a_1$=0.00029 (broken line), and a curve in a side in which the electric field is larger than the point at which the gradients change has been fitted by a straight line having a gradient $a_2$=0.00101 (solid line).

<Design of Charging Member>

The charging member is a charging member having a second electroconductive layer formed on the columnar second support, that is, a so-called charging roller; the second electroconductive layer has needed to have a matrix-domain structure (see FIG. 4); and furthermore, the matrix portion has needed to have a resistance of a predetermined value or larger compared to the domain portion.

Figure 4:
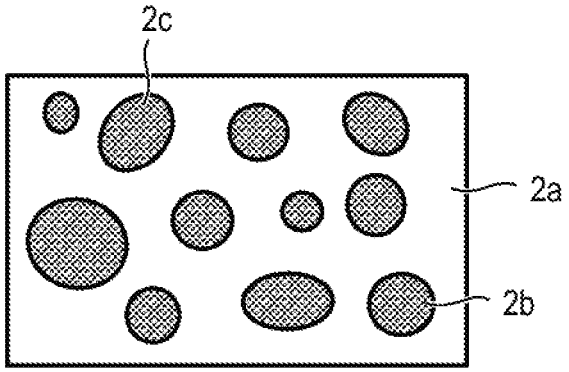
FIG. 4 illustrates a schematic view of a matrix-domain structure which a charging member according to the present disclosure has.

The "matrix-domain structure" of the second electroconductive layer referred here means a structure which includes the matrix portion containing the first rubber (2*a* in FIG. 4), and a plurality of domain portions dispersed in the matrix (2*b* in FIG. 4), and in which the domain contains a second rubber and an electron conducting agent (2*c* in FIG. 4). In addition, "matrix portion has a resistance of a predetermined value or larger compared to the domain portion" referred here means that the ratio $\rho_M/\rho_D$ of the volume resistivity $\rho_M$ [Ω·cm] of the matrix to the volume resistivity $\rho_D$ [Ω·cm] of the domain is $1.0\times10^5$ or larger.

<Combination Effect of Photosensitive Member and Charging Member>

The present inventors consider a mechanism in the following way, by which a process cartridge in which the above optimized photosensitive member and charging member are combined is effective in achieving both of the maintenance of the luminous sensitivity and the suppression of the image deletion at the time of repeated use for a long period of time and after storage under a high temperature and high humidity environment, which is a subject of the present disclosure.

Firstly, the photosensitive member of the present disclosure, which has a strong varistor property, has also a strong contrast between the dark portion potential at the time of charging and the light portion potential at the time of exposure, and accordingly can maintain the luminous sensitivity without impairing the charging characteristics at the time of repeated use for a long period of time. In addition, the present inventors have found that this strong varistor property is caused by an interaction between a layer responsible for charge generation in the photosensitive member and the other layer, or an interaction between a charge generation material in the photosensitive member and the other material such as a charge transport material, and that this characteristic does not appear in a layer alone which does not contain the charge generation material.

Secondly, by combining the photosensitive member having the strong varistor property with the charging roller having the second conductive layer having the matrix-domain structure in which the matrix has the resistance of the predetermined value or larger compared to the domain, a charge distribution corresponding to the matrix-domain structure is generated in the photosensitive member during the charging process in which the photosensitive member and the charging roller come in contact with each other and rotate together. This reason will be described separately, in a region (hereinafter, referred to as discharge region) in which the relationship between the distance of a minute gap between the surfaces of the photosensitive member and the charging roller during the charging process and the strength of the electric field satisfies Paschen's law, and an electric discharge is generated, and in a region (hereinafter, referred to as nip region) in which both of the surfaces come in contact with each other and does not cause the electric discharge, but the maximum electric field is applied to the photosensitive member.

In the discharge region, the electric charge applied from the columnar second support passes through the second electroconductive layer of the charging roller, is discharged toward the photosensitive member from the domain in which the electric resistance is low, and moves onto the photosensitive member. As a result, the charge distribution corresponding to the domain distribution of the charging roller is generated on the photosensitive member. Moreover, at this time, a distribution of an electric field formed by the electric charges on the photosensitive member is formed so as to correspond to the domain distribution, but when the photosensitive member has the strong varistor property, the electric resistance of the photosensitive member temporarily decreases at the portion of the photosensitive member, which corresponds to the domain of the charging roller, to which the strong electric field is applied (hereinafter, referred to as "domain corresponding portion"). As a result, the discharge contrast originating in the contrast of electric resistances between the matrix and the domain of the charging roller synergistically increases, and more electric discharges result in being generated in the domain corresponding portion.

On the other hand, in the nip region, a larger amount of electric current flows into the photosensitive member in the domain corresponding portion in which the electric resistance is low than in the portion at which the matrix of the charging roller comes in contact with the photosensitive member (hereinafter referred to as "matrix corresponding portion"). Accordingly, various residual carriers in the photosensitive member and memories which originate in dielectric polarization are easily canceled in the domain corresponding portion. Moreover, at this time, if the photosensitive member has a strong varistor property, the electric current in the domain corresponding portion becomes synergistically large similarly to the mechanism in the above discharge region, and the effect of canceling the memory of the domain corresponding portion with respect to the matrix corresponding portion becomes large. As a result, compared to the matrix corresponding portion, the domain corresponding portion is more likely to retain electric charges by cancelation of residual carriers and dielectric polarization which cause increase of the dark decay of the photosensitive member, and the charge contrast between the domain corresponding portion and the matrix corresponding portion results in increasing.

By the above reasons, when the photosensitive member and the charging member of the present disclosure are combined, the charge distribution which corresponds to the matrix-domain structure of the charging member is formed on the photosensitive member. Accordingly, the charge potential distribution of the photosensitive member is strongly discretized in such a way as to correspond to the matrix-domain structure of the charging member. The discretized charge potential distribution remains to some extent even after the exposure process, and accordingly the latent image distribution after exposure is also discretized in such a form as to be superimposed on the exposure modulation. As a result, the collapse of the charge distribution due to the charge transfer on the surface of the photosensitive member, which causes the image deletion, is constrained within the discretized region, and it is suppressed that the latent image distribution becomes blurred. In particular, this effect remarkably appears in image deletion under severe conditions such as the time of repeated use for a long period of time and the time after storage in a high temperature and high humidity environment.

<Comparison with Conventional Technology>

In Japanese Patent Application Laid-Open No. 2015-210366, it is merely disclosed that the current-voltage characteristic of a monolayer of a first electroconductive layer which the photosensitive member has have a varistor property, and it is not described that the current-voltage characteristic of the whole photosensitive member including the photosensitive layer has the strong varistor property as in the present disclosure. In fact, the current-voltage characteristics of the monolayers of the first electroconductive layers shown in Reference Examples 1 to 3 in the present disclosure are downwardly convexed, when illustrated by a V-I curve (see FIG. 5), but when being illustrated in a form of √E-log(I) curve, the current-voltage characteristics are convexed upward, from which it is understood that the current-voltage characteristics do not exhibit the strong varistor property.

In addition, in Japanese Patent Application Laid-Open No. 2015-210366, corona charging is assumed as a charging unit, and the matrix-domain structure which the charging roller of the present disclosure has is not described.

In Japanese Patent Application Laid-Open No. H05-142846, it is merely disclosed that the current-voltage characteristics of the surface protective layer which the photosensitive member has have the varistor property, and it is not described that the current-voltage characteristic of the whole photosensitive member including the photosensitive layer has the strong varistor property as in the present disclosure. In particular, in Japanese Patent Application Laid-Open No. H05-142846, the varistor property is expressed by the following Expression (E1):

$$I=aV^b \quad \text{(E1)},$$

where I is an electric current, V is voltage, a is a proportional constant, and b is a voltage nonlinearity coefficient. However, as long as the V-I curve is expressed by Expression (E1), no matter what value a orb is, any V-I curve illustrated in the form of the √E-log(I) curve is convexed upward.

In fact, when the logarithm of both sides of the Expression (E1) is taken, and both of the sides are rewritten through the substitutions of $X=V^{0.5}(\propto E^{0.5})$ and Y=log(I), the following Expression (E2) holds:

$$Y=2b\log X+\log a \quad \text{(E2)}$$

However, the result of the second-order differentiation of Expression (E2) with respect to X becomes always smaller than 0, as is shown in the following Expression (E3):

$$\frac{d^2Y}{dX^2}=-\frac{2b}{X^2}<0 \quad \text{(E3)}$$

It is understood from the calculations in the above Expression (E1) to Expression (E3) that the V-I curve is always convexed upward when being illustrated in the form of the √E-log(I) curve, as long as the V-I curve is expressed by Expression (E1), no matter what value a orb is; and accordingly, it is understood that Expression (E1) does not exhibit such a strong varistor property as in the present disclosure.

In addition, in Japanese Patent Application Laid-Open No. H05-142846, corona charging is assumed as the charging unit, and the matrix-domain structure which the charging roller of the present disclosure has is not described.

In Japanese Patent Application Laid-Open No. 2006-154565, a charging member is disclosed in which an ion conductive material and an electron conductive material are hybridized, but it is not described that an ion conductive material and an electron conductive material form a matrix-domain structure.

In addition, in Japanese Patent Application Laid-Open No. 2006-154565, it is merely described that the photosensitive member has a first electroconductive layer, but it is not assumed that the current-voltage characteristic exhibits a strong varistor property.

In Japanese Patent Application Laid-Open No. 2002-003651, a charging member is disclosed which has a matrix-domain structure including an ion conductive rubber material and an electron conductive rubber material, but the electric resistance of the matrix portion with respect to the domain portion does not satisfy such a condition in the present disclosure that the resistance is high resistance at a predetermined magnification or larger.

In addition, in Japanese Patent Application Laid-Open No. 2002-003651, it is not assumed that the current-voltage characteristic of the photosensitive member exhibits a predetermined strong varistor property.

As has been described above, the photosensitive member and the charging member described in Japanese Patent Application Laid-Open No. 2015-210366, Japanese Patent Application Laid-Open No. H05-142846, Japanese Patent Application Laid-Open No. 2006-154565, and Japanese Patent Application Laid-Open No. 2002-003651 are not sufficiently optimized in the combination for achieving the objectives of the present disclosure.

As has been shown in the above mechanism and in the above comparison with the conventional technology, the effects of the present disclosure can be achieved only when configurations of the above photosensitive member and charging member in the process cartridge of the present disclosure synergistically exert the effects on each other.

[Electrophotographic Photosensitive Member]

The electrophotographic photosensitive member of the present disclosure includes a photosensitive layer. In the electrophotographic photosensitive member of the present disclosure, in the case where an electric current is measured which flows when the voltage is applied while being varied, and when a gradient in a low electric field region is represented by $a_1$ and a gradient in a high electric field region is represented by $a_2$ in a √E-log(I) graph in which the square root of an electric field strength E [V/m] of the photosensitive layer is plotted on the horizontal axis, and the common logarithm of the electric current is plotted on the vertical axis, it is necessary that $a_2/a_1 \geq 1.50$ is satisfied.

In addition, from the viewpoint of suppressing the image deletion at the time of repeated use for a long period of time, it is preferable that the above $a_1$ and $a_2$ satisfy $a_2/a_1 \geq 1.80$. Furthermore, from the viewpoint of suppressing the image deletion after storage in a high temperature and high humidity environment, it is more preferable that the above $a_1$ and $a_2$ satisfy $a_2/a_1 \geq 2.20$.

When a point at which the gradients change in the √E-log(I) graph of the present disclosure, in other words, a point which divides the low electric field region and the high electric field region is determined to be $E^{*0.5}$ $[(V/m)^{0.5}]$, it is preferable that the square root $E^{*0.5}$ of the electric field strength satisfies 3000 $[(V/m)^{0.5}]$ or larger and 9000 $[(V/m)^{0.5}]$ or smaller. In addition, from the viewpoint that an electric field strength calculated from a voltage applied to the charging member in an actual charging process and an actual film thickness of the photosensitive layer of the photosensitive member should be close to E*[V/m], it is more preferable that $E^{*0.5}$ satisfies 5000 $[(V/m)^{0.5}]$ or larger and 7000 $[(V/m)^{0.5}]$ or smaller.

When $E^{*0.5}$ is smaller than 3000 $[(V/m)^{0.5}]$ or 5000 $[(V/m)^{0.5}]$, a large current flows through the photosensitive member during the charging process, regardless of the matrix portion and the domain portion of the charging member, and thereby the number of electric discharges increases in the discharge region and the dark decay decreases in the nip region due to the cancellation of the memory. As a result, the electric charge on the photosensitive member increases uniformly, and accordingly there is a possibility that the charge contrast corresponding to the matrix-domain structure decreases. When $E^{*0.5}$ is larger than 7000 $[(V/m)^{0.5}]$ or 9000 $[(V/m)^{0.5}]$, an electric current does not flow through the photosensitive member during the charging process, regardless of the matrix portion and the domain portion of the charging member, and the number of electric discharges decreases in the discharge region, and the dark decay increases in the nip region due to the remaining of the memory. As a result, the charge on the photosensitive member decreases uniformly, and accordingly there is a possibility that the charge contrast corresponding to the matrix-domain structure decreases.

From the viewpoint of the balance between the light portion characteristic and the dark portion characteristic of the photosensitive member, it is preferable that the gradient $a_2$ in the high electric field region of the present disclosure satisfies 0.00070 or larger and 0.00090 or smaller.

When the $a_2$ is 0.00070 or larger, the luminous sensitivity of the photosensitive member in the light portion becomes sufficient, and when the $a_2$ is 0.00090 or smaller, a capability of retaining the charge potential in the dark portion becomes sufficient; and there is little possibility that the fogging phenomenon occurs.

Examples of a method for manufacturing the electrophotographic photosensitive member of the present disclosure include a method of: preparing coating liquids for each layer, which will be described later; applying the coating liquids in order of desired layers, respectively; and drying the coating liquids. Examples of application methods of the coating liquid at this time include dip coating, spray coating, ink jet coating, roll coating, die coating, blade coating, curtain coating, wire bar coating and ring coating. Among the methods, the dip coating is preferable from the viewpoint of efficiency and productivity.

A support and each layer will be described below.

<First Support>

The electrophotographic photosensitive member includes a first support. It is preferable that the first support is an electroconductive support having electroconductivity. In addition, examples of the shapes of the first support include a cylindrical shape, a belt shape and a sheet shape; and among the shapes, it is preferable to be the cylindrical shape. In addition, the surface of the first support may be subjected to blast treatment, cutting treatment or the like.

As a material of the first support, a metal, a resin, glass and the like are preferable.

The metals include aluminum, iron, nickel, copper, gold, stainless steel, and alloys thereof. Among the metals, it is preferable to use aluminum, and to be a first support made from aluminum.

In addition, the electroconductivity may be imparted to the resin or the glass by treatment such as mixing of or coating with an electroconductive material.

The first support may be used after the surface of the first support has been anodized in an acidic liquid containing an oxidant. In this case, for example, an inorganic acid such as sulfuric acid or chromic acid or an organic acid such as oxalic acid or sulfonic acid can be used as an electrolytic solution, for the anodization treatment. Conditions such as a voltage to be applied, a current density, and a temperature and a time period of the treatment can be selected according to the type of the above electrolytic solution and to the film thickness. In addition, the anodized surface which is used for the electrophotographic photosensitive member of the present disclosure may be subjected to sealing treatment after the electrolytic treatment. As a method of the sealing treatment, there are hot water treatment, steam treatment and treatment with the use of various sealing agents such as nickel acetate and nickel fluoride, but it is preferable to treat the surface with the use of the nickel acetate which can efficiently seal the fine holes.

In particular, due to the support made from aluminum of which the surface is anodized under appropriate conditions and a suitable photosensitive layer provided thereon, an electric current can flow between the photosensitive layer and the first support in the high electric field region, and the predetermined strong varistor property necessary for the present disclosure can be obtained.

<First Electroconductive Layer>

A first electroconductive layer may be provided on the first support. By the first electroconductive layer being provided, the first support can conceal scratches and irregularities on its surface and can control the reflection of light on its surface.

It is preferable that the first electroconductive layer contains an electroconductive particle and a resin.

In particular, when the electroconductive particle and the resin are selected, the compounding ratios between the materials, a dispersion method of the electroconductive particles in the coating liquid for the first electroconductive layer, and the like are controlled, and a suitable photosensitive layer is provided thereon, an electric current can flow between the photosensitive layer and the first electroconductive layer in the high electric field region, and the predetermined strong varistor property necessary for the present disclosure can be obtain.

Examples of the materials for the electroconductive particle include a metal oxide, a metal and carbon black.

Examples of the metal oxides include zinc oxide, aluminum oxide, indium oxide, silicon oxide, zirconium oxide, tin oxide, titanium oxide, magnesium oxide, antimony oxide and bismuth oxide. Examples of the metals include aluminum, nickel, iron, nichrome, copper, zinc and silver.

Among the materials, it is preferable to use a metal oxide as the electroconductive particle, and in particular, it is more preferable to use titanium oxide, tin oxide or zinc oxide.

When the metal oxide is used as the electroconductive particle, the surface of the metal oxide may be treated with a silane coupling agent or the like, or the metal oxide may be doped with an element such as phosphorus or aluminum or an oxide thereof. Examples of doping elements and oxides thereof include phosphorus, aluminum, niobium and tantalum.

In addition, the electroconductive particle may have a multilayered structure having a core material particle and a covering layer with which the particle is covered. Examples of the core material particles include titanium oxide, barium sulfate and zinc oxide. Examples of the covering layers include metal oxides such as tin oxide and titanium oxide.

In addition, when the metal oxide is used as the electroconductive particle, it is preferable for the volume average particle size to be 1 nm or larger and 500 nm or smaller, and is more preferable to be 3 nm or larger and 400 nm or smaller.

Examples of the resins include a polyester resin, a polycarbonate resin, a polyvinyl acetal resin, an acrylic resin, a silicone resin, an epoxy resin, a melamine resin, a polyurethane resin, a phenol resin and an alkyd resin.

In addition, the first electroconductive layer may further contain a concealing agent such as a silicone oil, a resin particle and titanium oxide.

It is preferable for the average film thickness of the first electroconductive layer to be 1 μm or larger and 50 μm or smaller, and is particularly preferable to be 3 μm or larger and 40 μm or smaller.

The first electroconductive layer can be formed by preparing a coating liquid for the first electroconductive layer, which contains each of the above materials and a solvent, forming a coating film of the coating liquid, and drying the coating film. Examples of the solvents to be used for the coating liquid include an alcohol-based solvent, a sulfoxide-based solvent, a ketone-based solvent, an ether-based solvent, an ester-based solvent and an aromatic hydrocarbon-based solvent. Examples of dispersion methods for dispersing the electroconductive particles in the coating liquid for the first electroconductive layer include a method using a paint shaker, a sand mill, a ball mill, or a liquid collision type high speed disperser.

<Undercoat Layer>

In the present disclosure, an undercoat layer may be provided on the first support or the first electroconductive layer. The undercoat layer which has been provided can thereby enhance an adhesion function between layers and impart a charge injection inhibition function.

It is preferable that the undercoat layer contains a resin. In addition, the undercoat layer may be formed as a cured film by polymerization of a composition which contains a monomer having a polymerizable functional group.

Examples of the resins include a polyester resin, a polycarbonate resin, a polyvinyl acetal resin, an acrylic resin, an epoxy resin, a melamine resin, a polyurethane resin, a phenol resin, a polyvinyl phenol resin, an alkyd resin, a polyvinyl alcohol resin, a polyethylene oxide resin, a polypropylene oxide resin, a polyamide resin, a polyamic acid resin, a polyimide resin, a polyamide imide resin and a cellulose resin.

Examples of the polymerizable functional group which the monomer having the polymerizable functional group has include an isocyanate group, a blocked isocyanate group, a methylol group, an alkylated methylol group, an epoxy group, a metal alkoxide group, a hydroxyl group, an amino group, a carboxyl group, a thiol group, a carboxylic acid anhydride group and a carbon-carbon double bond group.

In addition, the undercoat layer may further contain an electron transport substance, a metal oxide, a metal, an electroconductive polymer and the like, for the purpose of enhancing the electric characteristics. Among the materials, it is preferable to use the electron transport substance and the metal oxide.

In particular, when the electron transport substance, a metal oxide, a metal, the electroconductive polymer and the resin are selected, compounding ratios among the materials are controlled, and an appropriate photosensitive layer is provided thereon, an electric current can flow between the photosensitive layer and the undercoat layer in the high electric field region, and the predetermined strong varistor property necessary for the present disclosure can be obtained.

Examples of the electron transport substances include a quinone compound, an imide compound, a benzimidazole compound, a cyclopentadienylidene compound, a fluorenone compound, a xanthone compound, a benzophenone compound, a cyanovinyl compound, a halogenated aryl compound, a silole compound and a boron-containing compound. It is also acceptable to form the undercoat layer as a cured film, by using an electron transport substance having a polymerizable functional group, as the electron transport substance, and copolymerizing the electron transport substance with the above monomer having the polymerizable functional group.

Examples of the metal oxide include indium tin oxide, tin oxide, indium oxide, titanium oxide, zinc oxide, aluminum oxide and silicon dioxide. Examples of the metals include gold, silver and aluminum.

In addition, the undercoat layer may also further contain an additive.

It is preferable for an average film thickness of the undercoat layer to be 0.1 μm or larger and 50 μm or smaller, is more preferable to be 0.2 μm or larger and 40 μm or smaller, and is particularly preferable to be 0.3 μm or larger and 30 μm or smaller.

The undercoat layer can be formed by operations of preparing a coating liquid for the undercoat layer containing each of the above materials and a solvent, forming a coating film of the coating liquid, and drying and/or curing the coating film. Examples of the solvent to be used for the coating liquid include an alcohol-based solvent, a ketone-based solvent, an ether-based solvent, an ester-based solvent and an aromatic hydrocarbon-based solvent.

<Photosensitive Layer>

The photosensitive layer of the electrophotographic photosensitive member is mainly classified into (1) a multilayer type photosensitive layer, and (2) a monolayer type photosensitive layer. The multilayer type photosensitive layer (1) includes a charge generation layer containing a charge generation substance, and a charge transport layer containing a charge transport substance. (2) The monolayer type photosensitive layer has a photosensitive layer which contains both of the charge generation substance and the charge transport substance.

(1) Multilayer Type Photosensitive Layer

The multilayer type photosensitive layer includes the charge generation layer and the charge transport layer.

(1-1) Charge Generation Layer

It is preferable that the charge generation layer contains the charge generation substance and a resin.

Examples of the charge generation substances include an azo pigment, a perylene pigment, a polycyclic quinone pigment, an indigo pigment and a phthalocyanine pigment. Among the substances, the phthalocyanine pigment is preferable from the viewpoint of easily obtaining the predetermined strong varistor property required for the present disclosure.

The present inventors consider the mechanism by which the predetermined strong varistor property is easily obtained when the phthalocyanine pigment is used as the charge generation substance, in the following way.

The predetermined strong varistor property of the present disclosure occurs by a mechanism that electric charges are transferred between the charge generation substance in the charge generation layer and a layer under the charge generation layer in the high electric field region, and the electric charges having the opposite polarity move to the charge transport layer side through the charge generation layer while causing avalanche. At this time, the point at which the gradient of the $\sqrt{E}$-log(I) graph of the present disclosure changes, in other words, a threshold electric field of the low electric field region and the high electric field region mainly depends on the height of the energy barrier which is determined by a combination of the layer under the charge generation layer and the charge generation substance, and on the amount of carriers, which is determined by a film thickness of the charge generation layer. On the other hand, the gradient $a_2$ of the high electric field region depends on the type of conduction mechanism, which is determined by a combination of the layer under the charge generation layer and the charge generation substance, and by whether the generation of the photo carrier in the charge generation layer containing the charge generation substance is an interface type or a bulk type.

This can be explained with the use of the following Theoretical Expression (E4) at the time when the low electric field region and the high electric field region in the √E-log(I) graph can be each fitted by a straight line:

$$I = I_0 \exp\left(-\frac{\phi}{k_B T}\right) \exp\left(\frac{\beta\sqrt{E}}{k_B T}\right). \quad \text{(E4)}$$

Expression (E4) is referred to as Schottky plot. In Expression (E4), $\phi$ represents a height [eV] of the energy barrier, $k_B$ represents the Boltzmann constant [eV/K], T is temperature [K], and $\beta$ is a coefficient [$eV/(V/m)^{0.5}$], which represents an effect by which an energy band deforms in an electric field, and $I_0$ is an electric current value [nA] corresponding to the time when $\phi=0$ and $E=0$.

When the common logarithm of both sides of Expression (E4) is taken, a straight-line fitting expression of the √E-log (I) graph shown in the following Expression (E5) is obtained:

$$\log I = \frac{0.434\beta}{k_B T}\sqrt{E} + \left(\log I_0 - \frac{0.434\phi}{k_B T}\right), \quad \text{(E5)}$$

where note that log(e)=0.434.

As is understood from Expression (E5), the threshold electric field of the low electric field region and the high electric field region of the present disclosure depends on $I_0$ and $\phi$ in the high electric field region. The present inventors have found that $\phi$ in the high electric field region corresponds to the height of the energy barrier, which is determined by the combination of the layer under the charge generation layer and the charge generation substance, and that the $I_0$ in the high electric field region is proportional to an exponent of the film thickness of the charge generation layer. The content in the latter that $I_0$ is proportional to the exponent of the film thickness of the charge generation layer means that the electric charges driven by the high electric field in the charge generation layer causes a snowslide phenomenon, in other words, the avalanche.

On the other hand, as is understood from Expression (E5), the gradient $a_2$ of the graph in the high electric field region of the present disclosure is proportional to a coefficient $\beta$ which indicates an effect by which the energy band deforms in the electric field. Here, $\beta$ varies depending on whether the photosensitive member of the present disclosure exhibits transport-limited conduction or injection-limited conduction in the high electric field region (Reference: The Institute of Electrical Engineers of Japan, University Course "Dielectric Phenomenology" The Institute of Electrical Engineers of Japan, pp. 230 to 234). In the case of the transport-limited conduction, the electric current is dominated by the movement of conduction carriers in the bulk of the charge generation layer or the charge transport layer, and the electric current at the time is referred to as the Poole-Frenkel current. On the other hand, in the case of the injection-limited conduction, the electric current is dominated by the injection of the conduction carriers at the interface between the layer under the charge generation layer and the charge generation layer, or the interface between the charge generation layer and the charge transport layer; and the electric current at the time is referred to as the Schottky current. When $\beta$ at the time when the Poole-Frenkel current flows is written particularly as $\beta_{PF}$, and $\beta$ at the time when the Schottky current flows is written particularly as $\beta_S$, it is known that there is a relation of $\beta_{PF}=2\beta_S$ between the both. Accordingly, $a_2$ of the present disclosure becomes larger in the case of the transport-limited type of conduction mechanism in which the Poole-Frenkel current flows than in the case of the injection-limited type of conduction mechanism in which the Schottky current flows.

From the above, in order that the gradient $a_2$ of the graph becomes large in the high electric field region of the present disclosure and that the amount of electric current in the high electric field region becomes large compared to that in the low electric field region, it is preferable that the following two conditions are satisfied. Specifically, it is preferable that the movement of carrier charges in the bulk of the charge generation layer causes the avalanche, and in addition, it is preferable that the movement of carrier charges in the bulk of the charge generation layer or the charge transport layer is a transport-limited type (Pool-Frenkel type).

On the other hand, when the phthalocyanine pigment is compared with the azo pigment as the charge generation substance, the azo pigment is an interfacial type in which the charge generation position is at the interface between the charge generation layer and the charge transport layer, but the phthalocyanine pigment is a bulk type in which the charge generation position is in the bulk of the charge generation layer (Reference: Minoru Umeda, "Extrinsic Photocarrier Generation Process and Kinetics of a Layered Organic Photoreceptor", Journal of Chemical Society of Japan, 1996, No. 11, pp. 932 to 937). Accordingly, when the phthalocyanine pigment is used as the charge generation substance, the avalanche of the carrier charges in the bulk tends to easily occur compared to that in the azo pigment, and the electric current flowing through the whole photosensitive member tends to easily become the Poole-Frenkel type. As a result, when the phthalocyanine pigment is used as the charge generation substance, the gradient $a_2$ of the graph in the high electric field region of the present disclosure also becomes large, and it becomes easy to obtain the predetermined strong varistor property.

Among the phthalocyanine pigments, oxytitanium phthalocyanine pigment, chlorogallium phthalocyanine pigment and hydroxygallium phthalocyanine pigment are preferable because high luminous sensitivity can be stably obtained.

It is preferable for a content of the charge generation substance in the charge generation layer to be 40% by mass or more and 85% by mass or less, and is more preferable to be 60% by mass or more and 80% by mass or less, with respect to a total mass of the charge generation layer.

Examples of the resins include a polyester resin, a polycarbonate resin, a polyvinyl acetal resin, a polyvinyl butyral resin, an acrylic resin, a silicone resin, an epoxy resin, a melamine resin, a polyurethane resin, a phenol resin, a polyvinyl alcohol resin, a cellulose resin, a polystyrene resin, a polyvinyl acetate resin and a polyvinyl chloride resin. Among the resins, the polyvinyl butyral resin is more preferable.

In addition, the charge generation layer may further contain additives such as an antioxidizing agent and an ultraviolet absorbing agent. Specific examples include a hindered phenol compound, a hindered amine compound, a sulfur compound, a phosphorus compound and a benzophenone compound.

It is preferable for the average film thickness of the charge generation layer to be 0.1 μm or larger and 1 μm or smaller, and is more preferable to be 0.15 μm or larger and 0.4 μm or smaller.

The charge generation layer can be formed by operations of: preparing a coating liquid for the charge generation layer, which contains each of the above materials and a solvent; forming a coating film of the coating liquid; and drying the coating film. Examples of the solvent to be used for the coating liquid include an alcohol-based solvent, a sulfoxide-based solvent, a ketone-based solvent, an ether-based solvent, an ester-based solvent and an aromatic hydrocarbon-based solvent.

(1-2) Charge Transport Layer

It is preferable that a charge transport layer contains a charge transport substance and a resin.

Examples of the charge transport substances include a polycyclic aromatic compound, a heterocyclic compound, a hydrazone compound, a styryl compound, an enamine compound, a benzidine compound, a triarylamine compound, and resins having a group derived from these substances. Among these substances, the triarylamine compound and the benzidine compound are preferable.

It is preferable for a content of the charge transport substance in the charge transport layer to be 25% by mass or more and 70% by mass or less, and is more preferable to be 30% by mass or more and 55% by mass or less, with respect to the total mass of the charge transport layer.

Examples of the resins include a polyester resin, a polycarbonate resin, an acrylic resin and a polystyrene resin. Among the resins, the polycarbonate resin and the polyester resin are preferable. In the polyester resins, a polyarylate resin is particularly preferable.

A content ratio (mass ratio) between the charge transport substance and the resin is preferably 4:10 to 20:10, and is more preferably 5:10 to 12:10.

In addition, the charge transport layer may contain additives such as an antioxidizing agent, an ultraviolet absorbing agent, a plasticizing agent, a leveling agent, a slipperiness imparting agent and an abrasion resistance improver. The specific examples include a hindered phenol compound, a hindered amine compound, a sulfur compound, a phosphorus compound, a benzophenone compound, a siloxane modified resin, silicone oil, a fluorocarbon resin particle, a polystyrene resin particle, a polyethylene resin particle, a silica particle, an alumina particle and a boron nitride particle.

It is preferable for an average film thickness of the charge transport layer to be 5 μm or larger and 50 μm or smaller, is more preferable to be 8 μm or larger and 40 μm or smaller, and is particularly preferable to be 10 μm or larger and 30 μm or smaller.

The charge transport layer can be formed by operations of: preparing a coating liquid for the charge transport layer, which contains each of the above materials and a solvent; forming a coating film of the coating liquid; and drying the coating film. Examples of the solvent to be used for the coating liquid include an alcohol-based solvent, a ketone-based solvent, an ether-based solvent, an ester-based solvent, and an aromatic hydrocarbon-based solvent. Among these solvents, the ether-based solvent or the aromatic hydrocarbon-based solvent is preferable.

(2) Monolayer Type Photosensitive Layer

The monolayer type photosensitive layer can be formed by operations of: preparing a coating liquid for the photosensitive layer containing a charge generation substance, a charge transport substance, a resin and a solvent; forming the coating film of the coating liquid; and drying the coating film. The charge generation substance, the charge transport substance and the resin are the same as the examples of the materials in the above "(1) multilayer type photosensitive layer".

<Protective Layer>

In the present disclosure, a protective layer may also be provided on the photosensitive layer. By having the protective layer provided therein, the electrophotographic photosensitive member can improve its durability.

It is preferable that the protective layer contains an electroconductive particle and/or a charge transport substance, and a resin.

Examples of the electroconductive particles include particles of metal oxides such as titanium oxide, zinc oxide, tin oxide and indium oxide.

Examples of the charge transport substances include a polycyclic aromatic compound, a heterocyclic compound, a hydrazone compound, a styryl compound, an enamine compound, a benzidine compound, a triarylamine compound, and resins having a group derived from these substances. Among the substances, the triarylamine compound and the benzidine compound are preferable.

Examples of the resin include a polyester resin, an acrylic resin, a phenoxy resin, a polycarbonate resin, a polystyrene resin, a phenol resin, a melamine resin and an epoxy resin. Among the resins, the polycarbonate resin, the polyester resin and the acrylic resin are preferable.

In addition, the protective layer may be formed also as a cured film by the polymerization of a composition which contains a monomer having a polymerizable functional group. Examples of the reaction at this time include a thermal polymerization reaction, a photopolymerization reaction, and a radiation-induced polymerization reaction. Examples of the polymerizable functional group which the monomer having a polymerizable functional group has include an acryl group and a methacryl group. As a monomer having the polymerizable functional group, a material having charge transport capability may be used.

The protective layer may contain additives such as an antioxidizing agent, an ultraviolet absorbing agent, a plasticizing agent, a leveling agent, a slipperiness imparting agent and an abrasion resistance improver. The specific additives include a hindered phenol compound, a hindered amine compound, a sulfur compound, a phosphorus compound, a benzophenone compound, a siloxane modified resin, silicone oil, a fluorocarbon resin particle, a polystyrene resin particle, a polyethylene resin particle, a silica particle, an alumina particle and a boron nitride particle.

It is preferable for an average film thickness of the protective layer to be 0.5 μm or larger and 10 μm or smaller, and is preferable to be 1 μm or larger and 7 μm or smaller.

The protective layer can be formed by operations of: preparing a coating liquid for the protective layer, which contains each of the above materials and a solvent; forming a coating film of the coating liquid; and drying and/or curing the coating film. Examples of the solvent to be used for the coating liquid include an alcohol-based solvent, a ketone-based solvent, an ether-based solvent, a sulfoxide-based solvent, an ester-based solvent and an aromatic hydrocarbon-based solvent.

<Gradient $a_1$, Gradient $a_2$, and Method for Measuring Point at which Gradient Changes>

(V-I Measurement)

The V-I curve of the photosensitive member of the present disclosure can be measured with an apparatus which can measure an electric current flowing in the photosensitive member when a voltage is applied to the photosensitive member in a range of an electric field strength of $4\times10^6$ [V/m] or higher and $1\times10^8$ [V/m] or lower.

A rubber electrode, a gold electrode, an ITO electrode or the like can be used as an electrode on the surface of the photosensitive member.

In order to measure the electric current, such a method can be used as to monitor the output current of a power supply for a test of applying a voltage to the electrode on the surface of the photosensitive member, or as to monitor the ground current of the photosensitive member support.

In an Example of the present disclosure, an ITO film having a shape of 35 mm in an axial direction×35 mm in a circumferential direction was vapor-deposited on the surface of the photosensitive member, which became a square shape when the cylindrical photosensitive member was developed; and a voltage [V] was applied to the surface of the photosensitive member through the ITO film, while being sequentially changed from a small absolute value to a large absolute value. At this time, the ground current [nA] of the first support corresponding to each voltage was monitored, and a relationship between the voltage V applied to the surface of the photosensitive member and the electric current I of the corresponding photosensitive member was obtained.

Note that the measurement was performed in a dark place, and a voltage of 0 [V] was applied for 10 seconds before each measurement voltage was applied, so as to thereby remove an influence of the previous charging. In addition, the electric current was measured after 30 seconds after the measurement voltage was applied, and was determined to be the measurement value.

In the measurement, the image forming region of the photosensitive member was equally divided into four parts in the axial direction; and the obtained three divided positions were aligned to the center of the above ITO film, and were determined to be three measurement positions. The measurement was repeated three times at each measurement position, and the average of V-I measurement results of nine points in total was determined to be the V-I curve of the Example.

(Calculation of Point at which Gradient Changes)

Figure 2:
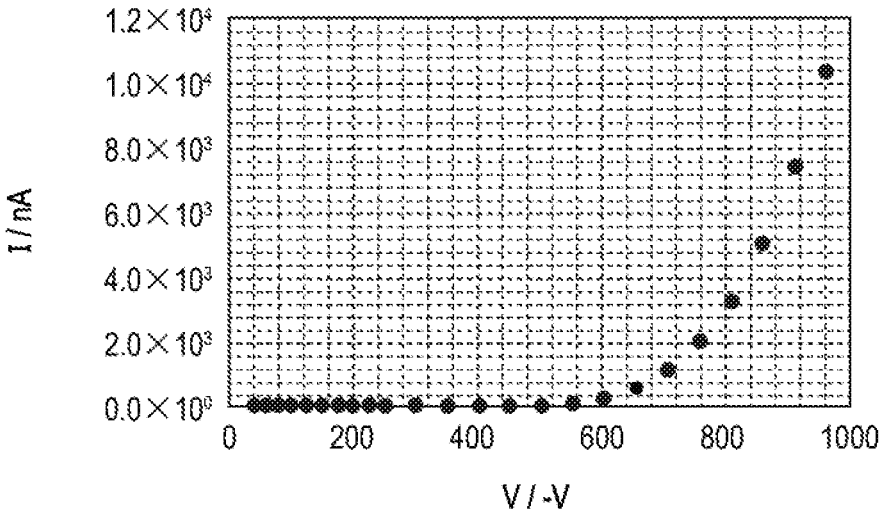
FIG. 2 illustrates a graph of a measurement result of voltage-current characteristics (V-I curve) of an electrophotographic photosensitive member described in Example 24.

An example of the V-I curve obtained by the above method is shown in FIG. 2. This measured V-I curve is re-illustrated by the √E-log (I) curve in FIG. 7 in which the data points are illustrated with the use of a square root $E^{0.5}$ $[(V/m)^{0.5}]$ of the electric field strength [V/m], which has been obtained by dividing an absolute value of the applied voltage V by the film thickness [m] of the photosensitive layer, and the log(I) which has been obtained by taking the common logarithm of the absolute value [nA] of the electric current I.

Figure 7:
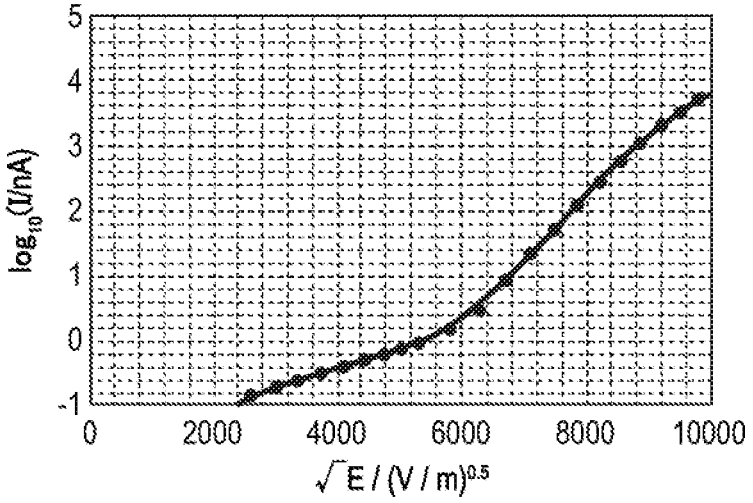
FIG. 7 illustrates a graph in which the measurement result of the voltage-current characteristics (V-I curve) of the electrophotographic photosensitive member described in Example 24 is re-illustrated in the form of the √E-log(I) curve, and the curve is fitted by a sixth order function. The solid line illustrates the fitting result.

Next, this √E-log (I) curve is subjected to least square fitting with the use of a sixth order function (see a solid line in FIG. 7). The sixth order function obtained in this way was further second-order differentiated by $E^{0.5}$, and $E^{0.5}=E^{*0.5}$ was calculated which gives the local maximum value of the graph obtained in the above; and the "point at which gradient changes" in the present disclosure was obtained (see FIG. 9). In the example of FIG. 9, the point at which the gradient changes is $E^{*0.5}=5794$ $[(V/m)^{0.5}]$.

Note that by using the sixth order function as the fitting function, the second order differentiation of the fitted sixth order function becomes the fourth order function, and the local maximum value becomes only one, in the case of the photosensitive member of the present disclosure, which exhibits a strong varistor property in which the √E-log (I) curve is downwardly convexed. Because of this, the point at which the gradient of the photosensitive member of the present disclosure changes results in being determined to be only one point, and accordingly the above method is effective.

(Calculation of Gradient $a_1$ and Gradient $a_2$)

Figure 8:
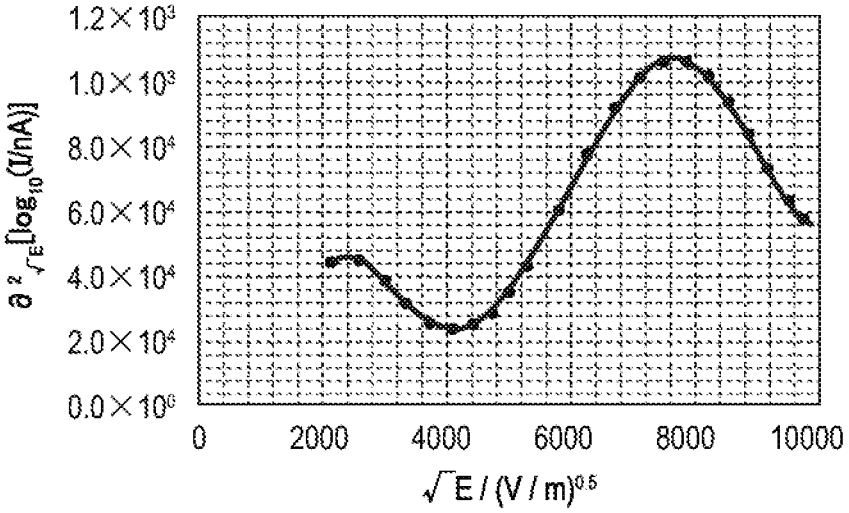
FIG. 8 illustrates a graph in which the measurement result of the voltage-current characteristics (V-I curve) of the electrophotographic photosensitive member described in Example 24 is re-illustrated in the form of the √E-log(I)

In FIG. 8, a graph of a fifth order function is illustrated, which has been obtained by first-order differentiating the sixth order function obtained by the above method. In the obtained fifth order function, $E^{0.5}$ shall be represented by $E_1^{0.5}$, which gives the local minimum value existing on the side in which $E^{0.5}$ is small (low electric field region) when viewed from the above point at which the gradient changes, and $E^{0.5}$ shall be represented by $E_2^{0.5}$, which gives the local maximum value existing on the side in which the $E^{0.5}$ is large (high electric field region) when viewed from the above point at which the gradient changes. In the present Example, a gradient was determined to be $a_1$, which was obtained by straight-line fitting with the use of only the measurement data points in a range of $(0.9E_1^{0.5}+0.1E^{*0.5})$ or larger and $(0.1E_1^{0.5}+0.9E^{*0.5})$ or smaller, in the √E-log(I) curve, and a gradient was determined to be $a_2$, which was obtained by straight-line fitting with the use of only the measurement data points in a range of $(0.9E^{*0.5}+0.1E_2^{0.5})$ or larger and $(0.1E^{*0.5}+0.9E_2^{0.5})$ or smaller.

Note that by using the sixth order function as the fitting function, the first order differentiation of the fitted sixth order function becomes the fifth order function, in the case of the photosensitive member of the present disclosure, which exhibits a strong varistor property in which the √E-log (I) curve is downwardly convexed, and the local minimum and local maximum values become only one, respectively on a side (low electric field region) in which the $E^{0.5}$ is smaller than $E^{*0.5}$ and on a side (high electric field region) in which the $E^{0.5}$ is larger than $E^{*0.5}$. Because of this, the ranges of straight-line fitting for obtaining the gradient $a_1$ of the low electric field region and the gradient $a_2$ of the high electric field region of the photosensitive member of the present disclosure are each determined to be only one, and accordingly, the above method is effective.

[Charging Member]

The charging member of the present disclosure is a charging roller having a second electroconductive layer.

The charging roller of the present disclosure can be formed by a method including the following steps (1) to (4), for example.

Step (1): a step of preparing a rubber mixture for forming a domain (hereinafter, also referred to as "CMB") which contains carbon black and a second rubber.

Step (2): a step of preparing a rubber mixture for forming a matrix (hereinafter, also referred to as "MRC") which contains the first rubber.

Step (3): a step of kneading CMB and MRC to prepare a rubber mixture having the matrix-domain structure.

Step (4): a step of forming a layer of the rubber mixture prepared in step (3) on an electroconductive support directly or via another layer, and curing the layer of the rubber composition to form an electroconductive layer of the present disclosure.

<Second Support>

The charging member has a second support. In the present disclosure, it is preferable that the second support is a second support having electroconductivity. In addition, examples of the shapes of the second support include a columnar shape, a belt shape and a sheet shape; and among the shapes, it is preferable that the shape is the columnar shape.

As a material of the second support, a metal, a resin, glass and the like are preferable.

Examples of the metals include aluminum, iron, nickel, copper, gold, stainless steel, and alloys thereof. In addition, these materials may be subjected to oxidation treatment, or plating treatment with chromium, nickel or the like. As for the types of the plating, any type of electroplating or electroless plating can be used, but the electroless plating is preferable from the viewpoint of dimensional stability. Examples of the types of electroless plating to be used here include nickel plating, copper plating, gold plating, and various other alloy platings. The plating thickness is preferably 0.05 μm or larger, and in consideration of a balance between work efficiency and rust prevention capability, the plating thickness is preferably 0.1 to 30 μm. The columnar shape of the second support may be a solid columnar shape, or also a hollow columnar shape (cylindrical shape). The outer diameter of the second support is preferably in a range of ϕ3 mm to ϕ10 mm.

<Intermediate Layer>

In the present disclosure, an intermediate layer may be provided between the second support and the second electroconductive layer. The intermediate layer being provided can thereby enhance an adhesion function between layers and control a charge supply capability.

It is preferable that the intermediate layer is a thin film and an electroconductive resin layer such as a primer, from the viewpoint of quickly supplying electric charges after electric charges have been consumed by discharging during the charging process, and stabilizing the charging.

As the primer, a known material can be selected and used, according to a rubber material for forming the second electroconductive layer, the material of the second support, and the like. Examples of the materials of the primer include thermosetting resins and thermoplastic resins, such as a phenolic resin, a urethane resin, an acrylic resin, a polyester resin, a polyether resin and an epoxy resin.

<Second Electroconductive Layer>

The second electroconductive layer includes a matrix containing the first rubber, and a plurality of domains that are dispersed in the matrix, the domain includes the second rubber and an electron conducting agent, and the volume resistivity of the matrix is larger than the volume resistivity of the domain by five digits or more, specifically, when the volume resistivity of the matrix is represented by $\rho_M$ [Ω·cm] and the volume resistivity of the domain is represented by $\rho_D$ [Ω·cm], $\rho_M$ is $1.0\times10^5$ times or higher of $\rho_D$.

In addition, from the viewpoint of more clarifying the charge contrast on the photosensitive member corresponding to the matrix-domain structure, it is preferable that the volume resistivity of the above matrix is $1.0\times10^{12}$ [Ω·cm] or higher.

Due to the volume resistivity of the above matrix being set at $1.0\times10^{12}$ [Ω·cm] or higher, electric discharge and inflow of electric charges from the matrix portion can be greatly suppressed, and the discharge contrast in the discharge region during the charging process and the current contrast in the nip region increase. As a result, the charge contrast on the photosensitive member after the charging process can be more clarified, which corresponds to the matrix-domain structure of the charging roller.

It is more preferable that an arithmetic mean value $D_m$ [μm] of a distance between adjacent wall surfaces of domains (hereinafter referred to as inter-domain distance) according to the present disclosure satisfies $D_m \leq 40$, from the viewpoint of preventing the collapse of the charge distribution which is caused by the charge transfer on the surface of the photosensitive member, from being visually recognized.

When $D_m \leq 40$ holds, the $D_m$ becomes sufficiently small compared to a scale L=L*=183 μm, which gives the maximum value of the VTF curve of the following Expression (E6):

$$VTF(L)=5.05e^{-138/L}(1-e^{-100/L}) \quad \text{(E6).}$$

(Reference: P. G. Roetling: Visual Performance and Image Coding, SPIE/OSA, 74, Image Processing, 1976, PP. 195 to 199), which indicates human visibility; and accordingly, a pitch of the charge contrast on the photosensitive member after the charging process also becomes smaller than L*, which corresponds to the matrix-domain structure of the above charging roller. As a result, a pitch of the discretization of the latent image distribution on the surface of the photosensitive member also becomes smaller than L*; the collapse of the charge distribution due to the charge transfer on the surface of the photosensitive member, which causes image deletion, is constrained within a discretized region smaller than L*; and the probability increases that the blur of the latent image distribution cannot be visually identified.

In addition, when $D_m 40$ holds, $D_m$ becomes small compared to the scale 42 μm of 1 dot in 600 dpi, which is typically used as a resolution of electrophotograph. As a result, the collapse of the charge distribution due to the charge transfer on the surface of the photosensitive member is constrained within the minimum unit of image formation of 600 dpi, and it can be prevented that the formed image is disordered by the blur of the latent image distribution and the image deletion occurs.

The thickness of the second electroconductive layer is not particularly limited as long as the aimed function and effect of the charging member can be obtained, but is preferably 1.0 mm or larger and 4.5 mm or smaller.

<Method for Controlling $\rho_D$, $\rho_M$, and $D_m$>

In order to control the volume resistivity $\rho_D$ [Ω·cm] of the domain, the volume resistivity $\rho_M$ [Ω·cm] of the matrix, and the arithmetic mean value $D_m$ [μm] of the inter-domain distances of the second electroconductive layer, it is acceptable to select the type and amount of the materials to be used in each of the steps (1) to (4) for manufacturing the charging roller described above, and adjust the manufacturing conditions.

Firstly, the volume resistivity $\rho_D$ of the domain can be controlled by the amount of electron conducting agent in the CMB.

For example, suppose that electroconductive carbon black is used of which the DBP oil absorption is 40 $cm^3$/100 g or more and 170 $cm^3$/100 g or less, as the electron conducting agent. In this case, the CMB is prepared so as to contain 40% by mass or more and 200% by mass or less of electroconductive carbon black based on the total mass of CMB, and thereby $\rho_D$ can be controlled to $1.0\times10^1$ [Ω·cm] or higher and $1.0\times10^4$ [Ω·cm] or lower.

As the rubber material for the domain, a rubber composition containing a rubber component for the matrix can be used; but from the viewpoint of easily forming a matrix-domain structure, the difference in a SP value from the rubber material which forms the matrix is preferably 0.4 $[(J/cm^3)^{0.5}]$ or larger and 5.0 $[(J/cm^3)^{0.5}]$ or smaller, and is more preferably 0.4 $[(J/cm^3)^{0.5}]$ or larger and 2.2 $[(J/cm^3)^{0.5}]$ or smaller.

The volume resistivity of the domain can be adjusted by appropriately selecting the type of electron conducting agent and the amount thereof to be added. Examples of the electron conducting agents to be blended in the domain include carbon black and graphite; oxides such as titanium oxide and tin oxide; oxides of metals such as Cu and Ag; and a particle of which the surface is coated with a metal and is made electroconductive. In addition, appropriate amounts of two or more of these electroconducting agents may be blended and used, as needed.

Among the above electron conducting agents, it is preferable to use electroconductive carbon black which has a high affinity with rubber, and can easily control the distance between the electron conducting agents. Examples of carbon black blended in the domains include gas furnace black, oil furnace black, thermal black, lamp black, acetylene black and Ketjen Black, but are not limited to these carbon blacks.

Among these carbon blacks, electroconductive carbon black of which the DBP oil absorption is 40 $cm^3$/100 g or more and 170 $cm^3$/100 g or less can be preferably used, from the viewpoint of being capable of imparting high electroconductivity to the domain.

It is preferable that the electron conducting agent such as electroconductive carbon black is blended in the domains in an amount of 20 parts by mass or more and 150 parts by mass or less with respect to 100 parts by mass of the rubber component contained in the domains. A particularly preferable blending ratio is 50 parts by mass or more and 100 parts by mass or less. As for the electroconducting agent to be blended in the above ratio, it is preferable that the electroconducting agent is blended in a large amount, compared to a general charging member for electrophotography.

In addition, as necessary, generally used compounding ingredients for rubber may be added to the rubber composition for the domains within a range that does not inhibit the effects according to the present disclosure, which include a filler, a processing aid, a cross-linking aid, a cross-linking accelerator, an anti-aging agent, a cross-linking acceleration aid, a cross-linking retarder, a softener, a dispersing agent and a coloring agent.

Next, the volume resistivity $\rho_M$ of the matrix can be controlled by the composition of the MRC.

For example, the first rubber used for the MRC includes natural rubber, butadiene rubber, butyl rubber, acrylonitrile butadiene rubber, urethane rubber, silicone rubber, fluorine rubber, isoprene rubber, chloroprene rubber, styrene-butadiene rubber, ethylene-propylene rubber and polynorbornene rubber, which have low electroconductivity.

In addition, into the MRC, as necessary, a filler, a processing aid, a cross-linking agent, a cross-linking aid, a cross-linking accelerator, a cross-linking accelerating aid, a cross-linking retarder, an anti-aging agent, a softener, a dispersing agent and a coloring agent may be added.

On the other hand, it is preferable that the MRC does not contain an electron conducting agent such as carbon black, because the present disclosure needs to satisfy $\rho_M/\rho_D \geq 1.0\times 10^5$ and $\rho_M \geq 1.0\times 10^{12}$ Ω·cm.

In the end, the arithmetic mean value $D_m$ of the inter-domain distances can be effectively controlled by adjusting the following four items (a) to (d).

(a) Difference between interfacial tensions σ of each of CMB and MRC.

(b) Ratio $\eta_D/\eta_M$ between viscosity $\eta_D$ of CMB and viscosity $\eta_M$ of MRC.

(c) Shear rate γ at the time when CMB and MRC are kneaded and amount of energy $E_{DK}$ at the time of shearing, in the above step (3) for forming the charging roller.

(d) Volume fraction of CMB with respect to MRC, in the above step (3) for forming the charging roller.

The four adjustments of the above (a) to (d) will be described below.

((a) Difference in Interfacial Tension Between CMB and MRC)

In general, when two types of incompatible rubber are mixed, phase separation occurs. This occurs because the interaction between the same polymers is stronger than the interaction between the dissimilar polymers, and accordingly the same polymers tend to cohere, reduce the free energy and are stabilized. On the interface of the phase-separated structure, dissimilar polymers come into contact with each other; and the free energy becomes higher than that of the inside which is stabilized by the interaction among the same molecules. As a result, in order to reduce the free energy of the interface, an interfacial tension is generated which tends to reduce the area in which the dissimilar polymers come in contact with each other. When the interfacial tension is small, in order to increase the entropy, even the dissimilar polymers tend to be mixed more uniformly. The uniformly mixed state means a dissolved state, and the solubility parameter (hereinafter referred to as "SP value"), which is a measure of the solubility, tends to correlate with the interfacial tension.

In other words, it is considered that the difference in the interfacial tension a between each of the CMB and the MRC correlates with the difference in the SP value between the rubbers contained in each. It is preferable for the first rubber in the MRC and the second rubber in the CMB that such rubbers are selected as the difference between absolute values of the SP values is 0.4 $[(J/cm^3)^{0.5}]$ or larger and 5.0 $[(J/cm^3)^{0.5}]$ or smaller, in particular, 0.4 $[(J/cm^3)^{0.5}]$ or larger and 2.2 $[(J/cm^3)^{0.5}]$ or smaller. When the difference is within this range, a stable phase-separated structure can be formed, and the domain diameter of CMB can be reduced.

Here, specific examples of the second rubber usable in the CMB include natural rubber (NR), isoprene rubber (IR), butadiene rubber (BR), styrene-butadiene rubber (SBR), butyl rubber (IIR), ethylene-propylene rubber (EPM, EPDM), chloroprene rubber (CR), nitrile rubber (NBR), hydrogenated nitrile rubber (H-NBR), silicone rubber and urethane rubber (U).

((b) Viscosity Ratio Between CMB and MRC)

As the viscosity ratio $\eta_D/\eta_M$ between CMB and MRC is closer to 1, the maximum Feret diameter of the domain can be made smaller. Specifically, it is preferable that $\eta_D/\eta_M$ is $1.0\eta_D/\eta_M \leq 2.0$. The $\eta_D/\eta_M$ can be adjusted by the selection of the Mooney viscosity of the raw rubber material which is used CMB and MRC, and/or by the blend of the type and amount of the filler. In addition, the ratio of the viscosities can be also adjusted by adding a plasticizing agent such as paraffin oil, in such an extent that the plasticizing agent does not hinder the formation of the phase-separated structure. In addition, the viscosity ratio can be adjusted by adjusting a temperature at the time of kneading. For information, the viscosities of the rubber mixture for forming the domain and the rubber mixture for forming the matrix can be obtained by measuring the Mooney viscosity ML(1+4) at a rubber temperature at the time of kneading, based on JIS K6300-1: 2013.

((c) Shear Rate at the Time when CMB and MRC are Kneaded and Amount of Energy at the Time of Shearing)

The higher the shear rate γ at the time when the CMB and the MRC are kneaded, and the larger the energy amount $E_{DK}$ at the time of shearing, the smaller the arithmetic mean value $D_m$ of the inter-domain distance can be made.

The rate γ can be increased by increasing an inner diameter of a stirring member such as a blade or a screw of the kneading machine, reducing the gap from the end surface of the stirring member to the inner wall of the kneading machine, or increasing the number of rotations. In addition, the $E_{DK}$ can be increased by increasing the number of rotations of the stirring member, or by increasing the viscosity of the second rubber in the CMB and the first rubber in the MRC.

((d) Volume Fraction of CMB with Respect to MRC)

The volume fraction of the CMB with respect to the MRC correlates with the probability of collision coalescence between CMBs. Specifically, when the volume fraction of the CMB with respect to the MRC is reduced, the probability of the collision coalescence to each other of the CMBs decreases. In other words, the arithmetic mean value $D_m$ of the inter-domain distances can be reduced by reducing the volume fraction of the CMB with respect to the MRC within a range in which the necessary electroconductivity can be obtained. From this viewpoint, it is preferable that the volume fraction of the CMB with respect to the MRC is 15% or larger and 40% or smaller.

By $\rho_D$, $\rho_M$, and $D_m$ being controlled with the use of the above adjustment methods (a) to (d), the second electroconductive layer can be obtained that satisfies $\rho_M/\rho_D \geq 1.0\times10^5$, $\rho_M > 1.0\times10^{12}$ Ω·cm, and $D_m \leq 40$ μm.

<Method for Checking Matrix-Domain Structure>

The presence of the matrix-domain structure in the second electroconductive layer can be checked by operations of preparing a thin slice from the second electroconductive layer, and observing the detail of the fracture cross section which has been formed on the thin slice.

Examples of a unit for preparing the thin slice include a sharp razor, a microtome and a focused ion beam (FIB) method. In addition, in order to more precisely observe the matrix-domain structure, it is acceptable to subject the thin slice for observation to the pretreatment such as dyeing treatment or vapor deposition treatment, by which a contrast between the domain and the matrix can be suitably obtained.

The fracture cross section of the thin slice on which the fracture cross section has been formed and the pretreatment has been performed as needed can be observed with a laser microscope, a scanning electron microscope (SEM), or a transmission electron microscope (TEM); and the presence of the matrix-domain structure can be checked. From the viewpoint of being capable of easily and precisely checking the matrix-domain structure, it is preferable to observe the matrix-domain structure with the scanning electron microscope (SEM).

After the thin slice of the second electroconductive layer has been obtained by the above technique and an image has been obtained by observing the surface of the thin slice at a magnification of 1000 to 10000 times, the image is converted into an 8-bit gray scale with the use of image processing software (trade name: Image Pro Plus produced by Media Cybernetics), and a 256-gradation monochrome image is obtained. Next, the white and black of the image are inverted so that the domain in the fracture cross section becomes white, then a threshold value for binarization is set for the luminance distribution of the image, based on the algorithm of the discriminant analysis method of Otsu, and a binarized image is obtained. In the end, the presence or absence of the matrix-domain structure may be determined by the analysis image which has been subjected to image processing into a state in which the domain and the matrix are distinguished by binarization.

In the case where the structure is included in the analysis image in which a plurality of domains 2*b* exist in the matrix 2*a* in an isolated state as is shown in FIG. 4, the presence of the matrix-domain structure in the second electroconductive layer can be checked. The isolated state of the domain 2*b* is acceptable, as long as each domain is arranged in a state of not being connected with another domain, the matrix 2*a* communicates with each other in the image, and the domain 2*b* is divided by the matrix 2*a*. Specifically, when the analysis region is determined to be within a 50 μm square in the analysis image, such a state is determined to be a state having the matrix-domain structure that the number of domains existing in the isolated state as described above is 80 number percent or more with respect to the total number of domain groups that do not have a contact point with a frame line of the analysis region.

The above state may be checked by operations of equally dividing the second electroconductive layer of the electroconductive member equally into 5 equal parts in the longitudinal direction, and equally dividing the layer into four equal parts in the circumferential direction; taking the slices from arbitrary one point in each of the regions and from 20 points in total; and subjecting the slices to the above measurement.

In Example of the present disclosure, a slice was cut out with the use of a razor so that a cross section perpendicular to the longitudinal direction of the second electroconductive layer could be observed, was subjected to platinum vapor deposition, and then was photographed at a magnification of 1000 times with the use of a scanning electron microscope (SEM) (trade name: S-4800, manufactured by Hitachi High-Technologies Corporation); and a cross-sectional image was obtained.

Subsequently, in Example of the present disclosure, the binarized image obtained by use of the above image processing software and method was subjected to the calculation of a number percentage K of domains which are isolated without being connected to each other, with respect to the total number of domains which exist in a region of 50 μm square and do not have a contact point with the frame line of the binarized image, due to a counting function. At this time, as shown in FIG. 4, a domain group was confirmed in which a plurality of domains 2*b* showed a form of being dispersed in a matrix 2*a* and existing in an independent state without being connected to each other; and on the other hand, the matrix 2*a* was in a state of communicating in the image.

In the end, in Example of the present disclosure, the presence or absence of the matrix-domain structure was determined in the following way. The slices were prepared by operations of equally dividing the second electroconductive layer into 5 equal parts in the longitudinal direction, and equally dividing the layer into four equal parts in the circumferential direction, and taking the slices from arbitrary one point in each of the obtained regions and from 20 points in total; and were subjected to the above measurement. In the case where the arithmetic mean value K (number %) thus obtained was 80 or larger, the matrix-domain structure was evaluated to be "present", and in the case where the arithmetic mean value K (number %) was less than 80, the matrix-domain structure was evaluated to be "absent".

<Method for Measuring Volume Resistivity $\rho_D$ of Domain>

The volume resistivity $\rho_D$ of the domain can be measured by preparing a thin slice of the second electroconductive layer, and then using a microprobe. Examples of a unit for preparing the thin slice include a sharp razor, a microtome and a focused ion beam method.

Regarding the preparation of thin slices, it is necessary to eliminate the influence of the matrix and measure the volume resistivity of only the domain, and accordingly it is necessary to prepare a thin slice having a film thickness smaller than the inter-domain distance measured in advance with a scanning electron microscope (SEM), a transmission electron microscope (TEM) or the like. Accordingly, as a unit for preparing the thin slice, a unit such as a microtome is preferable, which can prepare a very thin sample.

As for the measurement of the volume resistivity, firstly, one surface of the thin slice is grounded, and then the locations of the matrix and the domain in the thin slice are pinpointed. These locations can be pinpointed by a unit such as a scanning probe microscope (SPM) or atomic force microscope (AFM) which can measure the volume resistivities or hardness distributions of the matrix and domain. Next, the probe is brought into contact with the matrix, a DC voltage of 1 [V] is applied for 5 seconds, an arithmetic mean value of the ground current values in 5 seconds is measured, the applied voltage is divided by the measured value, and the electric resistance value is calculated. In the end, the resistance value may be converted into the volume resistivity with the use of the film thickness of the thin slice. At this time, a unit such as SPM or AFM which can measure also the shape of the slice can measure the volume resistivity and also the film thickness of the thin slice, at the same time, which is accordingly suitable.

In Example of the present disclosure, an ultra-thin slice having a thickness of 1 μm was cut out from the second electroconductive layer, at a cutting temperature of −100° C., with the use of a microtome (trade name: Leica EMFCS, manufactured by Leica Microsystems). When the ultra-thin slices were cut out, the direction of the cross section perpendicular to the longitudinal direction of the charging member was adopted, in consideration of the direction in which electric charges are transported for electric discharge.

Next, in Example of the present disclosure, the ultra-thin slice was placed on a metal plate in an environment of a temperature of 23° C. and a humidity of 50% RH; a portion corresponding to a domain was selected from among portions which came in direct contact with the metal plate, and was brought into contact with a cantilever of a scanning probe microscope (SPM) (trade name: Q-Scope250, manufactured by Quesant Instrument Corporation); a voltage of 1 V was applied to the cantilever for 5 seconds; electric current values were measured; and an arithmetic mean value in 5 seconds was calculated.

Subsequently, in Example of the present disclosure, the surface shape of the measurement slice was observed with the SPM, and a thickness of the measurement portion was calculated from the obtained height profile. Furthermore, an area of a concave portion of a contact portion of the cantilever was calculated from the observation result of the surface shape. The volume resistivity was calculated from the thickness and the area of the concave portion.

In the end, in Example of the present disclosure, the slices were prepared by operations of dividing the second electroconductive layer into 5 equal parts in the longitudinal direction, and dividing the layer into four equal parts in the circumferential direction, and taking the slices from arbitrary one point in each of the obtained regions and of 20 points in total; and were subjected to the above measurement. The average value was determined to be the volume resistivity $\rho_D$ of the domain.

In Example of the present disclosure, the above SPM was scanned in a contact mode.

<Method for Measuring Volume Resistivity $\rho_M$ of Matrix>

The volume resistivity $\rho_M$ of the matrix may be measured in the same manner as in the <method for measuring volume resistivity $\rho_D$ of domain>, except that the measurement portion is changed to a portion corresponding to the matrix, and a voltage to be applied when the electric current value is measured is changed to 50 V.

In Example of the present disclosure, the volume resistivity $\rho_M$ of the matrix was measured in the same manner as in the method in Example of the present disclosure in the <method for measuring volume resistivity $\rho_D$ of domain>, except that the measurement portion was changed to a portion corresponding to the matrix, and a voltage to be applied when the electric current value was measured was changed to 50 V.

<Method for Measuring Arithmetic Mean Value $D_m$ of Inter-Domain Distances>

An arithmetic mean value $D_m$ of inter-domain distances may be measured in the following way.

Firstly, a slice is prepared in the same manner as in the <method for measuring volume resistivity $\rho_D$ of domain>. Next, a fracture cross section is formed by a unit such as a freeze-fracture method, a cross polisher method or a focused ion beam method. Considering the smoothness of the fracture cross section and pretreatment for observation, the FIB method is preferable. In addition, in order to suitably observe the matrix-domain structure, it is acceptable to subject the slice to the pretreatment such as dyeing treatment or vapor deposition treatment, by which a contrast between an electroconductive phase and an insulative phase can be suitably obtained.

The presence of the matrix-domain structure is confirmed by observing the slice on which the fracture cross section has been formed and the pretreatment has been performed, with a scanning electron microscope (SEM) or a transmission electron microscope (TEM). Among the microscopes, it is preferable to observe the slice with the SEM at a magnification of 1000 to 100000 times in view of the correctness at the time when the area of the domain is quantified.

It is preferable to measure $D_m$ by quantifying a photograph image of a fracture cross section on which the matrix-domain structure appears. Image processing software (tradename: Luzex, manufactured by Nireco Corporation) is used to convert the image of the fracture cross section, which has been obtained by observation with the SEM, into an 8-bit gray scale, and a monochrome image having 256 gradations is obtained. Next, black and white portions of the image are reversed so that the domain in the fracture cross section becomes white, and the binarization is performed. Next, the distance between the wall surfaces of the domain size group in the image is calculated. The distance between the wall surfaces at this time is the shortest distance between the adjacent domains.

In the case of a charging member having a columnar shape, when the length in the longitudinal direction of the second electroconductive layer is represented by L, and the thickness of the second electroconductive layer is represented by T, cross sections in the thickness direction of the second electroconductive layer are acquired at three portions of the center in the longitudinal direction of the second electroconductive layer, and of L/4 from both ends of the second electroconductive layer toward the center (see FIG. 10). It is acceptable to acquire, for each of the acquired cross sections, observation regions of 50 μm square at arbitrary three portions in the thickness region from the outer surface of the second electroconductive layer to the depth of 0.1 T to 0.9 T toward the second support direction, and calculate $D_m$ as the arithmetic mean value of the inter-domain distances which are observed in each of all 9 observation regions. It is necessary to observe a face that includes the outer surface of the second electroconductive layer from the second support, which is a charge transfer direction, and accordingly the slice is cut out in a direction in which the cross section can be observed which contains a normal line starting from the central axis of the second support.

For information, in FIG. 10, reference numeral 81 denotes an electroconductive member, reference numeral 83 denotes a YZ plane perpendicular to the axial direction of the electroconductive member, reference numeral 83*a* denotes a cross section at a portion of L/4 from one end of the second electroconductive layer toward the center, reference numeral 83*b* denotes a cross section at the center in a longitudinal direction of the second electroconductive layer, and reference numeral 83*c* denotes a cross section at a portion of L/4 from one end of the second electroconductive layer toward the center.

In Example of the present disclosure, the thin slice for observation was cut out in the same manner as in the <method for measuring volume resistivity $\rho_D$ of domain>, and the fracture cross section was photographed at a magnification of 5000 times with a scanning electron microscope (SEM) (trade name: S-4800, Hitachi High Technologies Co., Ltd.), and an observation image was obtained. A binarized image was obtained from this image with the use of the image processing software (trade name: LUZEX, manufactured by Nireco Corporation). Next, on the binarized image, the distributions of the distances between the wall surfaces of the domain were calculated, and an arithmetic mean value of the distributions was calculated. In addition, the inter-domain distance $D_m$ was quantified by the above method, as an arithmetic mean of the measured values obtained from observation regions at nine points in total.

<Method for Measuring SP Value>

The SP values can be calculated accurately by an operation of creating a calibration curve using a material of which the SP value is known. As the known SP value, a value in a catalog of a material maker can be used. For example, the SP values of NBR and SBR do not depend on the molecular weight, and are almost determined by content ratios of acrylonitrile and styrene, respectively. Accordingly, the SP values can be calculated from analyses of content ratios between acrylonitrile and styrene in the rubbers constituting the matrix and the domain, with the use of an analytical method such as pyrolysis gas chromatography (Py-GC) and solid-state NMR, in combination with calibration curves of which the SP values are obtained from the known materials. In addition, the SP value of the isoprene rubber is determined according to isomeric structures of 1,2-polyisoprene, 1,3-polyisoprene, 3,4-polyisoprene, cis-1,4-polyisoprene, trans-1,4-polyisoprene, and the like. Accordingly, the SP value can be calculated based on the analyses of the content ratios of the isomers by Py-GC, solid-state NMR or the like, in combination with calibration curves of which the SP values are obtained from the known materials, in a similar way to those in SBR and NBR. The SP value of a material of which the SP value is known is obtained by the Hansen Solubility Sphere method.

[Process Cartridge and Electrophotographic Apparatus]

The process cartridge of the present disclosure includes: integrally supporting the electrophotographic photosensitive member described above and a charging member, and being detachably attachable to a main body of an electrophotographic apparatus. For information, the process cartridge of the present disclosure may integrally support at least one unit selected from the group consisting of a developing unit, a transfer unit and a cleaning unit.

In addition, the electrophotographic apparatus of the present disclosure includes: the electrophotographic photosensitive member and the charging member described above; and besides an exposure unit, a developing unit and a transfer unit.

The electrophotographic photosensitive member and the charging member of the process cartridge and the electrophotographic apparatus of the present disclosure preferably have the following features. Specifically, it is preferable that the gradients $a_2$ and $a_1$ in the $\sqrt{E}$-log(I) curve of the above photosensitive member and the arithmetic mean value $D_m$ [μm] of the inter-domain distances in the second electroconductive layer of the above charging member satisfy $D_m \times a_1/a_2 \leq 10$.

In the present disclosure, in order to suppress the image deletion, it is necessary that $a_2$ of the photosensitive member is large by a predetermined amount or more, compared to $a_1$. In addition, when the $D_m$ of the charging member is smaller than a predetermined value, the disorder of the formed image due to the blur of the latent image distribution is confined in a small region, and accordingly the image deletion can be suppressed more effectively. When these both effects are combined, and when $D_m \times a_1/a_2 \leq 10$ is satisfied, an effect of suppressing the image deletion is synergistically obtained.

Specifically, an effect of the $D_m$ side and an effect of the $a_1/a_2$ side synergistically act in such ways that the disorder of the formed image due to the blur of the latent image distribution is confined in a small region, due to a function that the pitch of the charge contrast between a domain corresponding portion and a matrix corresponding portion becomes small, when each of $D_m$ and $a_1/a_2$ take a small value so as to satisfy $D_m \times a_1/a_2 \leq 10$; and that the image deletion is largely suppressed, due to a function that the charge contrast between the domain corresponding portion and the matrix corresponding portion further increases, because the current contrast between the high electric field region and the low electric field region is very large, respectively.

Figure 1:
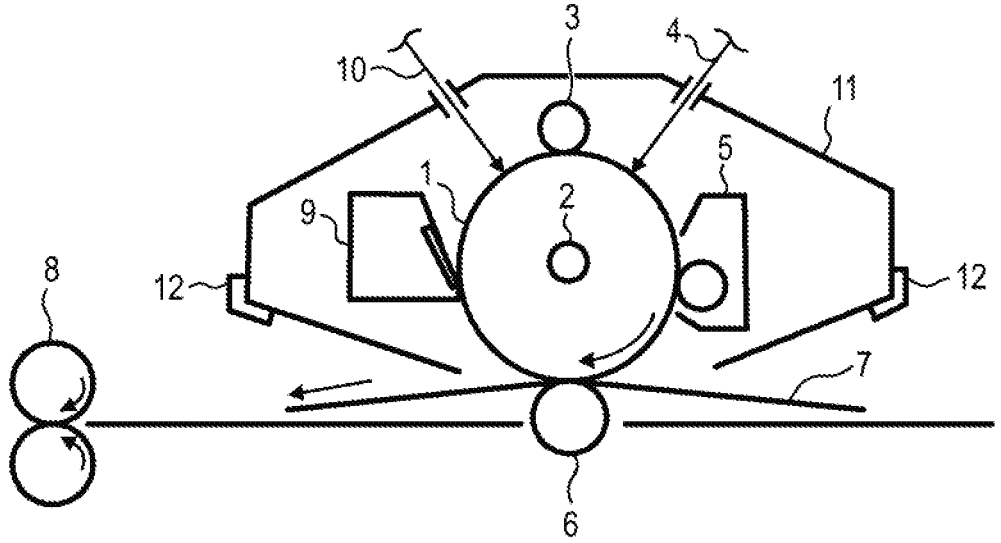
FIG. 1 illustrates one example of a schematic configuration of an electrophotographic apparatus including a process cartridge which includes an electrophotographic photosensitive member and a charging unit.

FIG. 1 illustrates an example of a schematic configuration of an electrophotographic apparatus having a process cartridge including an electrophotographic photosensitive member and a charging member.

Reference numeral 1 denotes a cylindrical electrophotographic photosensitive member which is rotationally driven around a shaft 2 in a direction of an arrow at a predetermined circumferential velocity. The surface of the electrophotographic photosensitive member 1 is charged to a predetermined positive or negative potential by a charging member 3. Note that, as shown in FIG. 1, the charging member of the present disclosure is a roller charging system using a roller-type charging member. The surface of the charged electrophotographic photosensitive member 1 is irradiated with exposure light 4 emitted from an exposure unit (not illustrated), and an electrostatic latent image corresponding to objective image information is formed on the surface. The electrostatic latent image formed on the surface of the electrophotographic photosensitive member 1 is developed by a toner accommodated in a developing unit 5, and a toner image is formed on the surface of the electrophotographic photosensitive member 1. The toner image formed on the surface of the electrophotographic photosensitive member 1 is transferred onto a transfer material 7 by a transfer unit 6. The transfer material 7 to which the toner image has been transferred is conveyed to a fixing unit 8, is subjected to fixing treatment of the toner image, and is printed out to the outside of the electrophotographic apparatus. The electrophotographic apparatus may have a cleaning unit 9 for removing an adherent such as a toner remaining on the surface of the electrophotographic photosensitive member 1 after transferring. Alternatively, a cleaning unit may not be separately provided, but a so-called cleanerless system may be used that removes the above adherent by a developing unit or the like. The electrophotographic apparatus may have a diselectrifying mechanism that subjects the surface of the electrophotographic photosensitive member 1 to a diselectrifying process by pre-exposure light 10 emitted from a pre-exposure unit (not illustrated). In addition, a guide unit 12 such as a rail may also be provided in order to detachably attach the process cartridge 11 of the present disclosure to a main body of the electrophotographic apparatus.

The electrophotographic photosensitive member of the present disclosure can be used in a laser beam printer, an LED printer, a copying machine and the like.

EXAMPLES

The present disclosure will be described below in more detail with reference to Examples and Comparative Examples. The present disclosure is not limited to the following Examples at all, as long as the present disclosure does not exceed the gist thereof. Herein, "part(s)" in the following Examples is on a mass basis unless otherwise particularly noted.

The film thickness of each layer of the electrophotographic photosensitive members of Examples and Comparative Examples was determined by a method using an eddy current film thickness meter (Fischerscope, manufactured by Fischer Instruments K.K.), or a method of converting the mass per unit area into a specific gravity, except for the charge generation layer. The film thickness of the charge generation layer was measured by converting a Macbeth density value of the photosensitive member, with the use of a calibration curve that was obtained in advance from the Macbeth density value which was measured by pressing a spectral densitometer (trade name: X-Rite 504/508, manufactured by X-Rite Inc.) against the surface of the photosensitive member, and from a film thickness measurement value obtained by cross-sectional SEM image observation.

Production Example 1 of Titanium Oxide Particle

As a base substance, anatase-type titanium oxide of which the average size of primary particles was 200 nm was used, and a titanium niobium sulfate solution was prepared which contained 33.7 parts of titanium in terms of $TiO_2$ and 2.9 parts of niobium in terms of $Nb_2O_5$. In pure water, 100 parts of the base substance were dispersed to prepare 1000 parts of a suspension liquid, and the suspension liquid was heated to 60° C. The titanium niobium sulfate solution and a 10 mol/L solution of sodium hydroxide were added dropwise to the suspension liquid over 3 hours so that a pH of the suspension liquid became 2 to 3. After the whole quantity was added dropwise, the pH was adjusted to the vicinity of neutrality, and a polyacrylamide-based flocculant was added to settle a solid content. The supernatant was removed, the rest was filtered, and the residue was cleaned and then dried at 110° C. to obtain an intermediate which contained 0.1 wt % in terms of C of an organic substance which was derived from the flocculant. This intermediate was calcined in nitrogen gas at 750° C. for 1 hour, then was calcined at 450° C. in air, and a titanium oxide particle 1 was produced. An average particle size (average primary particle size) of the obtained particles was 220 nm in the particle size measurement method using the scanning electron microscope described above.

Synthesis Example 1

Under an atmosphere of nitrogen flow, 5.46 parts of orthophthalonitrile and 45 parts of α-chloronaphthalene were charged into a reaction vessel, and then were heated to raise the temperature to 30° C.; and this temperature was maintained. Next, 3.75 parts of gallium trichloride were charged there at this temperature (30° C.). The water concentration of the mixed liquid at the time of the charging was 150 ppm. After that, the temperature was raised to 200° C. Next, the mixed liquid was subjected to a reaction at a temperature of 200° C. for 4.5 hours under an atmosphere of nitrogen flow, and then was cooled, and when the temperature reached 150° C., the product was filtered. The obtained residue was dispersed and cleaned with the use of N,N-dimethylformamide, at a temperature of 140° C. for 2 hours, and then was filtered. The obtained residue was cleaned with methanol, and then was dried; and a chlorogallium phthalocyanine pigment was obtained at a yield of 71%.

Synthesis Example 2

The chlorogallium phthalocyanine pigment in an amount of 4.65 parts, which was obtained in the above Synthesis Example 1, was dissolved in 139.5 parts of concentrated sulfuric acid at a temperature of 10° C.; the mixture was added dropwise to 620 parts of ice water under stirring; the pigment was reprecipitated; and the dispersion was filtered under reduced pressure with the use of a filter press. At this time, No. 5C (produced by Advantech Co., Ltd.) was used as a filter. The obtained wet cake (residue) was dispersed and cleaned with 2% aqueous ammonia for 30 minutes, and then the dispersion was filtered with the use of a filter press. Next, the obtained wet cake (residue) was dispersed and cleaned with ion-exchanged water, and then filtration using a filter press was repeated 3 times. In the end, the residue was subjected to freeze-drying (freeze-drying), and a hydroxygallium phthalocyanine pigment (hydrous hydroxygallium phthalocyanine pigment) having a solid content of 23% was obtained at a yield of 97%.

Synthesis Example 3

The hydroxygallium phthalocyanine pigment in an amount of 6.6 kg, which was obtained in the above Synthesis Example 2, was dried in the following way, with the use of a hyper dry drying machine (trade name: HD-06R, frequency (oscillation frequency): 2455 MHz±15 MHz, manufactured by Biocon (Japan) Ltd.).

The above hydroxygallium phthalocyanine pigment was placed on a dedicated circular plastic tray, in a state of a lump (water-containing cake thickness of 4 cm or less) immediately after having been taken out from the filter press; and far infrared rays were turned off, and the temperature of the inner wall of the drying machine was set so as to become 50° C. Then, at the time of microwave irradiation, the vacuum pump and the leak valve were adjusted so that the vacuum degree became 4.0 to 10.0 kPa.

Firstly, in a first step, the hydroxygallium phthalocyanine pigment was irradiated with a microwaves of 4.8 kW for 50 minutes; subsequently, the microwave was once turned off, and the leak valve was once closed; and a high vacuum of 2 kPa or lower was achieved. The solid content of the hydroxygallium phthalocyanine pigment was 88% at this point in time. In a second step, the leak valve was adjusted, and the degree of vacuum (pressure in the drying machine) was adjusted to within the above set value (4.0 to 10.0 kPa). After that, the hydroxygallium phthalocyanine pigment was irradiated with the microwave of 1.2 kW for 5 minutes; the microwave was once turned off, and the leak valve was once closed; and a high vacuum of 2 kPa or lower was achieved. This second step was further repeated one more time (two times in total). The solid content of the hydroxygallium phthalocyanine pigment was 98% at this point in time. Furthermore, in a third step, irradiation with microwave was conducted in the same manner as in the second step, except that the microwave output in the second step was changed from 1.2 kW to 0.8 kW. This third step was further repeated one more time (two times in total). Furthermore, in a fourth step, the leak valve was adjusted, and the vacuum degree (pressure in the drying machine) was restored to within the above set value (4.0 to 10.0 kPa). After that, the hydroxygallium phthalocyanine pigment was irradiated with the microwave of 0.4 kW for 3 minutes; the microwave was once turned off, and the leak valve was once closed; and a high vacuum of 2 kPa or lower was achieved. This fourth step was further repeated seven times (eight times in total). Thus, in a total of 3 hours, 1.52 kg of a hydroxygallium phthalocyanine pigment (crystal) was obtained of which the water content was 1% or less.

Synthesis Example 4

The hydroxygallium phthalocyanine pigment in an amount of 10 parts, which was obtained in the above Synthesis Example 2, was mixed with 200 parts of hydrochloric acid having a concentration of 35 mass % and a temperature of 23° C., and the mixture was stirred with a magnetic stirrer for 90 minutes. The amount of hydrochloric acid mixed was 118 mol of hydrogen chloride with respect to 1 mol of hydroxygallium phthalocyanine. After having been stirred, the mixture was added dropwise to 1000 parts of ion-exchanged water which was cooled with ice water, and the resultant mixture was stirred with a magnetic stirrer for 30 minutes. The stirred mixture was filtered under reduced pressure. At this time, No. 5C (produced by Advantech Co., Ltd.) was used as a filter. After that, the residue was dispersed and cleaned 4 times with ion-exchanged water at a temperature of 23° C. Thus, 9 parts of chlorogallium phthalocyanine pigment were obtained.

Synthesis Example 5

In 100 g of α-chloronaphthalene, 5.0 g of o-phthalodinitrile and 2.0 g of titanium tetrachloride were stirred and heated at 200° C. for 3 hours, the mixture was cooled to 50° C., the precipitated crystals were separated by filtration, and a paste of dichlorotitanium phthalocyanine was obtained. Next, this paste was stirred and cleaned in 100 ml of N, N-dimethylformamide which was heated to 100° C., and then was cleaned twice repeatedly with 100 ml of methanol at 60° C., and the mixture was filtered. Furthermore, the obtained paste was stirred in 100 ml of deionized water at 80° C. for 1 hour, the mixture was filtered, and 4.3 g of a blue titanyl phthalocyanine pigment was obtained.

Milling Example 1

The hydroxygallium phthalocyanine pigment in an amount of 0.5 parts, which was obtained in Synthesis Example 3, 9.5 parts of N,N-dimethylformamide (product code: D0722, produced by Tokyo Chemical Industry Co., Ltd.), and 15 parts of glass beads having a diameter of 0.9 mm were subjected to milling treatment in a ball mill at room temperature (23° C.) for 100 hours. At this time, a standard bottle (trade name: PS-6, manufactured by Hakuyo Glass Co., Ltd.) was used as the container, and the milling treatment was performed under conditions that the container rotated 60 times per 1 minute. The thus treated liquid was filtered through a filter (product number: N-NO. 125T, pore size: 133 μm, produced by NBC Meshtec Inc.), and glass beads were removed. To this liquid, 30 parts of N, N-dimethylformamide were added, then the mixture was filtered, and the filtration residue on the filter was sufficiently cleaned with tetrahydrofuran. Then, the cleaned filtration residue was vacuum-dried, and 0.48 parts of a hydroxygallium phthalocyanine pigment was obtained. The obtained pigment has peaks at 7.4°±0.3° and 28.2°±0.3° of Bragg angle 2θ in an X-ray diffraction spectrum using CuKα rays.

Milling Example 2

The titanyl phthalocyanine pigment in an amount of 0.5 parts, which was obtained in Synthesis Example 5, 10 parts of tetrahydrofuran, and 15 parts of glass beads having a diameter of 0.9 mm were subjected to milling treatment at a cooling water temperature of 18° C. for 48 hours, with the use of a sand mill (K-800, manufactured by Igarashi Kikai Seizo Co., Ltd. (currently AIMEX Co., Ltd.), disk diameter of 70 mm, and number of discs being 5 disks). At this time, the milling treatment was performed under the condition that the disk rotated 500 times per minute. The thus treated liquid was filtered through a filter (product number: N-NO. 125T, pore size: 133 μm, produced by NBC Meshtec Inc.), and glass beads were removed. To this liquid, 30 parts of tetrahydrofuran were added, then the mixture was filtered, and the filtration residue on the filter was sufficiently cleaned with methanol and water. Then, the cleaned filtration residue was vacuum-dried, and 0.45 parts of a titanyl phthalocyanine pigment was obtained. The obtained pigment has a strong peak at 27.2°±0.3° of the Bragg angle 2θ in the X-ray diffraction spectrum using CuKα rays.

Milling Example 3

The chlorogallium phthalocyanine pigment in an amount 0.5 parts, which was obtained in Synthesis Example 4, 10 parts of N,N-dimethylformamide (product code: D0722, produced by Tokyo Chemical Industry Co., Ltd.), and 15 parts of glass beads having a diameter of 0.9 mm were subjected to milling treatment in a paint shaker (manufactured by Toyo Seiki Seisaku-sho, Ltd.) at room temperature (23° C.) for 48 hours. At this time, a standard bottle (trade name: PS-6, manufactured by Hakuyo Glass Co., Ltd.) was used as the container. The thus treated liquid was filtered through a filter (product number: N-NO. 125T, pore size: 133 μm, produced by NBC Meshtec Inc.), and glass beads were removed. To this liquid, 30 parts of N, N-dimethylformamide were added, then the mixture was filtered, and the filtration residue on the filter was sufficiently cleaned with tetrahydrofuran. Then, the cleaned filtration residue was vacuum-dried, and 0.47 parts of the chlorogallium phthalocyanine pigment were obtained. In a spectral absorption spectrum according to the method described above, the obtained pigment had a first peak at 643 nm and a second peak at 789 nm in the spectrum, and the absorbance of the second peak was 0.74 times the absorbance of the first peak.

In addition, in the X-ray diffraction spectrum using CuKα ray, the obtained pigment has peaks at 7.4°, 16.6°, 25.5° and 28.3° of Bragg angle 2θ±0.2°.

[Production of First Support without Anodization]

An aluminum cylinder (JIS-A3003, aluminum alloy) having a length of 257 mm and a diameter of 24 mm was obtained as the first support without anodization, according to a manufacturing method including an extrusion process and a drawing process.

[Production of First Support Subjected to Anodization Treatment 1]

An aluminum cylinder (JIS-A3003, aluminum alloy) was prepared which had a length of 257 mm and a diameter of 24 mm and was produced by the manufacturing method including the extrusion step and the drawing step. The aluminum cylinder was subjected to cutting work with the use of a diamond sintered tool.

The cylinder was subjected sequentially to degreasing treatment, etching treatment in a 2 wt % solution of sodium hydroxide for 1 minute, neutralization treatment and further pure water cleaning, as a cleaning process.

Next, the cleaned cylinder was subjected to anodization in a 10 wt % solution of sulfuric acid at a current density of 1.0 A/dm$^2$ for 20 minutes, and an anodized film was formed on the surface of the cylinder. Next, the anodized cylinder was cleaned with water, and then was immersed in a 1 wt % solution of nickel acetate at 80° C. for 15 minutes to be sealed. Furthermore, the cylinder was subjected to pure water cleaning and drying treatment, and the first support subjected to anodization treatment 1 was obtained.

[Production of First Support Subjected to Anodization Treatment 2]

An aluminum cylinder (JIS-A3003, aluminum alloy) was prepared which had a length of 257 mm and a diameter of 24 mm and was produced by the manufacturing method including the extrusion step and the drawing step.

The cylinder was subjected sequentially to degreasing treatment, etching treatment in a 2 wt % solution of sodium hydroxide for 1 minute, neutralization treatment and further pure water cleaning, as a cleaning process.

Next, the cleaned cylinder was subjected to anodization in a 10 wt % solution of sulfuric acid at a current density of 1.0 A/dm$^2$ for 40 minutes, and an anodized film was formed on the surface of the cylinder. Next, the anodized cylinder was cleaned with water, and then was immersed in a 1 wt % solution of nickel acetate at 80° C. for 15 minutes to be sealed. Furthermore, the cylinder was subjected to pure water cleaning and drying treatment, and the first support subjected to anodization treatment 2 was obtained.

[Preparation of Coating Liquid 1 for First Electroconductive Layer]

Materials were charged into a ball mill, which were 60 parts of a barium sulfate particle (trade name: Pastran PC1, produced by Mitsui Mining & Smelting Co., Ltd.) which was coated with tin oxide, 15 parts of a titanium oxide particle (trade name: TITANIX JR, produced by Tayca Corporation), 43 parts of a resol type phenol resin (trade name: Phenolite J-325, produced by DIC Corporation, solid content 70% by mass), 0.015 parts of silicone oil (trade name: SH28PA, produced by Dow Corning Toray Co., Ltd.), 3.6 parts of a silicone resin particle (trade name: Tospearl 120, produced by Momentive Performance Materials Japan Inc.), 50 parts of 2-methoxy-1-propanol, and 50 parts of methanol; and were subjected to dispersion treatment for 20 hours; and a coating liquid 1 for an electroconductive layer was prepared.

[Preparation of Coating Liquid 2 for First Electroconductive Layer]

A zinc oxide particle (average primary particle diameter: 50 nm, specific surface area: 19 m$^2$/g, powder resistance: 1.0×10$^7$ Ω·cm, produced by Tayca Corporation) in an amount of 100 parts was mixed with 500 parts of toluene while the mixture was stirred. To this mixture, 0.75 parts of N-2-(aminoethyl)-3-aminopropylmethyldimethoxysilane (trade name: KBM-602, produced by Shin-Etsu Chemical Co., Ltd.) were added as a surface treatment agent, and the resultant mixture was mixed for 2 hours while being stirred. After that, toluene was distilled off under reduced pressure, the resultant product was dried at 120° C. for 3 hours, and thereby a surface-treated zinc oxide particle was obtained.

Next, 100 parts of a titanium oxide particle (trade name: JR 405, average primary particle diameter: 210 nm, produced by Tayca Corporation) were stirred and mixed with 500 parts of toluene, 0.75 parts of N-2-(aminoethyl)-3-aminopropylmethyldimethoxysilane were added thereto, and the mixture was stirred for 2 hours. After that, toluene was distilled off under reduced pressure, the resultant product was dried at 120° C. for 3 hours, and thereby a surface-treated titanium oxide particle was obtained.

Subsequently, 100 parts of the above surface-treated zinc oxide particle, 12 parts of the above surface-treated titanium oxide, and 30 parts of a blocked isocyanate compound represented by the following Formula (A2):

(A2)

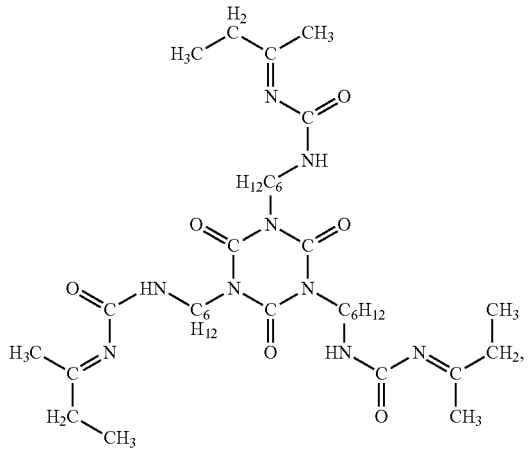

(trade name: Sumidule 3175, solid content: 75% by mass, made by Sumika Covestro Urethane Co., Ltd.), 15 parts of a polyvinyl butyral resin (trade name: S-LEC BM-1, produced by Sekisui Chemical Co., Ltd.), and 1 part of 2,3,4-trihydroxybenzophenone (produced by Tokyo Chemical Industry Co., Ltd.) were added to a mixed solvent of 70 parts of methyl ethyl ketone and 70 parts of cyclohexanone; and a dispersion liquid was prepared.

The dispersion liquid was subjected to dispersion treatment for 3 hours, in a vertical sand mill with the use of glass beads having an average particle size of 1.0 mm, at a number of rotations of 1,500 rpm, under an atmosphere of 23° C. After the dispersion treatment, 7 parts of a cross-linked polymethylmethacrylate particle (trade name: SSX-103, average particle size: 3 μm, produced by Sekisui Chemical Co., Ltd.) and 0.01 parts of silicone oil (trade name: SH28PA, produced by Dow Corning Toray Co., Ltd.) were added to the obtained dispersion liquid, and the mixture was stirred; and thereby a coating liquid 2 for the first electroconductive layer was prepared.

[Preparation of Coating Liquid 3 for First Electroconductive Layer]

A zinc oxide particle (specific surface area: 19 $m^2/g$, powder resistivity: $4.7\times10^6$ Ω·cm) in an amount of 100 parts was stirred and mixed with 500 parts of toluene, and 0.8 parts of a silane coupling agent (compound name: N-2-(aminoethyl)-3-aminopropylmethyldimethoxysilane, trade name: KBM602, produced by Shin-Etsu Chemical Co., Ltd.) were added thereto, and the mixture was stirred for 6 hours. After that, toluene was distilled off under reduced pressure, the resultant product was heated and dried at 130° C. for 6 hours, and a surface-treated zinc oxide particle was obtained.

Subsequently, 15 parts of a butyral resin (trade name: BM-1, produced by Sekisui Chemical Co., Ltd.) and 15 parts of blocked isocyanate (trade name: Duranate TPA-B80E, non-volatile content of 80% by mass, produced by Asahi Kasei Chemicals, Corporation) were dissolved in a mixed solution of 72 parts of methyl ethyl ketone and 72 parts of 1-butanol, and a solution was obtained. To this solution, 80 parts of the above surface-treated zinc oxide particle and 0.4 parts of 2,3,4-trihydroxybenzophenone (produced by Tokyo Chemical Industry Co., Ltd.) were added; and the mixture was charged in a sand mill with the use of glass beads having a diameter of 0.8 mm, and was subjected to dispersion treatment under an atmosphere at 23±3° C. for 3 hours. After the dispersion treatment, 0.01 parts of silicone oil (trade name: SH28PA, produced by AR BROWN Co., Ltd.), and 5.6 parts of a cross-linked polymethylmethacrylate (PMMA) particle (trade name: Techpolymer SSX-103, produced by Sekisui Kasei Co., Ltd., average primary particle size: 3 μm) were added thereto, the mixture was stirred, and a coating liquid 3 for the first electroconductive layer was prepared.

[Preparation of Coating Liquid 4 for First Electroconductive Layer]

A phenolic resin (monomer/oligomer of phenolic resin) (trade name: Plyophen J-325, produced by DIC Corporation, resin solid content: 60%, and density after curing: 1.3 $g/cm^3$) of a binder material in an amount of 50 parts was dissolved in 35 parts of 1-methoxy-2-propanol of a solvent, and a solution was obtained.

To the solution, 75 parts of the titanium oxide particle 1 obtained in Production Example 1 of the titanium oxide particle was added; the resultant liquid was used as a dispersion medium, and was charged into a vertical sand mill which used 120 parts of glass beads having an average particle size of 1.0 mm; the mixture was subjected to dispersion treatment under conditions of a dispersion liquid temperature of 23±3° C. and a number of rotations of 1500 rpm (circumferential velocity: 5.5 m/s) for 4 hours; and a dispersion liquid was obtained. The glass beads were removed from the dispersion liquid by a mesh. Into the dispersion liquid from which the glass beads were removed, 0.01 parts of silicone oil (trade name: SH28 PAINT ADDITIVE, produced by Dow Corning Toray Co., Ltd.) as a leveling agent, and 8 parts of a silicone resin particle (trade name: KMP-590, produced by Shin-Etsu Chemical Co., Ltd., average particle size: 2 μm, and density: 1.3 $g/cm^3$) as a surface roughness imparting material were added; the mixture was stirred, and was pressure filtered with the use of a PTFE filter paper (trade name: PF060, produced by Advantec Toyo Kaisha, Ltd.); and thereby a coating liquid 4 for the first electroconductive layer was prepared.

[Preparation of Coating Liquid 1 for Undercoat Layer]

N-methoxymethylated nylon 6 (trade name: Toresin EF-30T, produced by Nagase Chemtex Corporation) in an amount of 25 parts was dissolved (dissolution by heating at 65° C.) in 480 parts of a mixed solution of methanol/n-butanol=2/1, and the resultant solution was cooled. After that, the solution was filtered through a membrane filter (trade name: FP-022, pore size: 0.22 μm, produced by Sumitomo Electric Industries, Ltd.), and a coating liquid 1 for an undercoat layer was prepared.

[Preparation of Coating Liquid 2 for Undercoat Layer]

A Rutile-type titanium oxide particle (trade name: MT-600B, average primary particle size: 50 nm, produced by Tayca Corporation) in an amount of 100 parts were stirred and mixed with toluene in an amount of 500 parts, 5.0 parts of vinyltrimethoxysilane (trade name: KBM-1003, produced by Shin-Etsu Chemical Co., Ltd.) were added thereto, and the mixture was stirred for 8 hours. After that, the toluene was distilled off under reduced pressure, the resultant product was dried at 120° C. for 3 hours, and thereby a rutile-type titanium oxide particle was obtained which was already surface-treated with vinyltrimethoxysilane.

Subsequently, 18 parts of the above rutile-type titanium oxide particle which was surface-treated with the vinyltrimethoxysilane, 4.5 parts of N-methoxymethylated nylon (trade name: Toresin EF-30T, produced by Nagase Chemtex Corporation), and 1.5 parts of a copolymerized nylon resin (trade name: Amilan CM8000, produced by Toray Industries, Inc.) were added to a mixed solvent of 90 parts of methanol and 60 parts of 1-butanol, and a dispersion liquid was prepared. This dispersion liquid was subjected to dispersion treatment in a vertical sand mill with the use of glass beads having a diameter of 1.0 mm, for 5 hours, and a coating liquid 2 for the undercoat layer was prepared.

[Preparation of Coating Liquid 3 for Undercoat Layer]

A chemical compound in an amount of 1 part by mass, which is represented by the following Formula (A3):

(A3)

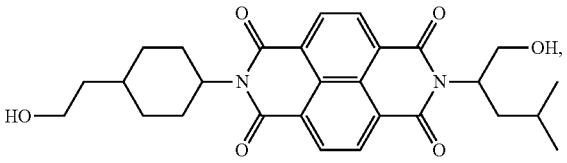

a polyvinyl butyral resin (S-LEC KSS, produced by Sekisui Chemical Co., Ltd.) in an amount of 0.2 parts by mass, and dioctyl tin laurate in an amount of 0.0005 parts by mass were dissolved in a mixed solvent of 15 parts by mass of methoxypropanol and 15 parts by mass of tetrahydrofuran. To this solution, a blocked isocyanate resin (Duranate SBN-70D, manufactured by Asahi Kasei Corporation) of which the solid content corresponds to 1.3 parts by mass was added, and a coating liquid 3 for the undercoat layer was prepared.

[Preparation of Coating Liquid 1 for Charge Generation Layer]

The hydroxygallium phthalocyanine pigment in an amount of 20 parts, which was obtained in Milling Example 1, 10 parts of polyvinyl butyral (trade name: S-LEC BX-1, produced by Sekisui Chemical Co., Ltd.), 190 parts of cyclohexanone and 482 parts of glass beads having a diameter of 0.9 mm were subjected to dispersion treatment at a cooling water temperature of 18° C. for 4 hours, with the use of a sand mill (K-800, manufactured by Igarashi Kikai Seizo Co., Ltd. (currently AIMEX Co., Ltd.), disk diameter of 70 mm, and number of discs being 5 disks). At this time, the dispersion treatment was performed under the condition that the disk rotated 1,800 times per minute. To this dispersion liquid, 444 parts of cyclohexanone and 634 parts of ethyl acetate were added, and thereby a coating liquid 1 for the charge generation layer was prepared.

[Preparation of Coating Liquid 2 for Charge Generation Layer]

The titanyl phthalocyanine pigment in an amount of 12 parts, which was obtained in Milling Example 2, 10 parts of polyvinyl butyral (trade name: S-LEC BX-1, produced by Sekisui Chemical Co., Ltd.), 139 parts of cyclohexanone and 354 parts of glass beads having a diameter of 0.9 mm were subjected to dispersion treatment at a cooling water temperature of 18° C. for 4 hours, with the use of a sand mill (K-800, manufactured by Igarashi Kikai Seizo Co., Ltd. (currently AIMEX Co., Ltd.), disk diameter of 70 mm, and number of discs being 5 disks). At this time, the dispersion treatment was performed under the condition that the disk rotated 1,800 times per minute. To this dispersion liquid, 326 parts of cyclohexanone and 465 parts of ethyl acetate were added, and thereby a coating liquid 2 for the charge generation layer was prepared.

[Preparation of Coating Liquid 3 for Charge Generation Layer]

The chlorogallium phthalocyanine pigment in an amount of 30 parts, which was obtained in Milling Example 3, 10 parts of polyvinyl butyral (trade name: S-LEC BX-1, produced by Sekisui Chemical Co., Ltd.), 253 parts of cyclohexanone and 643 parts of glass beads having a diameter of 0.9 mm were subjected to dispersion treatment at a cooling water temperature of 18° C. for 4 hours, with the use of a sand mill (K-800, manufactured by Igarashi Kikai Seizo Co., Ltd. (currently AIMEX Co., Ltd.), disk diameter of 70 mm, and number of discs being 5 disks). At this time, the dispersion treatment was performed under the condition that the disk rotated 1,800 times per minute. To this dispersion liquid, 592 parts of cyclohexanone and 845 parts of ethyl acetate were added, and thereby a coating liquid 3 for the charge generation layer was prepared.

[Preparation of Coating Liquid 4 for Charge Generation Layer]

A disazo compound in an amount of 20 parts, which is represented by the following Formula (A4):

(A4)

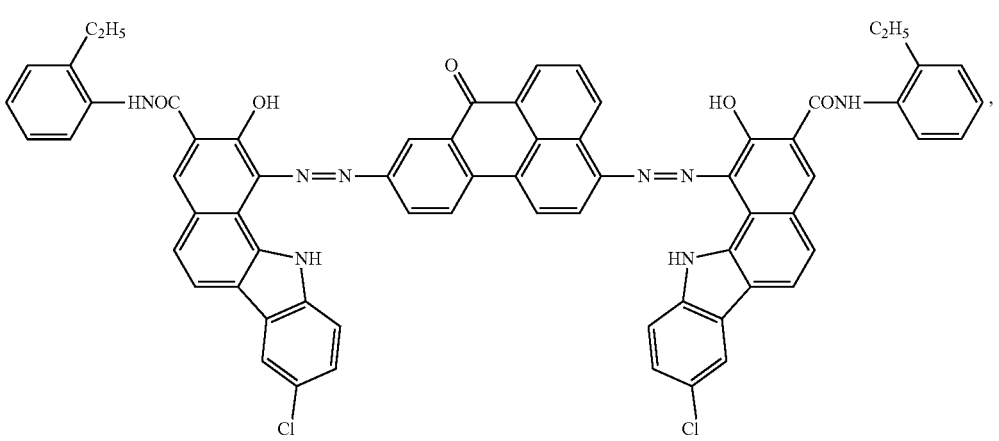

a polyvinyl butyral (trade name: S-LEC BX-1, produced by Sekisui Chemical Co., Ltd.) in an amount of 8 parts, 177 parts of cyclohexanone and 482 parts of glass beads having a diameter of 0.9 mm were subjected to dispersion treatment under cooling water temperature of 18° C. for 4 hours, with the use of a sand mill (K-800, manufactured by Igarashi Kikai Seizo Co., Ltd. (currently AIMEX Co., Ltd.), disk diameter 70 mm, and number of disks being 5 disks). At this time, the dispersion treatment was performed under the condition that the disk rotated 1,800 times per minute. To this dispersion liquid, 414 parts of cyclohexanone and 592 parts of ethyl acetate were added, and thereby a coating solution 4 for the charge generation layer was prepared.

[Preparation of Coating Liquid 5 for Charge Generation Layer]

A trisazo compound in an amount of 20 parts, which is represented by the following Formula (A5):

(A5)

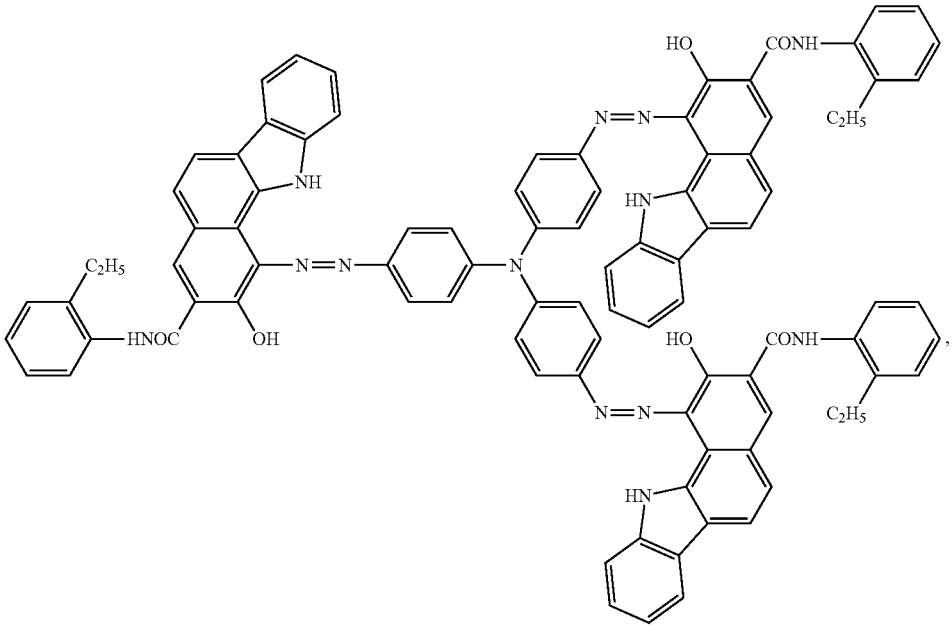

30 parts of a polyvinyl butyral (trade name: S-LEC BLS, produced by Sekisui Chemical Co., Ltd.), 300 parts of cyclohexanone and 500 parts of glass beads having a diameter of 0.9 mm were subjected to milling treatment in a ball mill under room temperature (23° C.) for 48 hours. At this time, a standard bottle (trade name: PS-6, manufactured by Hakuyo Glass Co., Ltd.) was used as the container, and the milling treatment was performed under the condition that the container rotated 60 times per 1 minute. To this dispersion liquid, 60 parts of cyclohexanone and 360 parts of ethyl acetate were added, and thereby a coating liquid 5 for the charge generation layer was prepared.

[Preparation of Coating Liquid for Charge Transport Layer]

As the charge transport substance, 70 parts of a triarylamine compound represented by the following Formula (A6):

(A6)

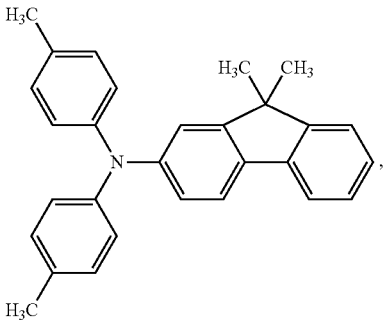

10 parts of a triarylamine compound represented by the following Formula (A7):

(A7)

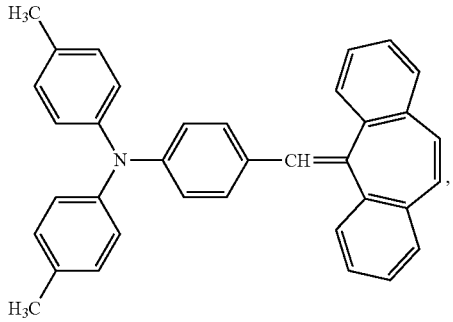

and 100 parts of polycarbonate (trade name: Iupilon Z-200, produced by Mitsubishi Engineering-Plastics Corporation) were dissolved in 630 parts of monochlorobenzene, and a coating liquid for the charge transport layer was prepared.

Production of Electrophotographic Photosensitive Member

Photosensitive Member Production Example 1

The first support without anodization was dip-coated with a coating liquid 1 for the charge generation layer to have a coating film formed thereon, the coating film was heated and dried at 100° C. for 10 minutes, and thereby a charge generation layer was formed which had a film thickness of 150 nm.

Next, the above charge generation layer was dip-coated with the coating liquid for the charge transport layer to have a coating film formed thereon, the coating film was heated and dried at a temperature of 120° C. for 60 minutes, and thereby a charge transport layer was formed which had a film thickness of 15 μm.

The coating films of the charge generation layer and the charge transport layer were heated with the use of an oven set at respective temperatures. As described above, the cylindrical (drum-shaped) photosensitive member 1 was produced.

The gradients $a_1$ and $a_2$ and the square root $E^{0.5}$ $[(V/m)^{0.5}]$ of the electric field strength at a point at which the gradients changed on the photosensitive member 1 obtained at this time were measured by the previously described method. The results are shown in Table 1 together with the configuration of Photosensitive Member Production Example 1.

In Table 1, "No anodization" means "first support without anodization", "Anodization 1" means "first support subjected to anodization treatment 1", and "Anodization 2" means "first support subjected to anodization treatment 2". In addition, "CPL" means "first electroconductive layer"; and "1", "2", "3" and "4" of CPL coating liquid No. mean "coating liquid 1 for first electroconductive layer", "coating liquid 2 for first electroconductive layer", and "coating liquid 3 for first electroconductive layer", and "coating liquid 4 for first electroconductive layer", respectively. Furthermore, "UCL" means "undercoat layer"; and "1", "2" and "3" of UCL coating liquid No. mean "coating liquid 1 for undercoat layer", "coating liquid 2 for undercoat layer", and "coating liquid 3 for undercoat layer", respectively. "CGL" means "charge generation layer"; and "1", "2", "3", "4" and "5" of CGL coating liquid No. mean "coating liquid 1 for charge generation layer", "coating liquid 2 for charge generation layer", and "coating liquid 3 for charge generation layer", "coating liquid 4 for charge generation layer", and "coating liquid 5 for charge generation layer", respectively.

In addition, in Table 1, a drying temperature, a drying time period, and a film thickness after drying when the CPL coating liquids No. 1 to 4 are applied by dipping are as follows.

- CPL coating liquid No. 1: drying temperature 145° C., drying time period 60 minutes, and film thickness after drying 30 μm
- CPL coating liquid No. 2: drying temperature 170° C., drying time period 20 minutes, and film thickness after drying 30 μm
- CPL coating liquid No. 3: drying temperature 160° C., drying time period 30 minutes, and film thickness after drying 18 μm
- CPL coating liquid No. 4: drying temperature 150° C., drying time period 20 minutes, and film thickness after drying 25 μm In addition, in Table 1, a drying temperature and a drying time period when the UCL coating liquids No. 1 to 3 are applied by dipping are as follows.

- UCL coating liquid No. 1: drying temperature 100° C., and drying time period 10 minutes
- UCL coating liquid No. 2: drying temperature 100° C., and drying time period 10 minutes
- UCL coating liquid No. 3: drying temperature 160° C., and drying time period 30 minutes In addition, in Table 1, a drying temperature and a drying time period when the CGL coating liquids No. 1 to 5 are applied by dipping are as follows.

- CGL coating liquid No. 1: drying temperature 100° C., drying time period 10 minutes, and film thickness after drying 150 nm
- CGL coating liquid No. 2: drying temperature 100° C., drying time period 10 minutes, and film thickness after drying 140 nm
- CGL coating liquid No. 3: drying temperature 100° C., drying time period 10 minutes, and film thickness after drying 190 nm
- CGL coating liquid No. 4: drying temperature 100° C., drying time period 10 minutes, and film thickness after drying 210 nm
- CGL coating liquid No. 5: drying temperature 100° C., drying time period 10 minutes, and film thickness after drying 220 nm Furthermore, "-" in Table 1 means that the relevant layer is not formed.

Photosensitive Member Production Examples 2 to 29

Photosensitive members 2 to 29 were produced in the same manner as in Photosensitive Member Production Example 1, except that the first electroconductive layer, the undercoat layer and the charge generation layer were changed as shown in Table 1, in Photosensitive Member Production Example 1. The coating films of the first electroconductive layer, the undercoat layer, the charge generation layer and the charge transport layer were heated with the use of an oven set at respective temperatures.

In addition, the gradients $a_1$ and $a_2$ and the square root $E^{0.5}$ $[(V/m)^{0.5}]$ of the electric field strength at a point at which the gradients changed on the photosensitive members 2 to 29 were measured in the same manner as in Photosensitive Member Production Example 1. The results are shown in Table 1 together with the configurations of Photosensitive Member Production Examples 2 to 29.

TABLE 1

| Photosensitive Member | Each layer of photosensitive member | | | | | Physical property value | | |
|---|---|---|---|---|---|---|---|---|
| Production Example No. | Type of support 1 | CPL coating liquid No. | UCL coating liquid No. | UCL film thickness/μm | CGL coating liquid No. | $E^{0.5}/(V/m)^{0.5}$ | $a_1 \times 10^{-4}$ | $a_2 \times 10^{-4}$ |
| 1 | No anodization | — | — | — | 1 | 5793 | 2.73 | 8.21 |
| 2 | No anodization | 1 | — | — | 1 | 5794 | 2.93 | 10.10 |
| 3 | No anodization | 2 | — | — | 1 | 3735 | 3.61 | 8.22 |
| 4 | No anodization | 3 | — | — | 1 | 4091 | 3.11 | 8.32 |
| 5 | No anodization | 4 | — | — | 1 | 6443 | 3.21 | 8.88 |
| 6 | Anodization 1 | — | — | — | 1 | 4942 | 2.92 | 8.27 |
| 7 | Anodization 2 | — | — | — | 1 | 5454 | 3.22 | 6.95 |
| 8 | No anodization | — | 1 | 0.6 | 1 | 8855 | 3.76 | 6.29 |
| 9 | No anodization | 3 | 1 | 0.6 | 1 | 8533 | 3.78 | 5.95 |
| 10 | No anodization | — | 2 | 2.0 | 1 | 8014 | 3.30 | 5.98 |
| 11 | No anodization | 1 | 2 | 2.0 | 1 | 6904 | 3.12 | 8.04 |

TABLE 1-continued

| Photosensitive Member | Each layer of photosensitive member | | | | | Physical property value | | |
|---|---|---|---|---|---|---|---|---|
| | | CPL coating | UCL coating | UCL film | CGL coating | | | |
| Production Example No. | Type of support 1 | liquid No. | liquid No. | thickness/ μm | liquid No. | $E^{0.5}/(V/m)^{0.5}$ | $a_1 \times 10^{-4}$ | $a_2 \times 10^{-4}$ |
| 12 | No anodization | 4 | 2 | 2.0 | 1 | 7229 | 3.26 | 7.43 |
| 13 | Anodization 1 | — | 2 | 2.0 | 1 | 6478 | 3.11 | 7.13 |
| 14 | No anodization | — | 3 | 0.7 | 1 | 6717 | 3.02 | 6.01 |
| 15 | No anodization | 1 | 3 | 0.7 | 1 | 7173 | 2.83 | 5.67 |
| 16 | No anodization | 2 | 3 | 0.7 | 1 | 6261 | 2.69 | 5.84 |
| 17 | No anodization | — | — | — | 2 | 6099 | 3.23 | 8.63 |
| 18 | No anodization | — | — | — | 3 | 5826 | 2.68 | 7.21 |
| 19 | No anodization | — | — | — | 4 | 5621 | 3.16 | 5.25 |
| 20 | No anodization | — | — | — | 5 | 5771 | 3.01 | 5.39 |
| 21 | Anodization 1 | — | 2 | 2.0 | 2 | 6810 | 3.57 | 7.49 |
| 22 | Anodization 1 | — | 2 | 2.0 | 3 | 6533 | 2.99 | 6.24 |
| 23 | Anodization 1 | — | 2 | 2.0 | 4 | 6187 | 3.18 | 4.91 |
| 24 | Anodization 1 | — | 2 | 2.0 | 5 | 6493 | 3.21 | 4.89 |
| 25 | No anodization | — | 1 | 0.6 | 2 | 8788 | 4.11 | 6.61 |
| 26 | No anodization | — | 1 | 0.6 | 3 | 8605 | 3.52 | 5.52 |
| 27 | No anodization | 1 | 1 | 1.0 | 1 | 8924 | 3.86 | 5.59 |

Production of Unvulcanized Rubber Mixture (CMB) for Forming Domain

CMB Production Example 1

Styrene-butadiene rubber (trade name: Tuffden 1000, produced by Asahi Kasei Corporation) in an amount of 100 parts, which was a raw material rubber, 60 parts of carbon black (trade name: Toka Black #5500 produced by Tokai Carbon Co., Ltd) which was an electron conducting agent, 5 parts of zinc oxide (trade name: zinc oxide type 2, produced by Sakai Chemical Industry Co., Ltd.) which was a vulcanization accelerator, 2 parts of zinc stearate (trade name: SZ-2000, produced by Sakai Chemical Industry Co., Ltd.) which was a processing aid were mixed with the use of a 6-liter pressure kneader (trade name: TD6-15MDX, manufactured by Toshin Co., Ltd.); and CMB1 was produced. The mixing conditions were set at a filling rate of 70 vol %, a number of rotations of the blade of 30 rpm, and 30 minutes.

At this time, the SP value and the Mooney viscosity of the raw material rubber, and the Mooney viscosity of CMB1 were measured by the previously described method. The results are shown in Table 2 together with a formation of each material in CMB Production Example 1.

Abbreviated names of materials of types of the raw material rubber in Table 2 are shown in Table 4, and abbreviated names of materials of the electron conducting agents are shown in Table 5.

Note that "parts by mass" in Table 2 means parts by mass of the electron conducting agent with respect to 100 parts of the type of raw material rubber.

CMB Production Examples 2 to 8 and 12 to 14

CMBs 2 to 8 and 12 to 14 were produced in the same manner as in CMB Production Example 1, except that the types of the raw material rubber and the electron conducting agents were changed as shown in Table 2, in CMB Production Example 1.

In addition, the SP values and Mooney viscosities of the raw material rubbers of CMB Production Examples 2 to 8 and 12 to 14, and the Mooney viscosities of CMBs 2 to 8 and 12 to 14 were measured in the same manner as in CMB Production Example 1. The results are shown in Table 2 together with formations of each material in CMB Production Examples 2 to 8 and 12 to 14.

CMB Production Example 9

An unvulcanized rubber mixture CNB 9A for forming CMB 9 was produced in the same manner as in the production of the unvulcanized domain rubber of CMB Production Example 1, but the type of the raw material rubber and the electron conducting agent were changed as shown in Table 2. Next, 100 parts of the unvulcanized rubber mixture CNB 9A, 3 parts of sulfur (trade name: SULFAXPMC, produced by Tsurumi Chemical Industry Co., Ltd.) which was a vulcanizing agent, and 3 parts of tetraethylthiuram disulfide (trade name: Nocceler TET-G, produced by Ouchi Shinko Chemical Industry Co., Ltd.) which was a vulcanization aid were mixed with the use of an open roll having a roll diameter of 12 inches; and a rubber composition for forming the domain was prepared. As for the mixing condition, the number of rotations of the front roll was set at 10 rpm, the number of rotations of the rear roll was set at 8 rpm, and the roll gap was set at 2 mm; left and right were turned back 20 times in total; and then the roll gap was set at 0.5 mm, and tight milling was performed 10 times.

The obtained rubber composition for forming the domain was charged into a mold having a thickness of 2 mm, and vulcanized by a hot press at a pressure of 10 MPa and a temperature of 160° C. for 30 minutes. The rubber sheet was taken out from the mold and was cooled to room temperature; and a vulcanized rubber sheet of the rubber composition for forming the domain was obtained, which had a thickness of 2 mm.

The obtained vulcanized rubber sheet of the rubber composition for forming the domain was immersed in liquid nitrogen for 48 hours, was completely frozen, and then was crushed with a hammer; and coarse powder was formed. After that, freeze pulverization and classification were performed at the same time with the use of a collision type supersonic jet pulverizer (trade name: CPY+USF-TYPE, manufactured by Nippon Pneumatic Mfg. Co., Ltd.) to produce CMB 9.

CMB Production Example 10

CMB 10 was produced in the same manner as in CMB Production Example 1, except that in CMB Production Example 1, the type of the raw material rubber and the electron conducting agent were changed as shown in Table 2, zinc oxide was not used as the vulcanization accelerator, 1 part of stearic acid was used in place of 2 parts of zinc stearate as a processing aid, and 30 parts of paraffin oil (trade name: PW-380, produced by Idemitsu Kosan Co., Ltd.) was added as a softening agent.

In addition, the SP value and Mooney viscosity of the raw material rubber of CMB Production Example 10, and the Mooney viscosity of CMB 10 were measured in the same manner, as in CMB Production Example 1. The results are shown in Table 2 together with a formation of each material in CMB Production Example 10.

CMB Production Example 11

CMB 11 was produced in the same manner as in CMB Production Example 1, except that in CMB Production Example 1, the type of the raw material rubber and the electron conducting agent were changed as shown in Table 2, 1 part of stearic acid was used in place of 2 parts of zinc stearate as a processing aid, and 30 parts of paraffin oil (trade name: PW-380, produced by Idemitsu Kosan Co., Ltd.) was added as a softening agent.

In addition, the SP value and Mooney viscosity of the raw material rubber of CMB Production Example 11, and the Mooney viscosity of CMB 11 were measured in the same manner as in CMB Production Example 1. The results are shown in Table 2 together with a formation of each material in CMB Production Example 11.

stearate (trade name: SZ-2000, produced by Sakai Chemical Industry Co., Ltd.) which was a processing aid were mixed with the use of a 6-liter pressure kneader (trade name: TD6-15MDX, manufactured by Toshin Co., Ltd.); and MRC 1 was produced. The mixing conditions were set at a filling rate of 70 vol %, a blade rotation speed of 30 rpm, and 16 minutes.

At this time, the SP value and the Mooney viscosity of the raw material rubber, and the Mooney viscosity of MRC 1 were measured by the previously described method. The results are shown in Table 3 together with a formation of each material in MRC Production Example 1.

Note that "parts by mass" in Table 3 means parts by mass of the electroconducting agent with respect to 100 parts of the types of raw material rubber. Abbreviated names of materials of types of the raw material rubber in Table 3 are shown in Table 4, and abbreviated names of materials of the fillers are shown in Table 5.

MRC Production Examples 2 to 8, 10 to 12, 15 and 16

MRCs 2 to 8, 10 to 12, 15 and 16 were produced in the same manner as in MRC Production Example 1, except that the types of the raw material rubber and the electroconducting agents/auxiliary agents were changed as shown in Table 3, in MRC Production Example 1.

In addition, in the same manner as in MRC Production Example 1, the SP values and Mooney viscosities of the raw material rubbers of MRC Production Examples 2 to 8, 10 to 12, 15 and 16, and the Mooney viscosities of MRC 2 to 8, 10 to 12, 15 and 16 were measured. The results are shown in Table 3 together with formations of each material in MRC Production Examples 2 to 8, 10 to 12, 15 and 16.

TABLE 2

| CMB Production Example No. | Type of raw material rubber: Abbreviated name of material | | SP value/ $MPa^{0.5}$ | Mooney viscosity | Electroconducting agent: Abbreviated name of material | Parts by mass | DBP/ $cm^3/100$ g | Dispersion time period/ min | Mooney viscosity |
|---|---|---|---|---|---|---|---|---|---|
| 1 | SBR | T1000 | 16.8 | 45 | #5500 | 60 | 155 | 30 | 92 |
| 2 | EPDM | 505A | 16 | 47 | #5500 | 65 | 155 | 30 | 94 |
| 3 | Butyl | Butyl 065 | 15.8 | 32 | #5500 | 65 | 155 | 30 | 93 |
| 4 | SBR | T2100 | 17 | 78 | #5500 | 65 | 155 | 30 | 110 |
| 5 | NBR | DN401LL | 17.4 | 32 | #7360 | 70 | 87 | 30 | 90 |
| 6 | NBR | N220SV | 20.4 | 57 | #7360 | 75 | 87 | 30 | 92 |
| 7 | NBR | N230SV | 19.2 | 32 | #7360 | 70 | 87 | 30 | 90 |
| 8 | NBR | N230SV | 19.2 | 32 | ECP | 15 | 360 | 30 | 60 |
| 9 | BR | T0700 | 17.1 | 43 | #7360 | 85 | 87 | 30 | 95 |
| 10 | EPT | 4045 | 16.4 | 45 | EC600JD | 10 | 495 | 30 | 57 |
| 11 | EPT | 4045 | 16.4 | 45 | EC600JD | 12 | 495 | 30 | 60 |
| 12 | ECO | CG102 | 18.5 | 52 | LV | 3 | — | 30 | 57 |
| 13 | NBR | N230SV | 19.2 | 32 | #7360 | 50 | 87 | 30 | 60 |
| 14 | Butyl | Butyl 065 | 15.8 | 32 | — | — | — | — | 37 |

Production of Rubber Mixture for Forming Matrix (MRC)

MRC Production Example 1

Butyl rubber (trade name: JSR Butyl 065, produced by JSR Corporation) in an amount of 100 parts, which was a raw material rubber, 70 parts of calcium carbonate (trade name: NANOX #30 produced by Maruo Calcium Co., Ltd.) which was a filler, 7 parts of zinc oxide (trade name: zinc oxide type 2, produced by Sakai Chemical Industry Co., Ltd.) which was a vulcanization accelerator, 2.8 parts of zinc MRC Production Example 9

MRC 9 was produced in the same manner as in MRC Production Example 1, except that in MRC Production Example 1, the type of the raw material rubber and the electroconducting agent/auxiliary agent were changed as shown in Table 3, calcium carbonate was not used as the filler, zinc oxide was not used as the vulcanization accelerator, and 1.33 parts of stearic acid was used in place of 2.8 parts of zinc stearate as a processing aid.

In addition, the SP value and Mooney viscosity of the raw material rubber of MRC Production Example 9, and the Mooney viscosity of MRC 9 were measured in the same manner as in MRC Production Example 1. The results are shown in Table 3 together with a formation of each material in MRC Production Example 9.

MRC Production Example 13

MRC 13 was produced in the same manner as in MRC Production Example 1, except that in MRC Production Example 1, the type of the raw material rubber and the electroconducting agent/auxiliary agent were changed as shown in Table 3, calcium carbonate was not used as the filler, zinc oxide was not used as the vulcanization accelerator, and 0.91 parts of stearic acid was used in place of 2.8 parts of zinc stearate as a processing aid.

Note that "Gerc3106+N280" in Table 3 means a mixture of 90 parts of terpolymer of epichlorohydrin-ethylene oxide-allyl glycidyl ether (Gerchron 3106, produced by Zeon Corporation) and 10 parts of liquid NBR (N280, produced by JSR corporation).

In addition, the SP value and Mooney viscosity of the raw material rubber of MRC Production Example 13, and the Mooney viscosity of MRC 13 were measured in the same manner as in MRC Production Example 1. The results are shown in Table 3 together with a formation of each material in MRC Production Example 13.

MRC Production Example 14

MRC 14 was produced in the same manner as in MRC Production Example 1, except that in MRC Production Example 1, the type of the raw material rubber and the electroconducting agent/auxiliary agent were changed as shown in Table 3, calcium carbonate was not used as the filler, 7 parts of zinc oxide of the vulcanization accelerator was changed to 4.62 parts of zinc oxide, and 1.54 parts of stearic acid was used in place of 2.8 parts of zinc stearate as a processing aid.

Note that "LiClO4" in Table 3 means lithium perchlorate of an ion conducting agent.

In addition, the SP value and Mooney viscosity of the raw material rubber of MRC Production Example 14, and the Mooney viscosity of MRC 14 were measured in the same manner as in MRC Production Example 1. The results are shown in Table 3 together with a formation of each material in MRC Production Example 14.

TABLE 3

| MRC Production Example No. | Type of raw material rubber: Abbreviated name of material | | SP value/ $MPa^{0.5}$ | Mooney viscosity | Electroconducting agent/ auxiliary agent: Abbreviated name of material | Parts by mass | DBP/ $cm^3/100$ g | Dispersion time period/ min | Mooney viscosity |
|---|---|---|---|---|---|---|---|---|---|
| 1 | Butyl | Butyl 065 | 15.8 | 32 | — | — | — | 16 | 40 |
| 2 | BR | T0700 | 17.1 | 43 | — | — | — | 16 | 48 |
| 3 | SBR | T1000 | 16.8 | 45 | — | — | — | 16 | 51 |
| 4 | SBR | T2003 | 17 | 33 | — | — | — | 16 | 38 |
| 5 | SBR | A303 | 17 | 46 | — | — | — | 16 | 52 |
| 6 | SBR | T2100 | 17 | 78 | — | — | — | 16 | 82 |
| 7 | EPDM | 505A | 16 | 47 | — | — | — | 16 | 52 |
| 8 | EPDM | 301A | 16 | 44 | — | — | — | 16 | 51 |
| 9 | ECO | CG102 | 18.5 | 52 | LV | 3 | — | 16 | 40 |
| 10 | Butyl | Butyl 065 | 15.8 | 32 | #7360 | 20 | 87 | 16 | 60 |
| 11 | NBR | N230SV | 19.2 | 32 | — | — | — | 16 | 37 |
| 12 | ECO | CG102 | 18.5 | 52 | — | — | — | 16 | 42 |
| 13 | Gerc3106 + N280 | | 18.6 | 60 | SRF | 20 | 50 | 16 | 70 |
| 14 | NBR | N230SV | 19.2 | 32 | LiClO4 | 0.77 | — | 16 | 35 |
| 15 | SBR | T1000 | 16.8 | 45 | #5500 | 65 | | 16 | 97 |
| 16 | Butyl | Butyl 065 | 15.8 | 32 | #7360 | 30 | — | 16 | 68 |

TABLE 4

| Abbreviated name of material | | Material name | Product name | Manufacturer name |
|---|---|---|---|---|
| IIR | Butyl065 | Butyl rubber | JSR Butyl 065 | JSR Corporation |
| BR | T0700 | Polybutadiene rubber | JSR T0700 | JSR Corporation |
| ECO | CG102 | Epichlorohydrin rubber | Epichromer CG102 | Osaka Soda Co., Ltd. |
| EPDM | 301A | Ethylene propylene diene rubber | Esprene301A | Sumitomo Chemical Co., Ltd. |
| EPDM | 505A | Ethylene propylene diene rubber | Esprene505A | Sumitomo Chemical Co., Ltd. |
| NBR | DN401LL | Acrylonitrile butadiene rubber | Nipol DN401LL | Zeon Corporation |
| NBR | N230SV | Acrylonitrile butadiene rubber | NBR N230SV | JSR Corporation |
| NBR | N220S | Acrylonitrile butadiene rubber | NBR N220S | JSR Corporation |
| SBR | T2003 | Styrene butadiene rubber | Tuffden 2003 | Asahi Kasei Corporation |

TABLE 4-continued

| Abbreviated name of material | | Material name | Product name | Manufacturer name |
|---|---|---|---|---|
| SBR | T1000 | Styrene butadiene rubber | Tuffden 1000 | Asahi Kasei Corporation |
| SBR | T2100 | Styrene butadiene rubber | Tuffden 2100R | Asahi Kasei Corporation |
| SBR | A303 | Styrene butadiene rubber | Asaprene 303 | Asahi Kasei Corporation |
| EPT | 4045 | Ethylene propylene diene rubber | Mitsui EPT4045 | Mitsui Chemicals Inc. |
| Gerc | 3106 | Epichlorohydrin rubber | Gerchron 3106 | Zeon Corporation |
| NBR | N280 | Acrylonitrile butadiene rubber (liquid) | NBR N280 | JSR Corporation |

TABLE 5

| Abbreviated name of material | Material name | Product name | Manufacturer name |
|---|---|---|---|
| #7360 | Electroconductive carbon black | Toka Black #7360SB | Tokai Carbon Co., Ltd. |
| #5500 | Electroconductive carbon black | Toka Black #5500 | Tokai Carbon Co., Ltd. |
| ECP | Electroconductive carbon black | Carbon ECP | Lion Specialty Chemicals Co., Ltd. |
| EC600JD | Electroconductive carbon black | Ketjen Black EC600JD | Lion Specialty Chemicals Co., Ltd. |
| SRF | Carbon black | SRF Carbon Black Asahi #35 | Asahi Carbon Co., Ltd. |
| LV | Ion conducting agent | LV70 | ADEKA |

Production of Charging Member (Charging Roller)

Charging Roller Production Example 1

As a columnar support, a round bar of stainless steel (SUS304) was prepared, which had a total length of 252 mm and an outer diameter of 6 mm, and of which the surface was subjected to electroless nickel plating.

Next, CMB 1 and MRC1 were mixed in a blending amount of 25 parts and 75 parts, respectively, with the use of a 6-liter pressure kneader (trade name: TD6-15MDX, manufactured by Toshin Co., Ltd.). The mixing conditions were set at a filling rate of 70 vol %, a blade rotation speed of 30 rpm, and 30 minutes.

Next, 100 parts of the above mixture of CMB1 and MRC1, 3 parts of sulfur (trade name: SULFAXPMC, produced by Tsurumi Chemical Industry Co., Ltd.) which was a vulcanizing agent, and 3 parts of tetramethylthiuram disulfide (trade name: Nocceler TT-P, produced by Ouchi Shinko Chemical Industry Co., Ltd.) which was a vulcanization aid were mixed with the use of an open roll having a roll diameter of 12 inches; and an unvulcanized rubber mixture for forming the second electroconductive layer was prepared. As for the mixing condition, the number of rotations of the front roll was set at 10 rpm, the number of rotations of the rear roll was set at 8 rpm, and the roll gap was set at 2 mm; left and right were turned back 20 times in total; and then the roll gap was set at 0.5 mm, and tight milling was performed 10 times.

Next, a die having an inner diameter of 10.0 mm was attached to the tip of a crosshead extrusion machine which had a supply mechanism for the second support and a discharge mechanism for an unvulcanized rubber roller, temperatures of the extrusion machine and the crosshead were adjusted at 80° C., and a conveyance speed of the second support was adjusted to 60 mm/sec. Under this condition, the above unvulcanized rubber mixture for forming the second electroconductive layer was supplied from the extrusion machine, the outer circumferential part of the second support was covered with the unvulcanized rubber mixture for forming the second electroconductive layer, in the crosshead, and an unvulcanized rubber roller was obtained.

Next, the above unvulcanized rubber roller was charged into a hot air vulcanizing furnace at 160° C., and the unvulcanized rubber mixture for forming the second electroconductive layer was vulcanized by being heated there for 60 minutes; and a roller was obtained which had the second electroconductive layer formed on the outer circumferential part of the second support. After that, both ends of the second electroconductive layer were cut off by 10 mm each, and the length of the second electroconductive layer in the longitudinal direction was adjusted to 232 mm.

In the end, the surface of the second electroconductive layer was polished with a rotating grindstone. Thereby, a charging roller 1 having such a crown shape was obtained that diameters at positions of 90 mm apart from the central part to both ends side were each 8.4 mm, and that the diameter in the central part was 8.5 mm The volume resistivity $\rho_D$ [Ω·cm] of the domains, the volume resistivity pm [Ω·cm] of the matrix and the arithmetic mean value $D_m$ [μm] of the inter-domain distances on the charging roller 1 which was obtained at this time were measured by the above method. The results are shown in Table 6 together with a configuration of the Charging Roller Production Example 1.

Abbreviated names of materials of the vulcanizing agent and the vulcanization accelerator in Table 6 are shown in Table 7.

Charging Roller Production Examples 2 to 31

Charging rollers 2 to 31 were produced in the same manner as in Charging Roller Production Example 1 except that in Charging Roller Production Example 1, CMB1, MRC1, the mixing ratio between CMB1 and MRC1, the vulcanizing agent and the vulcanization accelerator were changed as shown in Table 6.

For information, "TT+CZ" in Table 6 means a mixture of 1.5 parts of tetramethylthiuram disulfide (Nocceler TT-P, produced by Ouchi Shinko Chemical Industry Co., Ltd.) and 2.0 parts of N-cyclohexyl-2-benzothiazolylsulfenamide (Nocceler CZ, produced by Ouchi Shinko Chemical Industry Co., Ltd.).

In addition, the volume resistivity $\rho_D$ [Ω·cm] of the domains, the volume resistivity $\rho_M$ [Ω·cm] of the matrix, and the arithmetic mean value $D_m$ [μm] of the inter-domain distances in the charging rollers 2 to 31 were measured in the same manner as in the Charging Roller Production Example 1. The results are shown in Table 6 together with configurations of the Charging Roller Production Examples 2 to 31.

Charging Roller Production Example 32

Epichlorohydrin rubber (EO-EP-AGE ternary cocompound) (trade name: Epicomer CG102, produced by Osaka Soda Co., Ltd.) in an amount of 100 parts, which was a raw material rubber, 3 parts of LV-70 (trade name: ADK CIZER LV70, produced by ADEKA Corporation) which was an ion conductive agent, 10 parts of aliphatic polyester plasticizer (trade name: Polycizer P-202, produced by DIC Corporation) which was a plasticizer, 60 parts of calcium carbonate (trade name: NANOX #30 produced by Maruo Calcium Co., Ltd.) which was a filler, 5 parts of zinc oxide (trade name: zinc oxide Type 2, produced by Sakai Chemical Industry Co., Ltd.) which was a vulcanization accelerator, and 1 part of zinc stearate (trade name: SZ-2000 produced by Sakai Chemical Industry Co., Ltd.) which was a processing aid were mixed with the use of a 6-liter pressure kneader (trade name: TD6-15MDX, manufactured by Toshin Co., Ltd.); and an unvulcanized hydrin rubber composition was prepared. The mixing conditions were set at a filling rate of 70 vol %, a number of rotations of the blade of 30 rpm, and 20 minutes.

Next, 100 parts of the above unvulcanized hydrin rubber composition, 1.8 parts of sulfur (trade name: SULFAXPMC, produced by Tsurumi Chemical Industry Co., Ltd.) which was a vulcanizing agent, 1 part of tetramethylthiuram monosulfide (trade name: Nocceler TS, produced by Ouchi Shinko Chemical Industry Co., Ltd.) which was a vulcanization aid 1, and 1 part of 2-mercaptobenzimidazole (trade name: Nocrac MB, produced by Ouchi Shinko Chemical Industry Co., Ltd.) which was a vulcanization aid 2 were mixed with the use of an open roll having a roll diameter of 12 inches; and the first unvulcanized rubber composition was prepared. As for the mixing condition, the number of rotations of the front roll was set at 10 rpm, the number of rotations of the rear roll was set at 8 rpm, and the roll gap was set at 2 mm; left and right were turned back 20 times in total; and then the roll gap was set at 0.5 mm, and tight milling was performed 10 times.

Next, the unvulcanized rubber mixture for forming the second electroconductive layer in Charging Roller Production Example 1 was prepared as a second unvulcanized rubber mixture.

In order to form the prepared first unvulcanized rubber composition and second unvulcanized rubber mixture around a shaft core, two-layer extrusion was conducted with the use of a two-layer extruding equipment as shown in FIG. 11. FIG. 11 is a schematic view of a two-layer extrusion process. The extrusion machine 162 has a two-layer crosshead 163. The charging member 166 can be produced by the two-layer crosshead 163, in which the second electroconductive elastic layer are stacked on the first electroconductive elastic layer with the use of two types of unvulcanized rubber. The shaft core 161 that has been fed in the direction of the arrow by a cored bar feeding roller 164 which is rotating is inserted into the two-layer crosshead 163 from behind. Two types of cylindrical unvulcanized rubber layers are integrally extruded simultaneously with the shaft core 161, and thereby an unvulcanized rubber roller 165 is obtained of which the perimeter is covered with the two types of unvulcanized rubber layers. The obtained unvulcanized rubber roller 165 is vulcanized with the use of a hot air circulating furnace or an infrared drying furnace. Then, the vulcanized rubbers at both ends of the second electroconductive layer are removed, and the charging member 166 can be obtained.

The two-layer crosshead was adjusted so that the temperature became 100° C. and the outer diameter of the extrudate after extrusion became 10.0 mm. Next, the shaft core was prepared and extruded together with the raw material rubber, thereby two cylindrical raw material rubber layers were simultaneously formed around the cored bar, and an unvulcanized rubber roller was obtained. After that, the above unvulcanized rubber roller was charged into a hot air vulcanizing furnace of 160° C., and was heated for one hour, and an elastic roller having two layers was obtained which were a hydrin base layer (first electroconductive elastic layer) formed on the outer circumferential part of the second support, and a surface layer (second electroconductive elastic layer) having a matrix-domain structure, formed on the outer circumferential part thereof. The thickness ratio between the base layer and the surface layer, and the whole outer diameter were adjusted at the time of extrusion so that the thickness of the surface layer became 0.5 mm. After that, both ends of the second electroconductive layer were cut off by 10 mm each, and the length of the second electroconductive layer in the longitudinal direction was adjusted to 232 mm.

In the end, the surface of the second electroconductive layer was polished with a rotating grindstone. Thereby, a charging roller 32 having a crown shape was produced in which diameters at positions of 90 mm apart from the central part to both ends side were each 8.4 mm, and that the diameter in the central part was 8.5 mm.

In addition, the volume resistivity $\rho_D$ [Ω·cm] of the domains, the volume resistivity $\rho_M$ [Ω·cm] of the matrix, and the arithmetic mean value $D_m$ [μm] of the inter-domain distances in the charging roller 32 were measured in the same manner as in the Charging Roller Production Example 1. The results are shown in Table 6.

TABLE 6

| Charging Roller Production Example No. | Unvulcanized rubber composition: CMB Production Example No. | MRC Production Example No. | CMB, parts by mass | MRC, parts by mass | Vulcanizing agent: Abbreviated name of material | Parts by mass | Vulcanization accelerator: Abbreviated name of material | Parts by mass | Physical property value: Sea-island structure | $\rho_D$/ Ω · cm | $\rho_M$/ Ω · cm | $D_m$/ μm |
|---|---|---|---|---|---|---|---|---|---|---|---|---|
| 1 | 1 | 1 | 25 | 75 | Sulfur | 3 | TT | 3 | Present | $2.6 \times 10^{01}$ | $7.1 \times 10^{16}$ | 0.21 |
| 2 | 1 | 1 | 24.5 | 75.5 | Sulfur | 3 | TT | 3 | Present | $1.2 \times 10^{01}$ | $5.2 \times 10^{16}$ | 0.25 |
| 3 | 1 | 1 | 24 | 76 | Sulfur | 3 | TT | 3 | Present | $2.7 \times 10^{01}$ | $3.0 \times 10^{16}$ | 0.45 |
| 4 | 1 | 1 | 23 | 77 | Sulfur | 3 | TT | 3 | Present | $8.7 \times 10^{01}$ | $8.2 \times 10^{16}$ | 0.85 |
| 5 | 1 | 1 | 20 | 80 | Sulfur | 3 | TT | 3 | Present | $7.6 \times 10^{00}$ | $6.6 \times 10^{16}$ | 1.15 |
| 6 | 2 | 2 | 25 | 75 | Sulfur | 3 | sTET | 1 | Present | $4.4 \times 10^{01}$ | $9.6 \times 10^{15}$ | 0.23 |
| 7 | 3 | 3 | 25 | 75 | Sulfur | 3 | TT | 3 | Present | $2.6 \times 10^{01}$ | $1.5 \times 10^{14}$ | 0.24 |
| 8 | 2 | 4 | 25 | 75 | Sulfur | 3 | sTET | 1 | Present | $7.7 \times 10^{01}$ | $4.7 \times 10^{13}$ | 0.22 |
| 9 | 2 | 5 | 25 | 75 | Sulfur | 3 | sTET | 1 | Present | $6.9 \times 10^{01}$ | $9.0 \times 10^{12}$ | 0.21 |
| 10 | 3 | 6 | 22 | 78 | Sulfur | 3 | TT | 3 | Present | $1.3 \times 10^{01}$ | $8.4 \times 10^{14}$ | 0.23 |
| 11 | 3 | 2 | 21 | 75 | Sulfur | 3 | TT | 3 | Present | $5.0 \times 10^{00}$ | $6.4 \times 10^{15}$ | 1.92 |
| 12 | 4 | 7 | 25 | 75 | Sulfur | 3 | sTET | 3 | Present | $5.9 \times 10^{01}$ | $9.9 \times 10^{15}$ | 0.23 |
| 13 | 2 | 6 | 25 | 75 | Sulfur | 3 | sTET | 3 | Present | $7.0 \times 10^{01}$ | $5.9 \times 10^{12}$ | 0.26 |
| 14 | 5 | 8 | 23 | 75 | Sulfur | 3 | sTET | 3 | Present | $1.0 \times 10^{01}$ | $3.0 \times 10^{15}$ | 2.90 |
| 15 | 6 | 5 | 15 | 85 | Sulfur | 3 | TBZTD | 1 | Present | $6.6 \times 10^{03}$ | $2.6 \times 10^{12}$ | 3.20 |
| 16 | 7 | 7 | 25 | 75 | Sulfur | 3 | sTET | 3 | Present | $5.8 \times 10^{01}$ | $6.3 \times 10^{15}$ | 5.60 |
| 17 | 8 | 9 | 25 | 75 | Sulfur | 3 | TBZTD | 1 | Present | $1.3 \times 10^{01}$ | $1.4 \times 10^{07}$ | 0.56 |
| 18 | 1 | 10 | 25 | 75 | Sulfur | 3 | TT | 3 | Present | $2.6 \times 10^{01}$ | $1.9 \times 10^{07}$ | 0.21 |
| 19 | 1 | 11 | 25 | 75 | Sulfur | 3 | TBZTD | 1 | Present | $5.2 \times 10^{01}$ | $2.6 \times 1009$ | 0.23 |
| 20 | 9 | 7 | 25 | 75 | Sulfur | 3 | nTET | 3 | Present | $8.3 \times 10^{01}$ | $9.3 \times 10^{15}$ | 18 |
| 21 | 9 | 7 | 15 | 85 | Sulfur | 3 | nTET | 3 | Present | $8.3 \times 10^{01}$ | $9.3 \times 10^{15}$ | 25 |
| 22 | 9 | 7 | 10 | 90 | Sulfur | 3 | nTET | 3 | Present | $8.1 \times 10^{01}$ | $9.3 \times 10^{15}$ | 45 |
| 23 | 10 | 12 | 68 | 32 | 25B-40 | 2.25 | TAIC | 1.35 | Present | $2.9 \times 10^{05}$ | $3.0 \times 10^{08}$ | 0.85 |
| 24 | 10 | 13 | 23 | 77 | 25B-40 | 2 | TAIC | 1.2 | Present | $1.4 \times 10^{05}$ | $9.0 \times 10^{07}$ | 0.80 |
| 25 | 10 | 13 | 39 | 61 | 25B-40 | 3.91 | TAIC | 2.34 | Present | $3.8 \times 10^{05}$ | $9.0 \times 10^{07}$ | 0.82 |
| 26 | 11 | 14 | 43 | 57 | Sulfur | 0.41 | TT + CZ | 2.89 | Present | $3.3 \times 10^{06}$ | $7.0 \times 10^{10}$ | 1.12 |
| 27 | 12 | — | 100 | 0 | Sulfur | 3 | TBZTD | 1 | Absent | — | — | — |
| 28 | 13 | — | 100 | 0 | Sulfur | 3 | TBZTD | 1 | Absent | — | — | — |
| 29 | 14 | 15 | 75 | 25 | Sulfur | 3 | TT | 3 | Present | $2.6 \times 10^{15}$ | $9.2 \times 10^{02}$ | 2.20 |
| 30 | 1 | 1 | 60 | 40 | Sulfur | 3 | TT | 3 | Absent | — | — | — |
| 31 | 1 | 16 | 25 | 75 | Sulfur | 3 | TT | 3 | Present | $2.6 \times 10^{01}$ | $1.9 \times 10^{07}$ | 0.21 |
| 32 | — | — | — | — | — | — | — | — | Present | $6.2 \times 10^{01}$ | $8.7 \times 10^{15}$ | 0.21 |

TABLE 7

| Abbreviated name of material | Material name | Product name | Manufacturer name |
|---|---|---|---|
| Sulfur | Sulfur | SULFAXPMC | Tsurumi chemical industry Co., Ltd. |
| 25B-40 | 2,5-Dimethyl-2,5-di(t-butylperoxy)hexyne | Perhexa 25B-40 | NOF Corporation |
| TT | Tetramethylthiuram disulfide | Nocceler TT-P | Ouchi Shinko Chemical Industry Co., Ltd. |
| nTET | Tetramethylthiuram disulfide | Nocceler TET-G | Ouchi Shinko Chemical Industry Co., Ltd. |
| TBZTD | Tetrabenzylthiuram disulfide | Sanceler TBZTD | Sanshin Chemical Industry Co., Ltd. |
| sTET | Tetraethylthiuram disulfide | Sanceler TET-G | Sanshin Chemical Industry Co., Ltd. |
| TAIC | Triallyl isocyanurate | TAIC-M60 | Nihon Kasei Co., Ltd. |
| CZ | N-cyclohexyl-2-benzothiazolylsulfenamide | Nocceler CZ | Ouchi Shinko Chemical Industry Co., Ltd. |

Example 1

The above photosensitive member 1 and the above charging roller 1 were mounted in a process cartridge of a laser beam printer (trade name: Color Laser Jet CP3525dn) manufactured by Hewlett-Packard Company.

At this time, values relating to the effect of the present disclosure are shown in Table 8, which are $E^{*0.5}$, a measured value of $a_2$, and a calculated value of $a_2/a_1$ of the photosensitive member 1; measured values of $\rho_M$ and $D_m$, and the calculated value of $\rho_M/\rho_D$ of the charging roller 1; and a calculated value of $D_m \times a_1/a_2$ at the time when the photosensitive member 1 and the charging roller 1 have been combined.

Examples 2 to 128, Comparative Examples 1 to 28

Process cartridges of Examples 2 to 128 and Comparative Examples 1 to 28 were prepared in the same manner as in Example 1, except that the photosensitive member 1 and the charging roller 1 were changed as shown in Table 8 to Table 11 in Example 1.

In addition, values are shown in Table 8 to Table 11 in the same manner as in Example 1, which are $E^{*0.5}$, a measured value of $a_2$, and a calculated value of $a_2/a_1$ of each of the photosensitive members; measured values of pm and $D_m$, and the calculated value of $\rho_M/\rho_D$ of each of the charging rollers; and a calculated value of $D_m \times a_1/a_2$ at the time when each of the photosensitive members and each of the charging rollers have been combined.

TABLE 8

| Example | Photosensitive Member Production Example No. | $E^{*0.5}$/ $(V/m)^{0.5}$ | $a_2 \times 10^{-4}$ | $a_2/a_1$ | Charging Roller Production Example No. | $\rho_M$/ Ω · cm | $\rho_M/\rho_D$ | $D_m$/ μm | $D_m \times a_1/a_2$/ μm |
|---|---|---|---|---|---|---|---|---|---|
| 1 | 1 | 5793 | 8.21 | 3.01 | 1 | $7.1 \times 10^{16}$ | $2.8 \times 10^{15}$ | 0.21 | 0.07 |
| 2 | 1 | 5793 | 8.21 | 3.01 | 2 | $5.2 \times 10^{16}$ | $4.5 \times 10^{15}$ | 0.25 | 0.08 |
| 3 | 1 | 5793 | 8.21 | 3.01 | 3 | $3.0 \times 10^{16}$ | $1.1 \times 10^{15}$ | 0.45 | 0.15 |
| 4 | 1 | 5793 | 8.21 | 3.01 | 4 | $8.2 \times 10^{16}$ | $9.4 \times 10^{14}$ | 0.85 | 0.28 |
| 5 | 1 | 5793 | 8.21 | 3.01 | 5 | $6.6 \times 10^{16}$ | $8.7 \times 10^{15}$ | 1.15 | 0.38 |
| 6 | 1 | 5793 | 8.21 | 3.01 | 6 | $9.6 \times 10^{15}$ | $2.2 \times 10^{14}$ | 0.23 | 0.08 |
| 7 | 1 | 5793 | 8.21 | 3.01 | 7 | $1.5 \times 10^{14}$ | $5.7 \times 10^{12}$ | 0.24 | 0.08 |
| 8 | 1 | 5793 | 8.21 | 3.01 | 8 | $4.7 \times 10^{13}$ | $6.1 \times 10^{11}$ | 0.22 | 0.07 |
| 9 | 1 | 5793 | 8.21 | 3.01 | 9 | $9.0 \times 10^{12}$ | $1.3 \times 10^{11}$ | 0.21 | 0.07 |
| 10 | 1 | 5793 | 8.21 | 3.01 | 10 | $8.4 \times 10^{14}$ | $6.6 \times 10^{13}$ | 0.23 | 0.08 |
| 11 | 1 | 5793 | 8.21 | 3.01 | 11 | $6.4 \times 10^{15}$ | $1.3 \times 10^{15}$ | 1.92 | 0.64 |
| 12 | 1 | 5793 | 8.21 | 3.01 | 12 | $9.9 \times 10^{15}$ | $1.7 \times 10^{14}$ | 0.23 | 0.08 |
| 13 | 1 | 5793 | 8.21 | 3.01 | 13 | $5.9 \times 10^{12}$ | $8.5 \times 10^{10}$ | 0.26 | 0.09 |
| 14 | 1 | 5793 | 8.21 | 3.01 | 14 | $3.0 \times 10^{15}$ | $2.9 \times 10^{14}$ | 2.9 | 0.96 |
| 15 | 1 | 5793 | 8.21 | 3.01 | 15 | $2.6 \times 10^{12}$ | $3.9 \times 10^{8}$ | 3.2 | 1.06 |
| 16 | 1 | 5793 | 8.21 | 3.01 | 16 | $6.3 \times 10^{15}$ | $1.1 \times 10^{14}$ | 5.6 | 1.86 |
| 17 | 1 | 5793 | 8.21 | 3.01 | 17 | $1.4 \times 10^{7}$ | $1.2 \times 10^{6}$ | 0.56 | 0.19 |
| 18 | 1 | 5793 | 8.21 | 3.01 | 18 | $1.9 \times 10^{7}$ | $7.3 \times 10^{5}$ | 0.21 | 0.07 |
| 19 | 1 | 5793 | 8.21 | 3.01 | 19 | $2.6 \times 10^{9}$ | $5.0 \times 10^{7}$ | 0.23 | 0.08 |
| 20 | 1 | 5793 | 8.21 | 3.01 | 32 | $8.7 \times 10^{15}$ | $1.4 \times 10^{14}$ | 0.21 | 0.07 |
| 21 | 1 | 5793 | 8.21 | 3.01 | 20 | $8.3 \times 10^{1}$ | $9.3 \times 10^{15}$ | 18 | 5.98 |
| 22 | 1 | 5793 | 8.21 | 3.01 | 21 | $8.3 \times 10^{1}$ | $9.3 \times 10^{15}$ | 25 | 8.31 |
| 23 | 1 | 5793 | 8.21 | 3.01 | 22 | $8.1 \times 10^{1}$ | $9.3 \times 10^{15}$ | 45 | 14.95 |
| 24 | 2 | 5794 | 10.1 | 3.45 | 1 | $7.1 \times 10^{16}$ | $2.8 \times 10^{15}$ | 0.21 | 0.06 |
| 25 | 2 | 5794 | 10.1 | 3.45 | 6 | $9.6 \times 10^{15}$ | $2.2 \times 10^{14}$ | 0.23 | 0.07 |
| 26 | 2 | 5794 | 10.1 | 3.45 | 17 | $1.4 \times 10^{7}$ | $1.2 \times 10^{6}$ | 0.56 | 0.16 |
| 27 | 3 | 3735 | 8.22 | 2.28 | 1 | $7.1 \times 10^{16}$ | $2.8 \times 10^{15}$ | 0.21 | 0.09 |
| 28 | 3 | 3735 | 8.22 | 2.28 | 3 | $3.0 \times 10^{16}$ | $1.1 \times 10^{15}$ | 0.45 | 0.20 |
| 29 | 3 | 3735 | 8.22 | 2.28 | 5 | $6.6 \times 10^{16}$ | $8.7 \times 10^{15}$ | 1.15 | 0.50 |
| 30 | 3 | 3735 | 8.22 | 2.28 | 6 | $9.6 \times 10^{15}$ | $2.2 \times 10^{14}$ | 0.23 | 0.10 |
| 31 | 3 | 3735 | 8.22 | 2.28 | 7 | $1.5 \times 10^{14}$ | $5.7 \times 10^{12}$ | 0.24 | 0.11 |
| 32 | 3 | 3735 | 8.22 | 2.28 | 17 | $1.4 \times 10^{7}$ | $1.2 \times 10^{6}$ | 0.56 | 0.25 |
| 33 | 3 | 3735 | 8.22 | 2.28 | 19 | $2.6 \times 10^{9}$ | $5.0 \times 10^{7}$ | 0.23 | 0.10 |
| 34 | 3 | 3735 | 8.22 | 2.28 | 32 | $8.7 \times 10^{15}$ | $1.4 \times 10^{14}$ | 0.21 | 0.09 |
| 35 | 3 | 3735 | 8.22 | 2.28 | 20 | $8.3 \times 10^{1}$ | $9.3 \times 10^{15}$ | 18 | 7.89 |
| 36 | 3 | 3735 | 8.22 | 2.28 | 21 | $8.3 \times 10^{1}$ | $9.3 \times 10^{15}$ | 25 | 10.96 |
| 37 | 3 | 3735 | 8.22 | 2.28 | 22 | $8.1 \times 10^{1}$ | $9.3 \times 10^{15}$ | 45 | 19.74 |
| 38 | 4 | 4091 | 8.32 | 2.68 | 1 | $7.1 \times 10^{16}$ | $2.8 \times 10^{15}$ | 0.21 | 0.08 |
| 39 | 4 | 4091 | 8.32 | 2.68 | 7 | $1.5 \times 10^{14}$ | $5.7 \times 10^{12}$ | 0.24 | 0.09 |
| 40 | 4 | 4091 | 8.32 | 2.68 | 19 | $2.6 \times 10^{9}$ | $5.0 \times 10^{7}$ | 0.23 | 0.09 |
| 41 | 5 | 6443 | 8.88 | 2.77 | 1 | $7.1 \times 10^{16}$ | $2.8 \times 10^{15}$ | 0.21 | 0.08 |
| 42 | 5 | 6443 | 8.88 | 2.77 | 8 | $4.7 \times 10^{13}$ | $6.1 \times 10^{11}$ | 0.22 | 0.08 |
| 43 | 5 | 6443 | 8.88 | 2.77 | 18 | $1.9 \times 10^{7}$ | $7.3 \times 10^{5}$ | 0.21 | 0.08 |

TABLE 9

| Example | Photosensitive Member Production Example No. | $E^{*0.5}$/ $(V/m)^{0.5}$ | $a_2 \times 10^{-4}$ | $a_2/a_1$ | Charging Roller Production Example No. | $\rho_M$/ Ω · cm | $\rho_M/\rho_D$ | $D_m$/ μm | $D_m \times a_1/a_2$/ μm |
|---|---|---|---|---|---|---|---|---|---|
| 44 | 6 | 4942 | 8.27 | 2.83 | 1 | $7.1 \times 10^{16}$ | $2.8 \times 10^{15}$ | 0.21 | 0.07 |
| 45 | 6 | 4942 | 8.27 | 2.83 | 2 | $5.2 \times 10^{16}$ | $4.5 \times 10^{15}$ | 0.25 | 0.09 |
| 46 | 6 | 4942 | 8.27 | 2.83 | 4 | $8.2 \times 10^{16}$ | $9.4 \times 10^{14}$ | 0.85 | 0.30 |
| 47 | 6 | 4942 | 8.27 | 2.83 | 8 | $4.7 \times 10^{13}$ | $6.1 \times 10^{11}$ | 0.22 | 0.08 |
| 48 | 6 | 4942 | 8.27 | 2.83 | 10 | $8.4 \times 10^{14}$ | $6.6 \times 10^{13}$ | 0.23 | 0.08 |
| 49 | 6 | 4942 | 8.27 | 2.83 | 18 | $1.9 \times 10^{7}$ | $7.3 \times 10^{5}$ | 0.21 | 0.07 |
| 50 | 6 | 4942 | 8.27 | 2.83 | 32 | $8.7 \times 10^{15}$ | $1.4 \times 10^{14}$ | 0.21 | 0.07 |
| 51 | 6 | 4942 | 8.27 | 2.83 | 20 | $8.3 \times 10^{1}$ | $9.3 \times 10^{15}$ | 18 | 6.36 |
| 52 | 6 | 4942 | 8.27 | 2.83 | 21 | $8.3 \times 10^{1}$ | $9.3 \times 10^{15}$ | 25 | 8.83 |
| 53 | 6 | 4942 | 8.27 | 2.83 | 22 | $8.1 \times 10^{1}$ | $9.3 \times 10^{15}$ | 45 | 15.90 |

TABLE 9-continued

| Example | Photosensitive Member Production Example No. | $E^{*0.5}/(V/m)^{0.5}$ | $a_2 \times 10^{-4}$ | $a_2/a_1$ | Charging Roller Production Example No. | $\rho_M/\Omega \cdot cm$ | $\rho_M/\rho_D$ | $D_m/\mu m$ | $D_m \times a_1/a_2/\mu m$ |
|---|---|---|---|---|---|---|---|---|---|
| 54 | 7 | 5454 | 6.95 | 2.16 | 1 | $7.1 \times 10^{16}$ | $2.8 \times 10^{15}$ | 0.21 | 0.10 |
| 55 | 7 | 5454 | 6.95 | 2.16 | 9 | $9.0 \times 10^{12}$ | $1.3 \times 10^{11}$ | 0.21 | 0.10 |
| 56 | 7 | 5454 | 6.95 | 2.16 | 34 | $8.7 \times 10^{15}$ | $1.4 \times 10^{14}$ | 0.21 | 0.10 |
| 57 | 8 | 8855 | 6.29 | 1.67 | 1 | $7.1 \times 10^{16}$ | $2.8 \times 10^{15}$ | 0.21 | 0.13 |
| 58 | 8 | 8855 | 6.29 | 1.67 | 10 | $8.4 \times 10^{14}$ | $6.6 \times 10^{13}$ | 0.23 | 0.14 |
| 59 | 9 | 8533 | 5.95 | 1.57 | 1 | $7.1 \times 10^{16}$ | $2.8 \times 10^{15}$ | 0.21 | 0.13 |
| 60 | 9 | 8533 | 5.95 | 1.57 | 11 | $6.4 \times 10^{15}$ | $1.3 \times 10^{15}$ | 1.92 | 1.22 |
| 61 | 10 | 8014 | 5.98 | 1.81 | 1 | $7.1 \times 10^{16}$ | $2.8 \times 10^{15}$ | 0.21 | 0.12 |
| 62 | 10 | 8014 | 5.98 | 1.81 | 3 | $3.0 \times 10^{16}$ | $1.1 \times 10^{15}$ | 0.45 | 0.25 |
| 63 | 10 | 8014 | 5.98 | 1.81 | 4 | $8.2 \times 10^{16}$ | $9.4 \times 10^{14}$ | 0.85 | 0.47 |
| 64 | 10 | 8014 | 5.98 | 1.81 | 9 | $9.0 \times 10^{12}$ | $1.3 \times 10^{11}$ | 0.21 | 0.12 |
| 65 | 10 | 8014 | 5.98 | 1.81 | 11 | $6.4 \times 10^{15}$ | $1.3 \times 10^{15}$ | 1.92 | 1.06 |
| 66 | 10 | 8014 | 5.98 | 1.81 | 16 | $6.3 \times 10^{15}$ | $1.1 \times 10^{14}$ | 5.6 | 3.09 |
| 67 | 10 | 8014 | 5.98 | 1.81 | 17 | $1.4 \times 10^{7}$ | $1.2 \times 10^{6}$ | 0.56 | 0.31 |
| 68 | 10 | 8014 | 5.98 | 1.81 | 32 | $8.7 \times 10^{15}$ | $1.4 \times 10^{14}$ | 0.21 | 0.12 |
| 69 | 10 | 8014 | 5.98 | 1.81 | 20 | $8.3 \times 10^{1}$ | $9.3 \times 10^{15}$ | 18 | 9.94 |
| 70 | 10 | 8014 | 5.98 | 1.81 | 21 | $8.3 \times 10^{1}$ | $9.3 \times 10^{15}$ | 25 | 13.81 |
| 71 | 10 | 8014 | 5.98 | 1.81 | 22 | $8.1 \times 10^{1}$ | $9.3 \times 10^{15}$ | 45 | 24.86 |
| 72 | 11 | 6904 | 8.04 | 2.58 | 1 | $7.1 \times 10^{16}$ | $2.8 \times 10^{15}$ | 0.21 | 0.08 |
| 73 | 11 | 6904 | 8.04 | 2.58 | 12 | $9.9 \times 10^{15}$ | $1.7 \times 10^{14}$ | 0.23 | 0.09 |
| 74 | 11 | 6904 | 8.04 | 2.58 | 13 | $5.9 \times 10^{12}$ | $8.5 \times 10^{10}$ | 0.26 | 0.10 |
| 75 | 12 | 7229 | 7.43 | 2.28 | 1 | $7.1 \times 10^{16}$ | $2.8 \times 10^{15}$ | 0.21 | 0.09 |
| 76 | 12 | 7229 | 7.43 | 2.28 | 3 | $3.0 \times 10^{16}$ | $1.1 \times 10^{15}$ | 0.45 | 0.20 |
| 77 | 12 | 7229 | 7.43 | 2.28 | 5 | $6.6 \times 10^{16}$ | $8.7 \times 10^{15}$ | 1.15 | 0.50 |
| 78 | 12 | 7229 | 7.43 | 2.28 | 12 | $9.9 \times 10^{15}$ | $1.7 \times 10^{14}$ | 0.23 | 0.10 |
| 79 | 12 | 7229 | 7.43 | 2.28 | 13 | $5.9 \times 10^{12}$ | $8.5 \times 10^{10}$ | 0.26 | 0.11 |
| 80 | 12 | 7229 | 7.43 | 2.28 | 32 | $8.7 \times 10^{15}$ | $1.4 \times 10^{14}$ | 0.21 | 0.09 |
| 81 | 12 | 7229 | 7.43 | 2.28 | 20 | $8.3 \times 10^{1}$ | $9.3 \times 10^{15}$ | 18 | 7.89 |
| 82 | 12 | 7229 | 7.43 | 2.28 | 21 | $8.3 \times 10^{1}$ | $9.3 \times 10^{15}$ | 25 | 10.96 |
| 83 | 12 | 7229 | 7.43 | 2.28 | 22 | $8.1 \times 10^{1}$ | $9.3 \times 10^{15}$ | 45 | 19.74 |

TABLE 10

| Example | Photosensitive Member Production Example No. | $E^{*0.5}/(V/m)^{0.5}$ | $a_2 \times 10^{-4}$ | $a_2/a_1$ | Charging Roller Production Example No. | $\rho_M/\Omega \cdot cm$ | $\rho_M/\rho_D$ | $D_m/\mu m$ | $D_m \times a_1/a_2/\mu m$ |
|---|---|---|---|---|---|---|---|---|---|
| 84 | 13 | 6478 | 7.13 | 2.29 | 1 | $7.1 \times 10^{16}$ | $2.8 \times 10^{15}$ | 0.21 | 0.09 |
| 85 | 13 | 6478 | 7.13 | 2.29 | 2 | $5.2 \times 10^{16}$ | $4.5 \times 10^{15}$ | 0.25 | 0.11 |
| 86 | 13 | 6478 | 7.13 | 2.29 | 4 | $8.2 \times 10^{16}$ | $9.4 \times 10^{14}$ | 0.85 | 0.37 |
| 87 | 13 | 6478 | 7.13 | 2.29 | 14 | $3.0 \times 10^{15}$ | $2.9 \times 10^{14}$ | 2.9 | 1.27 |
| 88 | 13 | 6478 | 7.13 | 2.29 | 17 | $1.4 \times 10^{7}$ | $1.2 \times 10^{6}$ | 0.56 | 0.24 |
| 89 | 13 | 6478 | 7.13 | 2.29 | 32 | $8.7 \times 10^{15}$ | $1.4 \times 10^{14}$ | 0.21 | 0.09 |
| 90 | 13 | 6478 | 7.13 | 2.29 | 20 | $8.3 \times 10^{1}$ | $9.3 \times 10^{15}$ | 18 | 7.86 |
| 91 | 13 | 6478 | 7.13 | 2.29 | 21 | $8.3 \times 10^{1}$ | $9.3 \times 10^{15}$ | 25 | 10.92 |
| 92 | 13 | 6478 | 7.13 | 2.29 | 22 | $8.1 \times 10^{1}$ | $9.3 \times 10^{15}$ | 45 | 19.65 |
| 93 | 14 | 6717 | 6.01 | 1.99 | 1 | $7.1 \times 10^{16}$ | $2.8 \times 10^{15}$ | 0.21 | 0.11 |
| 94 | 14 | 6717 | 6.01 | 1.99 | 14 | $3.0 \times 10^{15}$ | $2.9 \times 10^{14}$ | 2.9 | 1.46 |
| 95 | 14 | 6717 | 6.01 | 1.99 | 17 | $1.4 \times 10^{7}$ | $1.2 \times 10^{6}$ | 0.56 | 0.28 |
| 96 | 14 | 6717 | 6.01 | 1.99 | 34 | $8.7 \times 10^{15}$ | $1.4 \times 10^{14}$ | 0.21 | 0.11 |
| 97 | 15 | 7173 | 5.67 | 2.00 | 1 | $7.1 \times 10^{16}$ | $2.8 \times 10^{15}$ | 0.21 | 0.11 |
| 98 | 15 | 7173 | 5.67 | 2.00 | 5 | $6.6 \times 10^{16}$ | $8.7 \times 10^{15}$ | 1.15 | 0.58 |
| 99 | 15 | 7173 | 5.67 | 2.00 | 6 | $9.6 \times 10^{15}$ | $2.2 \times 10^{14}$ | 0.23 | 0.12 |
| 100 | 15 | 7173 | 5.67 | 2.00 | 15 | $2.6 \times 10^{12}$ | $3.9 \times 10^{8}$ | 3.2 | 1.60 |
| 101 | 15 | 7173 | 5.67 | 2.00 | 18 | $1.9 \times 10^{7}$ | $7.3 \times 10^{5}$ | 0.21 | 0.11 |
| 102 | 15 | 7173 | 5.67 | 2.00 | 32 | $8.7 \times 10^{15}$ | $1.4 \times 10^{14}$ | 0.21 | 0.11 |
| 103 | 15 | 7173 | 5.67 | 2.00 | 20 | $8.3 \times 10^{1}$ | $9.3 \times 10^{15}$ | 18 | 9.00 |
| 104 | 15 | 7173 | 5.67 | 2.00 | 21 | $8.3 \times 10^{1}$ | $9.3 \times 10^{15}$ | 25 | 12.50 |
| 105 | 15 | 7173 | 5.67 | 2.00 | 22 | $8.1 \times 10^{1}$ | $9.3 \times 10^{15}$ | 45 | 22.50 |
| 106 | 16 | 6261 | 5.84 | 2.17 | 1 | $7.1 \times 10^{16}$ | $2.8 \times 10^{15}$ | 0.21 | 0.10 |
| 107 | 16 | 6261 | 5.84 | 2.17 | 15 | $2.6 \times 10^{12}$ | $3.9 \times 10^{8}$ | 3.2 | 1.47 |
| 108 | 16 | 6261 | 5.84 | 2.17 | 19 | $2.6 \times 10^{9}$ | $5.0 \times 10^{7}$ | 0.23 | 0.11 |
| 109 | 17 | 6099 | 8.63 | 2.67 | 1 | $7.1 \times 10^{16}$ | $2.8 \times 10^{15}$ | 0.21 | 0.08 |
| 110 | 17 | 6099 | 8.63 | 2.67 | 3 | $3.0 \times 10^{16}$ | $1.1 \times 10^{15}$ | 0.45 | 0.17 |
| 111 | 17 | 6099 | 8.63 | 2.67 | 5 | $6.6 \times 10^{16}$ | $8.7 \times 10^{15}$ | 1.15 | 0.43 |
| 112 | 17 | 6099 | 8.63 | 2.67 | 10 | $8.4 \times 10^{14}$ | $6.6 \times 10^{13}$ | 0.23 | 0.09 |
| 113 | 17 | 6099 | 8.63 | 2.67 | 18 | $1.9 \times 10^{7}$ | $7.3 \times 10^{5}$ | 0.21 | 0.08 |
| 114 | 17 | 6099 | 8.63 | 2.67 | 32 | $8.7 \times 10^{15}$ | $1.4 \times 10^{14}$ | 0.21 | 0.08 |
| 115 | 18 | 5826 | 7.21 | 2.69 | 1 | $7.1 \times 10^{16}$ | $2.8 \times 10^{15}$ | 0.21 | 0.08 |

TABLE 10-continued

| Example | Photosensitive Member Production Example No. | $E^{*0.5}/(V/m)^{0.5}$ | $a_2 \times 10^{-4}$ | $a_2/a_1$ | Charging Roller Production Example No. | $\rho_M/\Omega \cdot cm$ | $\rho_M/\rho_D$ | $D_m/\mu m$ | $D_m \times a_1/a_2/\mu m$ |
|---|---|---|---|---|---|---|---|---|---|
| 116 | 19 | 5621 | 5.25 | 1.66 | 1 | $7.1 \times 10^{16}$ | $2.8 \times 10^{15}$ | 0.21 | 0.13 |
| 117 | 19 | 5621 | 5.25 | 1.66 | 3 | $3.0 \times 10^{16}$ | $1.1 \times 10^{15}$ | 0.45 | 0.27 |
| 118 | 19 | 5621 | 5.25 | 1.66 | 5 | $6.6 \times 10^{16}$ | $8.7 \times 10^{15}$ | 1.15 | 0.69 |
| 119 | 19 | 5621 | 5.25 | 1.66 | 10 | $8.4 \times 10^{14}$ | $6.6 \times 10^{13}$ | 0.23 | 0.14 |
| 120 | 19 | 5621 | 5.25 | 1.66 | 18 | $1.9 \times 10^{7}$ | $7.3 \times 10^{5}$ | 0.21 | 0.13 |
| 121 | 19 | 5621 | 5.25 | 1.66 | 32 | $8.7 \times 10^{15}$ | $1.4 \times 10^{14}$ | 0.21 | 0.13 |
| 122 | 20 | 5771 | 5.39 | 1.79 | 1 | $7.1 \times 10^{16}$ | $2.8 \times 10^{15}$ | 0.21 | 0.12 |
| 123 | 21 | 6810 | 7.49 | 2.10 | 1 | $7.1 \times 10^{16}$ | $2.8 \times 10^{15}$ | 0.21 | 0.10 |
| 124 | 22 | 6533 | 6.24 | 2.09 | 1 | $7.1 \times 10^{16}$ | $2.8 \times 10^{15}$ | 0.21 | 0.10 |
| 125 | 23 | 6187 | 4.91 | 1.54 | 1 | $7.1 \times 10^{16}$ | $2.8 \times 10^{15}$ | 0.21 | 0.14 |
| 126 | 24 | 6493 | 4.89 | 1.52 | 1 | $7.1 \times 10^{16}$ | $2.8 \times 10^{15}$ | 0.21 | 0.14 |
| 127 | 25 | 8788 | 6.61 | 1.61 | 1 | $7.1 \times 10^{16}$ | $2.8 \times 10^{15}$ | 0.21 | 0.13 |
| 128 | 26 | 8605 | 5.52 | 1.57 | 1 | $7.1 \times 10^{6}$ | $2.8 \times 10^{15}$ | 0.21 | 0.13 |

TABLE 11

| Comparative Example | Photosensitive Member Production Example No. | $E^{*0.5}/(V/m)^{0.5}$ | $a_2 \times 10^{-4}$ | $a_2/a_1$ | Charging Roller Production Example No. | $\rho_M/\Omega \cdot cm$ | $\rho_M/\rho_D$ | $D_m/\mu m$ | $D_m \times a_1/a_2/\mu m$ |
|---|---|---|---|---|---|---|---|---|---|
| 1 | 27 | 8924 | 5.59 | 1.45 | 23 | $3.0 \times 10^{8}$ | $1.0 \times 10^{3}$ | 0.85 | 0.59 |
| 2 | 27 | 8924 | 5.59 | 1.45 | 24 | $9.0 \times 10^{7}$ | $6.5 \times 10^{2}$ | 0.80 | 0.55 |
| 3 | 27 | 8924 | 5.59 | 1.45 | 25 | $9.0 \times 10^{7}$ | $2.4 \times 10^{2}$ | 0.82 | 0.57 |
| 4 | 27 | 8924 | 5.59 | 1.45 | 26 | $7.0 \times 10^{10}$ | $2.1 \times 10^{4}$ | 1.12 | 0.77 |
| 5 | 27 | 8924 | 5.59 | 1.45 | 27 | — | — | — | — |
| 6 | 27 | 8924 | 5.59 | 1.45 | 28 | — | — | — | — |
| 7 | 27 | 8924 | 5.59 | 1.45 | 29 | $9.2 \times 10^{2}$ | $3.6 \times 10^{-13}$ | 2.20 | 1.52 |
| 8 | 27 | 8924 | 5.59 | 1.45 | 30 | — | — | — | — |
| 9 | 27 | 8924 | 5.59 | 1.45 | 31 | $1.9 \times 10^{7}$ | $7.3 \times 10^{5}$ | 0.21 | 0.15 |
| 10 | 28 | 8432 | 3.09 | 0.76 | 26 | $7.0 \times 10^{10}$ | $2.1 \times 10^{4}$ | 1.12 | 1.48 |
| 11 | 28 | 8432 | 3.09 | 0.76 | 27 | — | — | — | — |
| 12 | 28 | 8432 | 3.09 | 0.76 | 31 | $1.9 \times 10^{7}$ | $7.3 \times 10^{5}$ | 0.21 | 0.28 |
| 13 | 29 | 8848 | 3.92 | 1.43 | 26 | $7.0 \times 10^{10}$ | $2.1 \times 10^{4}$ | 1.12 | 0.79 |
| 14 | 29 | 8848 | 3.92 | 1.43 | 27 | — | — | — | — |
| 15 | 29 | 8848 | 3.92 | 1.43 | 31 | $1.9 \times 10^{7}$ | $7.3 \times 10^{5}$ | 0.21 | 0.15 |
| 16 | 1 | 5793 | 8.21 | 3.01 | 23 | $3.0 \times 10^{8}$ | $1.0 \times 10^{3}$ | 0.85 | 0.28 |
| 17 | 1 | 5793 | 8.21 | 3.01 | 26 | $7.0 \times 10^{10}$ | $2.1 \times 10^{4}$ | 1.12 | 0.37 |
| 18 | 1 | 5793 | 8.21 | 3.01 | 27 | — | — | — | — |
| 19 | 1 | 5793 | 8.21 | 3.01 | 28 | — | — | — | — |
| 20 | 1 | 5793 | 8.21 | 3.01 | 29 | $9.2 \times 10^{2}$ | $3.6 \times 10^{-13}$ | 2.20 | 0.73 |
| 21 | 2 | 5794 | 10.10 | 3.45 | 23 | $3.0 \times 10^{8}$ | $1.0 \times 10^{3}$ | 0.85 | 0.25 |
| 22 | 3 | 3735 | 8.22 | 2.28 | 23 | $3.0 \times 10^{8}$ | $1.0 \times 10^{3}$ | 0.85 | 0.37 |
| 23 | 5 | 6443 | 8.88 | 2.77 | 23 | $3.0 \times 10^{8}$ | $1.0 \times 10^{3}$ | 0.85 | 0.31 |
| 24 | 8 | 8855 | 6.29 | 1.67 | 23 | $3.0 \times 10^{8}$ | $1.0 \times 10^{3}$ | 0.85 | 0.51 |
| 25 | 10 | 8014 | 5.98 | 1.81 | 23 | $3.0 \times 10^{8}$ | $1.0 \times 10^{3}$ | 0.85 | 0.47 |
| 26 | 12 | 7229 | 7.43 | 2.28 | 23 | $3.0 \times 10^{8}$ | $1.0 \times 10^{3}$ | 0.85 | 0.37 |
| 27 | 15 | 7173 | 5.67 | 2.00 | 23 | $3.0 \times 10^{8}$ | $1.0 \times 10^{3}$ | 0.85 | 0.42 |
| 28 | 17 | 6099 | 8.63 | 2.67 | 23 | $3.0 \times 10^{8}$ | $1.0 \times 10^{3}$ | 0.85 | 0.32 |

[Evaluation]

Each of the process cartridges of the above Examples and Comparative Examples was evaluated in the following way. The results are shown in Tables 12 to 15.

<Evaluation Apparatus>

A laser beam printer (trade name: Color Laser Jet Enterprise M653dn) manufactured by Hewlett-Packard company was prepared as an electrophotographic apparatus for the evaluation, and was modified so that the voltage to be applied to the charging roller, and a pre-exposure amount and an image exposure amount to the photosensitive member can be adjusted and measured.

In addition, each process cartridge of the Examples and the Comparative Examples was mounted on a station of the process cartridge for a cyan color, and was adjusted so as to be capable of being operated even though process cartridges for other colors (magenta, yellow and black) were not mounted on the main body of the laser beam printer.

When the image was output, only the process cartridge for the cyan color was mounted on the main body of the laser beam printer, and a monochromatic image by only a cyan toner was output.

<Image Deletion>

(Endurance Test Under Environment of High Temperature and High Humidity: H/H)

Firstly, the process cartridges of Examples and Comparative Examples and the electrophotographic apparatus were left for 24 hours or longer under an environment of high temperature and high humidity (H/H: temperature of 30° C. and humidity of 80% RH), and then the process cartridges were each mounted on the station of the process cartridge for a cyan color of the electrophotographic apparatus.

The voltage to be applied to the charging roller and the image exposure amount to the photosensitive member were set so that the dark portion potential became −800 V and the light portion potential became −150 V. The pre-exposure amount was set so as to become 3 times the image exposure amount. A device having a potential probe (trade name: Model 6000B-8, manufactured by Trek Japan) mounted at a development position of the process cartridge was used for measurement of the surface potential of the photosensitive member when the electric potential was set, and the surface potential was measured with the use of a surface potential meter (trade name: Model 344, manufactured by Trek Japan).

Next, 100000 sheets of a square lattice image having a line width of 0.1 mm and a line spacing of 10 mm were continuously output in a single color of cyan on A4-size plain paper. After the images were output, the main power source of the electrophotographic apparatus was turned off, and the electrophotographic apparatus was left under an environment of a temperature of 30° C. and a humidity of 80% RH, for three days. Immediately after the electrophotographic apparatus has been left, the main power supply thereof was turned on, and each one sheet of evaluation images of the following 4 types of line and space (where the orientation of the lines was a direction of a genetrix of the photosensitive member) was output by a single color of cyan, on A4-size plain paper.

Image 1L: 1 line and 20 spaces (line width 42 μm, and line spacing 847 μm)

Image 2L: 2 lines and 20 spaces (line width of 85 μm, and line spacing of 847 μm)

Image 4L: 4 lines and 20 spaces (line width of 170 μm, and line spacing of 847 μm)

Image 8L: 8 lines and 20 spaces (line width of 339 μm, and line spacing of 847 μm)

The image deletion of each of the 4 types of output images was visually observed, and the image deletion was evaluated based on the following criteria.

Rank A: abnormalities are not found in the line.

Rank B: the line is broken.

Rank C: the line has disappeared.

(Endurance test under environment of normal temperature and normal humidity: N/N)

The endurance test was performed under an environment of normal temperature and normal humidity: N/N, in the same manner as in (endurance test under environment of high temperature and high humidity: H/H), except that in the above (endurance test under environment of high temperature and high humidity: H/H), the environment of high temperature and high humidity (H/H: temperature of 30° C. and humidity of 80% RH) was changed to the environment of normal temperature and normal humidity (N/N: temperature of 23° C. and humidity of 50% RH), and that after 100000 sheets were continuously output, the apparatus was not left for 3 days, but evaluation images were immediately output. The evaluation image of the line and space and the evaluation criteria of the image deletion are also the same as those in the above (endurance test under environment of high temperature and high humidity: H/H).

<Potential Fluctuation>

A sheet feeding endurance test was performed by output of 10000 sheets of the image, while the printing was operated in an intermittent mode in which a character image with a printing ratio of 2% was output on A4-size plain paper one sheet by one sheet, with the use of the same voltage to be applied to the charging roller and the same pre-exposure amount and image exposure amount to the photosensitive member as in the above (endurance test under environment of high temperature and high humidity: H/H).

Subsequently, immediately after the sheet feeding endurance test of 10000 sheets, the dark portion potential and the light portion potential were measured with the use of the above voltage to be applied, pre-exposure amount and image exposure amount. $\Delta V_d = V_d + 800$ and $\Delta V_1 = V_1 + 150$ at the time when the measured dark portion potential and light portion potential were represented by $V_d$ [V] and V1 [V], respectively, were determined as the amount of potential fluctuation before and after the sheet feeding endurance test of 10000 sheets.

TABLE 12

| | Endurance image deletion test | | | | | | | | | |
|---|---|---|---|---|---|---|---|---|---|---|
| | Under environment of high temperature and high humidity: H/H | | | | Under environment of normal temperature and normal humidity: N/N | | | | Fluctuation of electric potential | |
| Example | 1 L | 2 L | 4 L | 8 L | 1 L | 2 L | 4 L | 8 L | $\Delta V_d$/V | $\Delta V_l$/V |
| 1 | A | A | A | A | A | A | A | A | 15 | 23 |
| 2 | A | A | A | A | A | A | A | A | 16 | 23 |
| 3 | A | A | A | A | A | A | A | A | 15 | 22 |
| 4 | A | A | A | A | A | A | A | A | 17 | 22 |
| 5 | A | A | A | A | A | A | A | A | 18 | 24 |
| 6 | B | A | A | A | A | A | A | A | 15 | 22 |
| 7 | B | A | A | A | A | A | A | A | 16 | 22 |
| 8 | B | B | A | A | B | A | A | A | 17 | 23 |
| 9 | B | B | A | A | B | A | A | A | 18 | 23 |
| 10 | B | A | A | A | A | A | A | A | 16 | 23 |
| 11 | A | A | A | A | A | A | A | A | 19 | 24 |
| 12 | B | A | A | A | A | A | A | A | 20 | 23 |
| 13 | B | B | A | A | B | A | A | A | 21 | 22 |
| 14 | B | A | A | A | A | A | A | A | 20 | 23 |
| 15 | B | B | B | A | B | A | A | A | 20 | 24 |
| 16 | B | A | A | A | A | A | A | A | 22 | 23 |
| 17 | B | B | B | A | B | B | A | A | 27 | 26 |
| 18 | B | B | B | A | B | B | A | A | 27 | 25 |
| 19 | B | B | B | A | B | B | A | A | 26 | 25 |
| 20 | B | A | A | A | A | A | A | A | 27 | 25 |
| 21 | B | A | A | A | B | A | A | A | 24 | 22 |

TABLE 12-continued

| | Endurance image deletion test | | | | | | | | | |
|---|---|---|---|---|---|---|---|---|---|---|
| | Under environment of high temperature and high humidity: H/H | | | | Under environment of normal temperature and normal humidity: N/N | | | | Fluctuation of electric potential | |
| Example | 1 L | 2 L | 4 L | 8 L | 1 L | 2 L | 4 L | 8 L | $\Delta V_d/V$ | $\Delta V_l/V$ |
| 22 | C | B | A | A | B | B | A | A | 26 | 25 |
| 23 | C | C | B | A | B | B | A | A | 28 | 25 |
| 24 | A | A | A | A | A | A | A | A | 26 | 12 |
| 25 | A | A | A | A | A | A | A | A | 26 | 13 |
| 26 | B | B | B | A | B | B | A | A | 33 | 12 |
| 27 | B | B | A | A | B | A | A | A | 17 | 23 |
| 28 | B | B | A | A | B | A | A | A | 17 | 23 |
| 29 | B | B | A | A | B | A | A | A | 19 | 23 |
| 30 | B | B | A | A | B | A | A | A | 17 | 23 |
| 31 | B | B | A | A | B | A | A | A | 17 | 23 |
| 32 | C | B | B | A | B | B | B | A | 28 | 24 |
| 33 | B | B | B | A | B | B | A | A | 28 | 23 |
| 34 | B | B | A | A | B | A | A | A | 27 | 23 |
| 35 | B | A | A | A | B | A | A | A | 25 | 23 |
| 36 | C | B | A | A | B | B | A | A | 27 | 23 |
| 37 | C | C | B | A | B | B | A | A | 29 | 23 |
| 38 | B | A | A | A | A | A | A | A | 16 | 22 |
| 39 | B | B | A | A | B | A | A | A | 17 | 22 |
| 40 | B | B | B | A | B | B | A | A | 27 | 22 |
| 41 | B | A | A | A | A | A | A | A | 15 | 19 |
| 42 | B | B | A | A | B | A | A | A | 17 | 19 |
| 43 | B | B | B | A | B | B | A | A | 27 | 19 |

TABLE 13

| | Endurance image deletion test | | | | | | | | | |
|---|---|---|---|---|---|---|---|---|---|---|
| | Under environment of high temperature and high humidity: H/H | | | | Under environment of normal temperature and normal humidity: N/N | | | | Fluctuation of electric potential | |
| Example | 1 L | 2 L | 4 L | 8 L | 1 L | 2 L | 4 L | 8 L | $\Delta V_d/V$ | $\Delta V_l/V$ |
| 44 | B | A | A | A | A | A | A | A | 17 | 22 |
| 45 | B | A | A | A | A | A | A | A | 17 | 22 |
| 46 | B | A | A | A | A | A | A | A | 18 | 22 |
| 47 | B | B | A | A | B | A | A | A | 18 | 23 |
| 48 | B | A | A | A | A | A | A | A | 18 | 22 |
| 49 | B | B | B | A | B | B | A | A | 28 | 22 |
| 50 | B | A | A | A | A | A | A | A | 28 | 22 |
| 51 | C | B | A | A | B | B | A | A | 25 | 22 |
| 52 | C | C | B | A | B | B | B | A | 28 | 22 |
| 53 | C | C | C | B | B | B | B | A | 30 | 23 |
| 54 | B | B | B | A | B | A | A | A | 15 | 34 |
| 55 | B | B | B | A | B | B | A | A | 18 | 33 |
| 56 | B | B | B | A | B | A | A | A | 27 | 33 |
| 57 | C | B | B | A | B | B | B | A | 15 | 38 |
| 58 | C | B | B | A | B | B | B | A | 16 | 36 |
| 59 | C | B | B | A | B | B | B | A | 15 | 39 |
| 60 | C | B | B | A | B | B | B | A | 18 | 39 |
| 61 | B | B | B | A | B | A | A | A | 15 | 39 |
| 62 | B | B | B | A | B | A | A | A | 15 | 37 |
| 63 | B | B | B | A | B | B | A | A | 17 | 39 |
| 64 | C | B | B | A | B | B | B | A | 18 | 39 |
| 65 | B | B | B | A | B | A | A | A | 18 | 39 |
| 66 | B | B | B | A | B | B | A | A | 21 | 39 |
| 67 | C | B | B | A | B | B | B | A | 26 | 38 |
| 68 | B | B | B | A | B | B | A | A | 25 | 39 |
| 69 | B | A | A | A | B | A | A | A | 23 | 38 |
| 70 | C | B | A | A | B | B | A | A | 25 | 38 |
| 71 | C | C | B | A | B | B | A | A | 27 | 39 |
| 72 | B | A | A | A | A | A | A | A | 16 | 25 |
| 73 | B | B | A | A | B | A | A | A | 20 | 25 |
| 74 | B | B | A | A | B | A | A | A | 22 | 24 |
| 75 | B | B | A | A | B | A | A | A | 15 | 28 |
| 76 | B | B | A | A | B | A | A | A | 15 | 27 |
| 77 | B | B | A | A | B | A | A | A | 18 | 28 |
| 78 | B | B | B | A | B | A | A | A | 20 | 28 |
| 79 | B | B | A | A | B | A | A | A | 21 | 27 |
| 80 | B | B | A | A | B | A | A | A | 27 | 28 |

TABLE 13-continued

| | Endurance image deletion test | | | | | | | | | |
|---|---|---|---|---|---|---|---|---|---|---|
| | Under environment of high temperature and high humidity: H/H | | | | Under environment of normal temperature and normal humidity: N/N | | | | Fluctuation of electric potential | |
| Example | 1 L | 2 L | 4 L | 8 L | 1 L | 2 L | 4 L | 8 L | $\Delta V_d/V$ | $\Delta V_l/V$ |
| 81 | B | A | A | A | B | A | A | A | 24 | 28 |
| 82 | C | B | A | A | B | B | A | A | 25 | 28 |
| 83 | C | C | B | A | B | B | A | A | 27 | 28 |

TABLE 14

| | Endurance image deletion test | | | | | | | | | |
|---|---|---|---|---|---|---|---|---|---|---|
| | Under environment of high temperature and high humidity: H/H | | | | Under environment of normal temperature and normal humidity: N/N | | | | Fluctuation of electric potential | |
| Example | 1 L | 2 L | 4 L | 8 L | 1 L | 2 L | 4 L | 8 L | $\Delta V_d/V$ | $\Delta V_l/V$ |
| 84 | B | B | A | A | B | A | A | A | 15 | 30 |
| 85 | B | B | A | A | B | A | A | A | 15 | 28 |
| 86 | B | B | A | A | B | A | A | A | 17 | 30 |
| 87 | B | B | A | A | B | A | A | A | 20 | 30 |
| 88 | B | B | B | A | B | B | A | A | 27 | 29 |
| 89 | B | B | A | A | B | A | A | A | 27 | 29 |
| 90 | C | B | A | A | B | B | A | A | 25 | 31 |
| 91 | C | C | B | A | B | B | A | A | 28 | 29 |
| 92 | C | C | B | A | B | B | B | A | 30 | 30 |
| 93 | B | B | B | A | B | A | A | A | 15 | 31 |
| 94 | B | B | B | A | B | A | A | A | 20 | 31 |
| 95 | C | B | B | A | B | B | B | A | 27 | 31 |
| 96 | B | B | B | A | B | A | A | A | 26 | 31 |
| 97 | B | B | B | A | B | A | A | A | 15 | 33 |
| 98 | B | B | B | A | B | A | A | A | 18 | 33 |
| 99 | B | B | B | A | B | A | A | A | 15 | 33 |
| 100 | C | B | B | A | B | B | B | A | 19 | 34 |
| 101 | C | B | B | A | B | B | B | A | 26 | 34 |
| 102 | B | B | B | A | B | A | A | A | 25 | 32 |
| 103 | B | A | A | A | B | A | A | A | 23 | 34 |
| 104 | C | B | A | A | B | B | A | A | 25 | 33 |
| 105 | C | C | B | A | B | B | A | A | 27 | 34 |
| 106 | B | B | B | A | B | A | A | A | 15 | 32 |
| 107 | B | B | B | A | B | A | A | A | 20 | 33 |
| 108 | C | B | B | A | B | B | B | A | 26 | 33 |
| 109 | B | A | A | A | A | A | A | A | 15 | 24 |
| 110 | B | A | A | A | A | A | A | A | 15 | 23 |
| 111 | B | A | A | A | A | A | A | A | 18 | 24 |
| 112 | B | B | A | A | B | A | A | A | 16 | 23 |
| 113 | B | B | B | A | B | A | A | A | 27 | 23 |
| 114 | B | B | A | A | B | A | A | A | 26 | 24 |
| 115 | B | A | A | A | A | A | A | A | 15 | 32 |
| 116 | C | B | B | A | B | B | B | A | 15 | 47 |
| 117 | C | B | B | A | B | B | B | A | 15 | 47 |
| 118 | C | B | B | A | B | B | B | A | 18 | 46 |
| 119 | C | B | B | A | B | B | B | A | 16 | 46 |
| 120 | C | C | B | A | B | B | B | A | 27 | 46 |
| 121 | C | B | B | A | B | B | B | A | 26 | 48 |
| 122 | C | B | B | A | B | B | B | A | 15 | 48 |
| 123 | B | B | B | A | B | A | A | A | 15 | 28 |
| 124 | B | B | B | A | B | A | A | A | 15 | 33 |
| 125 | C | B | B | A | B | B | B | A | 15 | 48 |
| 126 | C | B | B | A | B | B | B | A | 15 | 49 |
| 127 | C | B | B | A | B | B | B | A | 15 | 35 |
| 128 | C | B | B | A | B | B | B | A | 15 | 37 |

TABLE 15

| Comparative Example | Endurance image deletion test: Under environment of high temperature and high humidity: H/H 1 L | 2 L | 4 L | 8 L | Under environment of normal temperature and normal humidity: N/N 1 L | 2 L | 4 L | 8 L | Fluctuation of electric potential $\Delta V_d/V$ | $\Delta V_l/V$ |
|---|---|---|---|---|---|---|---|---|---|---|
| 1 | C | C | C | C | C | C | C | B | 39 | 67 |
| 2 | C | C | C | C | C | C | C | B | 43 | 66 |
| 3 | C | C | C | C | C | C | C | B | 43 | 66 |
| 4 | C | C | C | C | C | C | B | B | 37 | 67 |
| 5 | C | C | C | C | C | C | C | C | 36 | 68 |
| 6 | C | C | C | C | C | C | C | C | 40 | 67 |
| 7 | C | C | C | C | C | C | C | C | 34 | 68 |
| 8 | C | C | C | C | C | C | C | B | 36 | 67 |
| 9 | C | C | C | B | C | B | B | B | 31 | 67 |
| 10 | C | C | C | B | C | C | B | B | 36 | 92 |
| 11 | C | C | C | C | C | C | C | C | 34 | 92 |
| 12 | C | C | C | C | C | B | B | B | 33 | 93 |
| 13 | C | C | C | C | C | C | B | B | 42 | 84 |
| 14 | C | C | C | C | C | C | C | C | 37 | 82 |
| 15 | C | C | C | C | C | B | B | B | 34 | 83 |
| 16 | C | C | C | B | C | C | B | B | 40 | 39 |
| 17 | C | C | C | B | C | C | B | B | 36 | 39 |
| 18 | C | C | C | C | C | C | B | B | 36 | 39 |
| 19 | C | C | C | C | C | C | B | B | 39 | 39 |
| 20 | C | C | C | C | C | C | B | B | 36 | 40 |
| 21 | C | C | C | B | C | C | B | B | 51 | 21 |
| 22 | C | C | C | B | C | C | B | B | 48 | 39 |
| 23 | C | C | C | B | C | C | B | B | 42 | 32 |
| 24 | C | C | C | B | C | C | B | B | 31 | 59 |
| 25 | C | C | C | B | C | C | B | B | 36 | 62 |
| 26 | C | C | C | B | C | C | B | B | 39 | 47 |
| 27 | C | C | C | B | C | C | B | B | 37 | 65 |
| 28 | C | C | C | B | C | C | B | B | 40 | 34 |

Reference Example 1

The first support without anodization was dip-coated with the coating liquid 1 for the electroconductive layer to have a coating film formed thereon, the coating film was heated and dried at 145° C. for 60 minutes, and thereby the first electroconductive layer was formed which had a film thickness of 30 nm.

Reference Example 2

The first support without anodization was dip-coated with the coating liquid 2 for the electroconductive layer to have a coating film formed thereon, the coating film was heated and dried at 170° C. for 20 minutes, and thereby the first electroconductive layer was formed which had a film thickness of 30 nm.

Reference Example 3

The first support without anodization was dip-coated with the coating liquid 3 for the electroconductive layer to have a coating film formed thereon, the coating film was heated and dried at 160° C. for 30 minutes, and thereby the first electroconductive layer was formed which had a film thickness of 18 nm.

Figure 5:
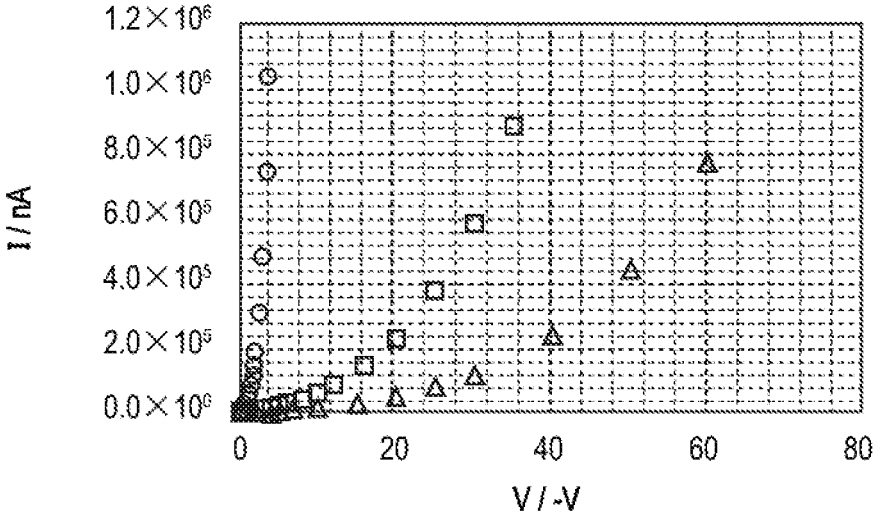
FIG. 5 illustrates a graph illustrating the measurement results of the voltage-current characteristics (V-I curve) of monolayers of the electroconductive layers described in Reference Examples 1 to 3, respectively.

The voltage-current characteristics (V-I curve) of each monolayer of the three types of first electroconductive layer, which were obtained in Reference Examples 1 to 3, were measured by the previously described method. The results are shown in FIG. 5. In addition, a graph is shown in FIG. 6, in which FIG. 5 is re-illustrated by a $\sqrt{E}$-log(I) curve.

Figure 6:
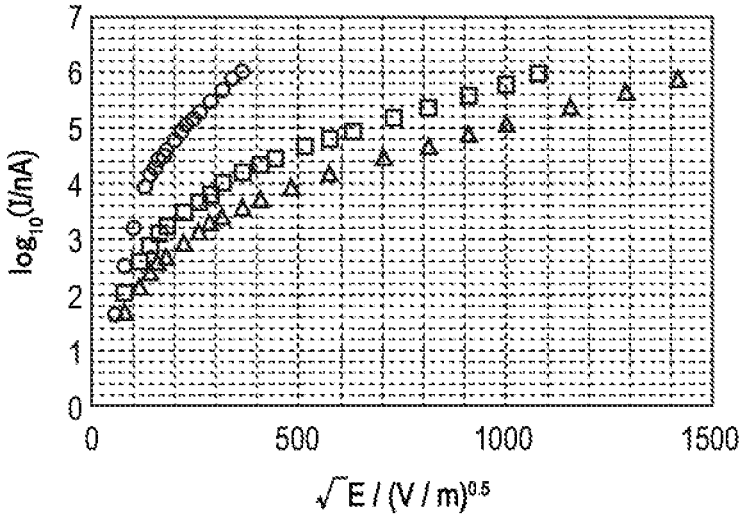
FIG. 6 illustrates a graph which re-illustrates the measurement results of the voltage-current characteristics (V-I curve) of monolayers of the electroconductive layers described in Reference Examples 1 to 3, respectively, in a form of a √E-log(I) curve.

In FIG. 5 and FIG. 6, circle marks indicate Reference Example 1, triangle marks indicate Reference Example 2, and square marks indicate Reference Example 3.

As is understood from FIG. 5 and FIG. 6, the voltage-current characteristics of a monolayer of the first electroconductive layer illustrate a varistor property, but does not illustrate a strong varistor property of the present disclosure.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-191566, filed Oct. 18, 2019, which is hereby incorporated by reference herein in its entirety.

What is claimed is:

1. A process cartridge detachably attachable to a main body of an electrophotographic apparatus, the process cartridge comprising:

an electrophotographic photosensitive member; and a charging member, wherein the electrophotographic photosensitive member comprises a first support and a photosensitive layer, when an electric current is measured which flows when a voltage is applied to a surface of the electrophotographic photosensitive member while being varied, there exists a point at which gradients change, in a graph in which a horizontal axis is a square root of an electric field strength E [V/m] in the photosensitive layer, and a vertical axis is a common logarithm of the electric current, and when a gradient of the graph is represented by $a_1$, in a region in which the electric field strength is smaller than that of the point at which the gradients change, and a gradient of the graph is represented by $a_2$, in a region in which the electric field strength is larger than that of the point at which the gradients change, $a_2/a_1$ is 1.50 or larger; and the charging member comprises a second support having an electroconductive outer surface, and a second electroconductive layer provided on the outer surface of the second support, wherein the second electroconductive layer comprises a matrix containing a first rubber, and a plurality of domains that are dispersed in the matrix, wherein the domain comprises a second rubber and an electron conducting agent, at least a portion of the domain is exposed to an outer surface of the charging member, and the outer surface of the charging member comprises at least the matrix and at least a portion of the domain, wherein when a volume resistivity of the matrix is represented by $\rho_M$ [Ω·cm] and a volume resistivity of the domain is represented by $\rho_D$ [Ω·cm], $\rho_M$ is $1.0\times10^5$ times or higher of $\rho_D$.

2. The process cartridge according to claim 1, wherein in the electrophotographic photosensitive member, the gradients $a_2$ and $a_1$ satisfy $a_2/a_1\geq1.80$.

3. The process cartridge according to claim 2, wherein in the electrophotographic photosensitive member, the gradients $a_2$ and $a_1$ satisfy $a_2/a_1\geq2.20$.

4. The process cartridge according to claim 1, wherein in the electrophotographic photosensitive member, a point at which the gradients change exists in a range in which the square root $E^{*0.5}$ of the electric field strength is 3000 $[(V/m)^{0.5}]$ or larger and 9000 $[(V/m)^{0.5}]$ or smaller.

5. The process cartridge according to claim 4, wherein in the electrophotographic photosensitive member, the point at which the gradients change exists in a range in which the square root $E^{*0.5}$ of the electric field strength is 5000 $[(V/m)^{0.5}]$ or larger and 7000 $[(V/m)^{0.5}]$ or smaller.

6. The process cartridge according to claim 1, wherein in the electrophotographic photosensitive member, the gradient $a_2$ is 0.00070 or larger and 0.00090 or smaller.

7. The process cartridge according to claim 1, wherein in the electrophotographic photosensitive member, the photosensitive layer contains a phthalocyanine pigment as a charge generation substance.

8. The process cartridge according to claim 1, wherein in the charging member, a volume resistivity of the matrix is higher than $1.0\times10^{12}$ [Ω·cm].

9. The process cartridge according to claim 1, wherein the gradients $a_2$ and $a_1$ of the electrophotographic photosensitive member and an arithmetic mean value $D_m$ [μm] of inter-domain distances of the charging member satisfy $D_m\times a_1/a_2\leq10$.

10. The process cartridge according to claim 1, wherein in the charging member, an arithmetic mean value $D_m$ of inter-domain distances of the charging member is 40 [μm] or smaller.

11. An electrophotographic apparatus comprising:

an electrophotographic photosensitive member; and a charging member, wherein the electrophotographic photosensitive member comprises a first support and a photosensitive layer, when an electric current is measured which flows when a voltage is applied to a surface of the electrophotographic photosensitive member while being varied, there exists a point at which gradients change, in a graph in which a horizontal axis is a square root of an electric field strength E [V/m] in the photosensitive layer, and a vertical axis is a common logarithm of the electric current, and when a gradient of the graph is represented by $a_1$, in a region in which the electric field strength is smaller than that of the point at which the gradients change, and a gradient of the graph is represented by $a_2$, in a region in which the electric field strength is larger than that of the point at which the gradients change, $a_2/a_1$ is 1.50 or larger; and the charging member comprises a second support having an electroconductive outer surface, and a second electroconductive layer provided on the outer surface of the second support, wherein the second electroconductive layer comprises a matrix containing a first rubber, and a plurality of domains that are dispersed in the matrix, wherein the domain comprises a second rubber and an electron conducting agent, at least a portion of the domain is exposed to an outer surface of the charging member, and the outer surface of the charging member comprises at least the matrix and at least a portion of the domain, wherein when a volume resistivity of the matrix is represented by $\rho_M$ [Ω·cm] and a volume resistivity of the domain is represented by $\rho_D$ [Ω·cm], $\rho_M$ is $1.0\times10^5$ times or higher of $\rho_D$.

* * * * *